US009554222B2

(12) United States Patent
Miller et al.

(10) Patent No.: US 9,554,222 B2
(45) Date of Patent: Jan. 24, 2017

(54) ELECTROMECHANICAL TRANSDUCER WITH MECHANICAL ADVANTAGE

(71) Applicant: Cochlear Limited, Macquarie University, NSW (AU)

(72) Inventors: Scott Miller, Lafayette, CO (US); Travis Rian Andrews, Loveland, CO (US); Robert F. McCullough, Boulder, CO (US); Farid Moumane, Na (FR)

(73) Assignee: Cochlear Limited, Macquarie University, NSW (AU)

( * ) Notice: Subject to any disclaimer, the term of this patent is extended or adjusted under 35 U.S.C. 154(b) by 473 days.

(21) Appl. No.: 13/916,214

(22) Filed: Jun. 12, 2013

(65) Prior Publication Data

US 2014/0163308 A1 Jun. 12, 2014

Related U.S. Application Data

(63) Continuation-in-part of application No. 13/708,781, filed on Dec. 7, 2012.

(60) Provisional application No. 61/567,846, filed on Dec. 7, 2011.

(51) Int. Cl.
*H04R 25/00* (2006.01)
*H04R 17/00* (2006.01)

(52) U.S. Cl.
CPC ..... *H04R 25/606* (2013.01); *H04R 17/00* (2013.01); *H04R 25/554* (2013.01); *H04R 2225/31* (2013.01); *H04R 2460/13* (2013.01); *Y10T 29/42* (2015.01)

(58) Field of Classification Search
CPC ... H04R 17/00; H04R 25/554; H04R 2460/13; H04R 25/606; H04R 2225/31; Y10T 29/42
See application file for complete search history.

(56) References Cited

U.S. PATENT DOCUMENTS 5,800,336 A * 9/1998 Ball ..... H04R 25/606 600/25
5,815,872 A * 10/1998 Meginniss, III ... A46B 15/0002 15/105
6,759,790 B1 * 7/2004 Bugel ..... H02N 2/043 310/328
2005/0215852 A1 * 9/2005 Hatami ..... A61H 19/44 600/38

* cited by examiner

*Primary Examiner* — Christine H. Matthews
*Assistant Examiner* — Joshua D Lannu
(74) *Attorney, Agent, or Firm* — Hauptman Ham, LLP

(57) ABSTRACT

A vibratory apparatus including a lever arm apparatus including a living hinge, wherein the vibratory apparatus is configured such that at least a portion of the lever arm moves about the living hinge when the vibratory apparatus is generating vibrations.

18 Claims, 34 Drawing Sheets

ELECTROMECHANICAL TRANSDUCER WITH MECHANICAL ADVANTAGE

CROSS-REFERENCE TO RELATED APPLICATIONS

The present application claims priority as a continuation-in-part to U.S. patent application Ser. No. 13/708,781, entitled Electromechanical Transducer with Mechanical Advantage, filed on Dec. 7, 2012, naming Scott Miller, Travis Andrews, Robert McCullogh and Farid Moumane as inventors, which in turn claims priority to U.S. Provisional Patent Application No. 61/567,846, entitled Implantable Electromechanical Transducer With Mechanical Advantage, filed on Dec. 7, 2011, naming Scott Miller, Travis Andrews, Robert McCullogh and Farid Moumane as inventors. The entire contents of these applications are incorporated herein by reference in their entirety.

FIELD OF THE INVENTION

The present invention relates to implantable auditory stimulation systems, and more particularly, to an improved bone anchored actuator/transducer that is operative to transmit sound by direct conduction through bone to the inner ear.

BACKGROUND OF THE INVENTION

The utilization of implanted hearing instruments continues to increase with improving technology. Such implantable hearing instruments provide operative and cosmetic utilitarian features relative to conventional ear canal hearing devices. For example, implantable hearing devices offer operative utilitarian features in relation to patients having certain types of conductive or sensorineural hearing loss (e.g., mixed hearing loss comprising a conductive loss component of 45 dB or more with sensorineural hearing loss component of 40 dB or more). These patients are generally known to perform poorly with conventional hearing aids because their conductive and sensorineural hearing loss components are additive and these patients require substantial amounts of gain and output for proper speech recognition.

Conductive hearing loss can happen when there is a problem conducting sound waves anywhere along the route through the outer ear, tympanic membrane (eardrum), or middle ear (ossicles) and is sometimes termed middle ear hearing loss. Sensorineural hearing loss occurs in the inner ear and/or neural pathways. In patients with sensorineural hearing loss, the external and middle ear can function normally (e.g., sound vibrations are transmitted undisturbed through the eardrum and ossicles where fluid waves are created in the cochlea). However, due to damage to the pathway for sound impulses from the hair cells of the inner ear to the auditory nerve and the brain, the inner ear cannot detect the full intensity and quality of the sound. Sometimes conductive hearing loss occurs in combination with sensorineural hearing loss. In other words, there can be damage in the outer or middle ear and in the inner ear or auditory nerve. When this occurs, the hearing loss is sometimes referred to as a mixed hearing loss.

In instances of middle ear or mixed hearing loss, bone conduction devices, such as bone anchored hearing instruments, provide an option for patients in addition to standard hearing instruments or middle and inner ear hearing instruments. Bone anchored hearing instruments utilize a surgically implanted abutment to transmit sound by direct conduction through bone to the inner ear, bypassing the external auditory canal and middle ear. Accordingly, in cases where the middle ear is damaged or deformed, bone anchored hearing instruments provide a viable hearing solution that is typically less invasive than either a middle ear hearing instrument or a cochlear implant.

Some types of bone anchored hearing instruments have a bone screw surgically embedded into the skull with a small abutment exposed though the overlying tissue/skin. An external sound processor connects onto this abutment and transmits vibrations in response to a sound signal to the abutment and hence the bone screw. The implant vibrates the skull and inner ear, which stimulate the nerve fibers of the inner ear, thus providing hearing.

There have been attempts to produce an implantable actuator for generating the necessary vibrations where the implantable actuator can be wirelessly coupled to an external sound processor. However, to date, these attempts have resulted in actuators that provide the vibration of frequency and/or amplitude to stimulate hearing in a manner that has limited utility. For instance, provision of adequate stimulation in these systems can require excitation of a large mass to generate vibration of a magnitude necessary to simulate hearing. This is especially true at low frequencies. Displacement of such a large mass has further complicated efforts due to the high power demands of these devices. That is, as implantable devices typically require a rechargeable battery for energy storage, the power consumption demands of devices utilizing large masses has resulted in devices that do not, inter alia, have an adequate operating duration between charges.

SUMMARY OF THE INVENTION

In view of the foregoing a bone conduction actuator/transducer (BCT) (also herein referred to as a bone conduction device) which can be implantable (e.g., such as used in a active transcutaneous bone conduction device) and/or can be applied to the outside of the skin (e.g., such as used in a passive transcutaneous bone conduction device) is provided that can generate large vibrational forces while using a relatively compact mass and relatively low power consumption. In one exemplary arrangement the BCT utilizes a mechanical advantage to convert a low displacement, high force output of an actuator to a high displacement, low force output. This generates utilitarian momentum to generate an increased force without use of a relatively large mass.

An exemplary embodiment provides an implantable and/or externally attachable electromechanical transducer which can improve coupling, reduces infection, and cosmetics. At least some exemplary embodiments provide a transducer that generates a relatively large force output, and does so with relatively low power consumption. It is noted at this time that while the embodiments detailed herein are often described in terms of an implantable device, other embodiments include devices that are applied externally to the recipient. It is further noted that while embodiments detailed herein are described in terms of vibratory apparatuses that vibrate when an electrical signal is applied thereto, the teachings detailed herein and or variations thereof are applicable to apparatuses that detect vibration and output a signal indicative of the detected vibrations. Still further, it is noted that the teachings detailed herein and or variations thereof can be applicable to any device system or method that utilizes piezoelectric transducers.

According to an exemplary aspect, an implantable vibratory actuator is provided for use in a bone conduction transducer that utilizes a lever arrangement to convert a low displacement high force output of an actuator into a high displacement low force output. Specifically, the implantable vibratory actuator includes a housing having a hermetically sealed internal chamber. Disposed within the internal chamber is a lever having a first end and a second free end. The first end of the lever connects to the housing via a hinge or is fixedly interconnected thereto. In the latter regard, the lever can be a cantilever. A piezoelectric element is disposed within the internal chamber that is adapted to deform in response to an applied voltage. The deformation of the piezoelectric element is applied to the lever such that this deformation displaces the second free end of the lever. To provide a mechanical advantage/amplification, the displacement of the free end of the lever can be greater than a deformation displacement of the piezoelectric element. Further, the displacement of the free end of the lever within the internal chamber imparts a vibration to the housing.

In various arrangements, the free end of the lever can support a mass in order to provide a utilitarian momentum. Further, it will be appreciated that the length of the lever can be adjusted to increase displacement and/or velocity of the free end of the lever. In one arrangement, the displacement of the free end of the lever is at least five times the deformation displacement of the piezoelectric element. In a further arrangement, displacement of the free end is at least ten times the deformation displacement of the piezoelectric element.

In further arrangements, the free end of the lever and/or a mass supported thereon, can be designed to have a predetermined resonance frequency. In one arrangement, the resonant frequency of the free end of the lever is between about 500 Hz and 1 KHz. In a further arrangement, the resonant frequency is between about 700 Hz and about 800 Hz. It will be appreciated that in addition to such resonant frequencies, the lever can have additional resonant frequencies (e.g., harmonic frequencies).

In one arrangement, the lever is adapted to translate movement of the actuator from a first direction to a second direction. For instance, in one arrangement, the piezoelectric element can have a long axis that can be aligned with a surface (e.g., base surface and/or top surface) of the implant housing. In such an arrangement, movement of the second free end of the lever can have a component that is normal to this surface. In this regard, the lever can be a nonlinear lever (e.g., right angle or other nonlinear element) that translates movement from the first direction to a second direction. In one arrangement, movement of the free second end has a primary component that is transverse to the direction of axial expansion of the piezoelectric element. In this regard, a majority of the movement of the free second end is transverse to an axial deformation/displacement of the piezoelectric element.

In an arrangement where the first end of the lever is fixedly attached to the housing such that the lever is a cantilever, the lever can further include a flexible portion disposed between its first and second ends. In this arrangement, such a flexible portion can be defined by a connection having a reduced cross-sectional area in relation to adjacent cross-sectional areas to the lever and/or housing. In this regard, flexible portion can define a flexural hinge. In a further arrangement, this flexible portion is disposed between the interconnection of the lever to the housing and a location where the piezoelectric element applies a force to the lever. In a further arrangement, the lever includes at least a second flexible portion along its length. The second flexible portion can be disposed at a location along the length of the lever beyond the location where the piezoelectric element applies a force to the lever. The second flexible portion can define one or more resonant frequencies for the second free end of the lever. In such an arrangement, the second free end of the lever and/or any supported mass thereon can form a resonator.

In another arrangement, the piezoelectric element is interconnected to the lever such that displacement of the free second end of the lever displaces at least a portion of the piezoelectric element. In such an arrangement, a length of the lever can, in a static position, be substantially aligned with the base surface of the internal chamber. Accordingly, movement of the free second end of the lever can have a component that is normal to the base surface. In such an arrangement, the piezoelectric element can form a portion of the mass that is utilized to impart vibrations to the implant housing for hearing augmentation purposes. Accordingly, by utilizing the piezoelectric element as a portion of the mass, the overall size of the vibratory actuator can be reduced. Where the piezoelectric element is connected to the lever, the piezoelectric element can be compliantly engaged to the lever at first and second ends to permit movement between these elements.

In one arrangement, the housing, lever and piezoelectric element are all nonmagnetic materials. In this regard, an implantable bone conduction transducer incorporating these elements can be safe for magnetic resonance imaging procedures.

According to another aspect, a transverse vibratory actuator is provided that allows for translating axial motion of the piezoelectric element from a first direction to a second direction while permitting, but not requiring, amplifying that deformation. The actuator includes a housing having a base surface and a hermetically sealed internal chamber. This base surface can define a reference plane and can be adapted for positioning against a skull surface of a patient. Disposed within the internal chamber is a lever having a first end fixedly connected to the housing and a second free end. The second free end of the lever supports a mass. A piezoelectric element is disposed within the internal surface and is adapted to deform in a direction substantially aligned with the base surface in response to an applied voltage. In this regard, the deformation axis of the piezoelectric element can be substantially parallel to the base surface. The deformation displacement of the piezoelectric element applies a force to the lever to displace the second free end of the lever and the mass in a direction that is primarily normal to the base surface. In this regard, movement of the second free end of the lever has a component of movement in the normal direction that can be greater than a component of movement that is parallel to the base. The displacement of the second free end of the lever and the mass imparts a vibration to the housing.

In one arrangement, an elongated rod is interconnected to an outside surface of the housing. Accordingly, vibrations imparted on the housing can be transmitted through to this elongated rod. Specifically, such vibrations can be transmitted through the rod where it interconnects to the housing to a second free end of the rod which can be selectively positioned relative to a patient's skull. As will be appreciated, this rod or vibration extension need not necessarily be a straight shaft. In one arrangement, the elongated rod is integrally formed with the portion of the housing where it connects. Accordingly, such integral formation can enhance vibration transmissions there between.

According to another aspect, a method is provided for use in an implantable actuator of a bone conduction hearing instrument. The method includes receiving a drive signal at an implanted housing. In response to the drive signal, a voltage can be applied to a piezoelectric element within the housing to deform the piezoelectric element in a first direction. A force associated with the deformation of the piezoelectric element is utilized to displace a free end of a lever supporting a mass within the housing. The displacement of the mass is greater than the deformation displacement of the piezoelectric element. Furthermore, the displacement of the free end of the lever and the mass within the internal chamber imparts a vibration to the implanted housing. In one arrangement, the displacement of the free end of the lever and the mass is at least ten times the deformation displacement of the piezoelectric element. In a further arrangement, displacing the free end of the lever includes displacing the lever and mass in a direction that is primarily transverse to the deformation direction of the piezoelectric element. In one particular arrangement, the piezoelectric element can be adapted to deform in a direction that is substantially aligned with the surface of the skull such that the displacement of the free end of the lever and supported mass is in a direction that is primarily transverse to this movement and substantially normal to the surface of the skull.

Receiving the drive signal can include receiving a transcutaneously transmitted signal from an external speech processing unit. In such an arrangement, the drive signal can be received at an implanted coil or RF receiver. In another arrangement, the step for receiving a drive signal can include receiving a drive signal from an implanted speech processing system.

In according to another aspect, an implantable bone conduction hearing instrument is provided. The instrument includes a speech processing system that is adapted to receive acoustic signals and generate a drive signal representative of the acoustic signals. The system further includes an implantable bone conduction transducer adapted for positioning relative to a patient's skull (e.g., on a skull surface and/or within the skull). The bone conduction transducer includes a biocompatible housing that defines a hermetically sealed internal chamber. Disposed within the internal chamber is a piezoelectric element that is adapted to deform in response to the drive signal as received from the speech processing unit. In response to the drive signal, the piezoelectric element deforms and displaces a lever within the internal chamber that supports a resonant mass. In one arrangement, the displacement of the lever and mass is at least ten times the displacement of the piezoelectric element. In another arrangement, the piezoelectric element can be disposed within the internal housing such that it is aligned with the base surface of the housing, which can be adapted for positioning on, within or against the surface of the skull. In such an arrangement, the displacement of the free end of the lever and mass can be in a direction that is substantially normal to the base surface and hence normal to the skull.

Numerous additional features and utilitarian aspects of at least some embodiments of the present invention will become apparent to those skilled in the art upon consideration of the embodiment descriptions provided hereinbelow.

BRIEF DESCRIPTION OF THE DRAWINGS

FIG. 8B illustrates an exemplary principle of operation according to an exemplary embodiment of that of FIG. 8A.

FIG. 8F illustrates another exemplary flowchart according to an exemplary method.

DETAILED DESCRIPTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application (s) or use(s) of the present invention.

Implantable Bone Conduction Hearing Instrument

Figure 1:
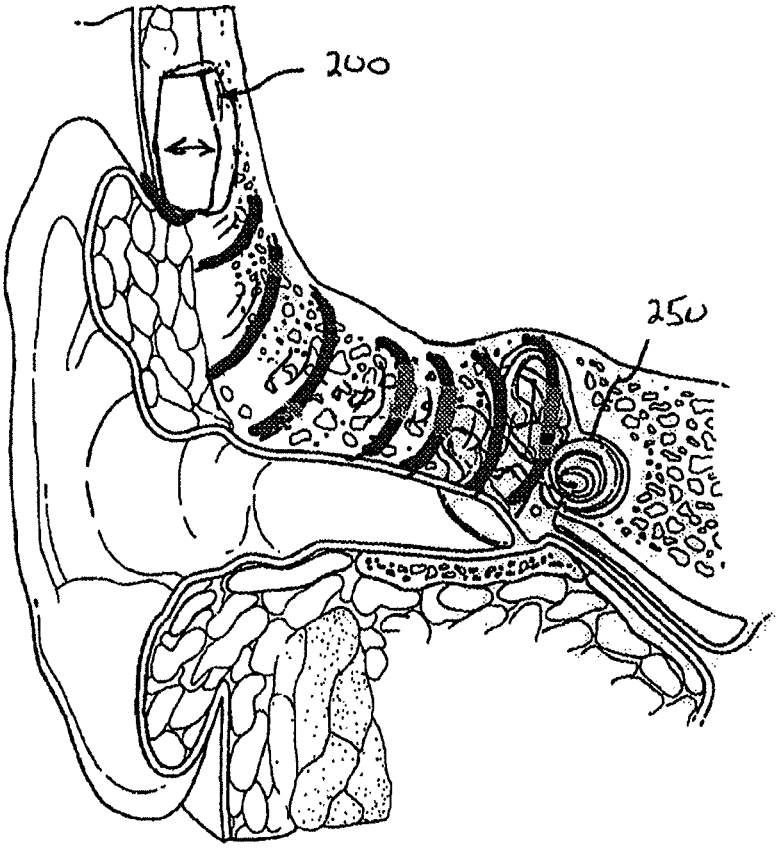
FIG. 1 illustrates transmissions of vibrations by bone conduction to a patient's cochlea.

FIG. 1 illustrates the use of an implantable bone conduction transducer (BCT) 200 to impart vibrations to the cochlea 250 of a patient to stimulate hearing. As illustrated, the BCT 200 is formed as a compact biocompatible/bio-inert housing that can be attached to the skull of a patient subcutaneously. In response to a received drive signal, an actuator disposed within the bio-inert housing vibrates. This vibration is imparted to the housing, which is secured to the skull. Accordingly, these vibrations are applied to the skull and at least a portion of these vibrations are transmitted through the skull to the cochlea 250. That is, the BCT 200 forces the skull to shake slightly. The ossicular chain has inertia and is somewhat isolated from the skull by suspending tendons and a soft tissue connection between the footplate of the stapes to the oval window. As a result, the ossicular chain lags behind this shaking of the skull. The cochlea, being firmly anchored in the skull, moves essentially with the skull. The resulting relative motion between the ossicular chain and the cochlea generates a differential displacement of the oval window and round window of the cochlea resulting in hearing stimulation. In patients, without an ossicular chain, the vibration alone can impart movement of fluid within the cochlea to stimulate hearing, though to a lesser magnitude.

The housing of the BCT 200 is firmly connected to the skull as excess compliance between the BCT 200 and the skull will reduce the force to the skull, and can introduce undesirable resonances. The mounting structure will typically have at least 3 points of connection. For instance, the housing of the BCT 200 can include three or more mounting holes (not shown). Alternatively, a bracket can be utilized to affix the BCT against the surface of the skull. In any arrangement, it is typically desirable that the bottom of the BCT housing be thinly in contact with the skull at least at one point. Such firm contact provides improved vibration conduction to underlying bone.

Figure 2A:
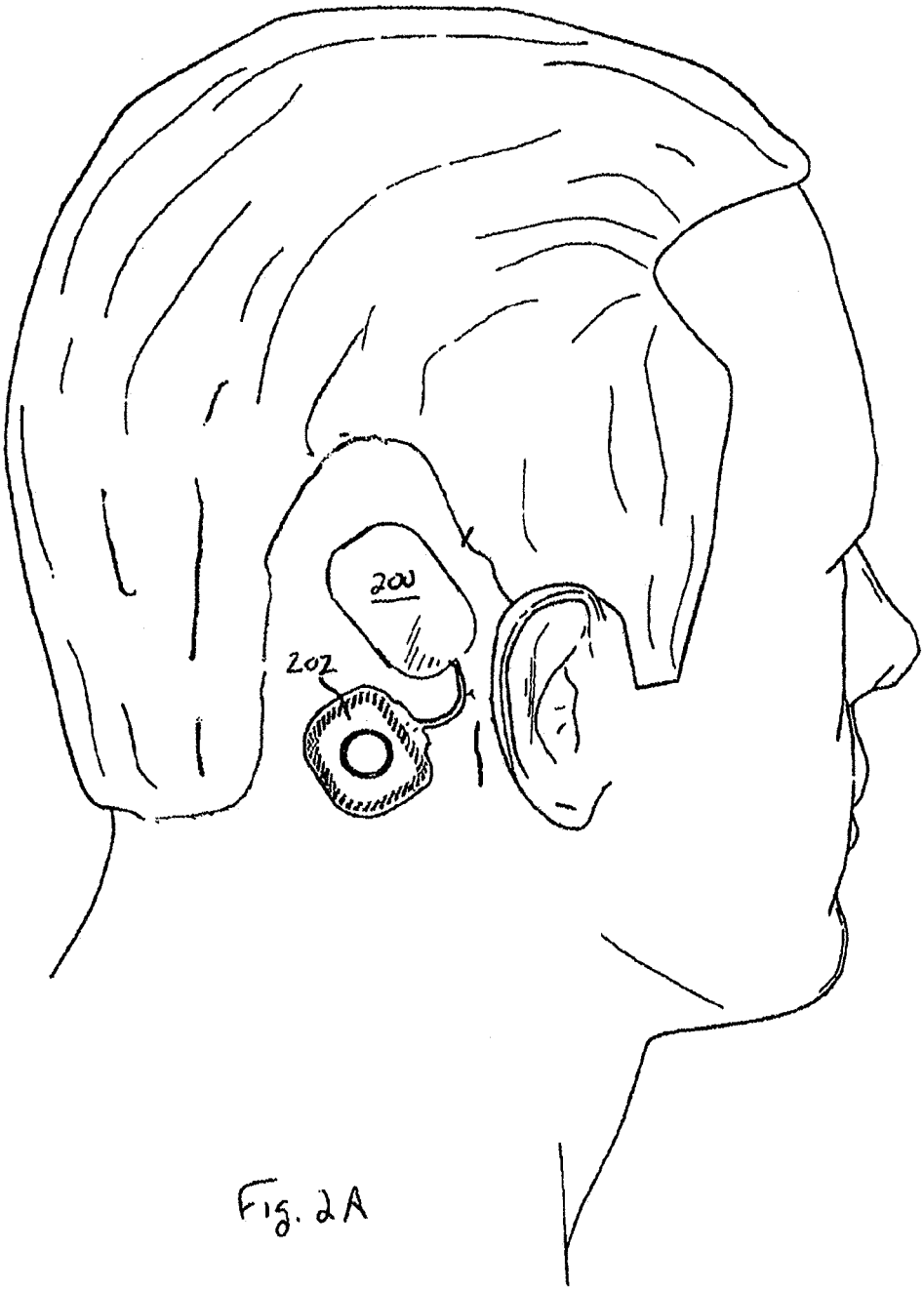
FIG. 2A illustrates one embodiment of a semi-implantable bone conduction hearing instrument.
Figure 2B:
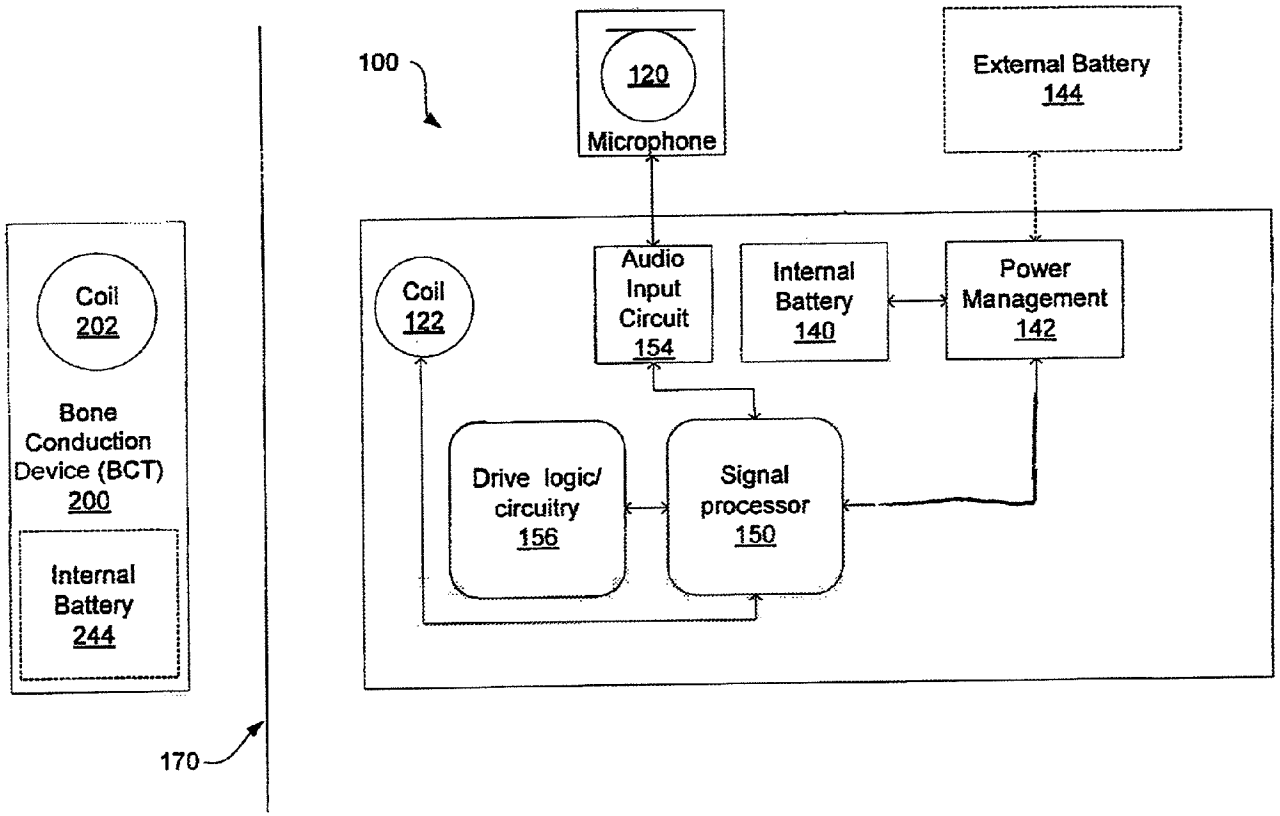
FIG. 2B illustrates a schematic view of the instrument of FIG. 2A.
Figure 3A:
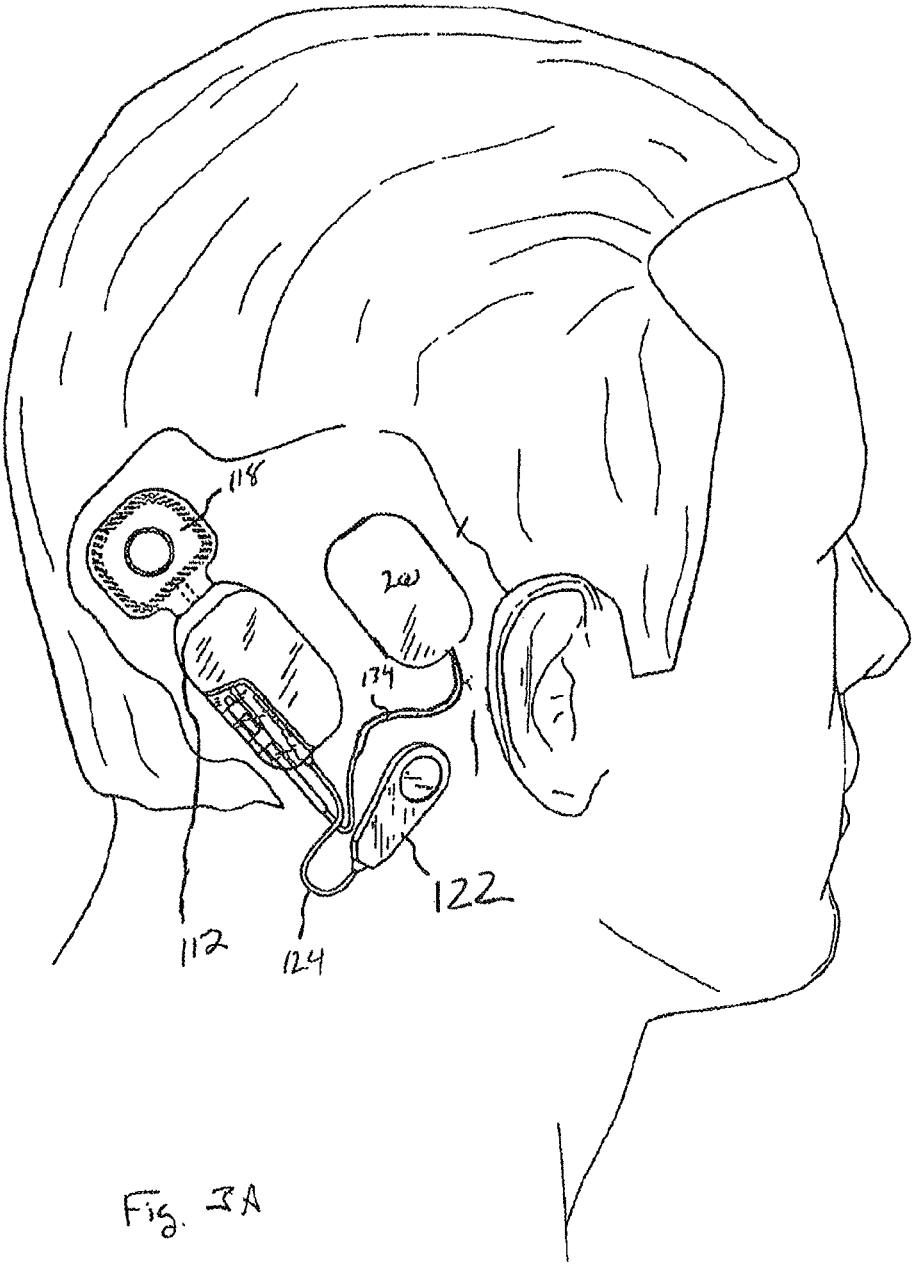
FIG. 3A illustrates a fully implantable bone conduction hearing instrument.
Figure 3B:
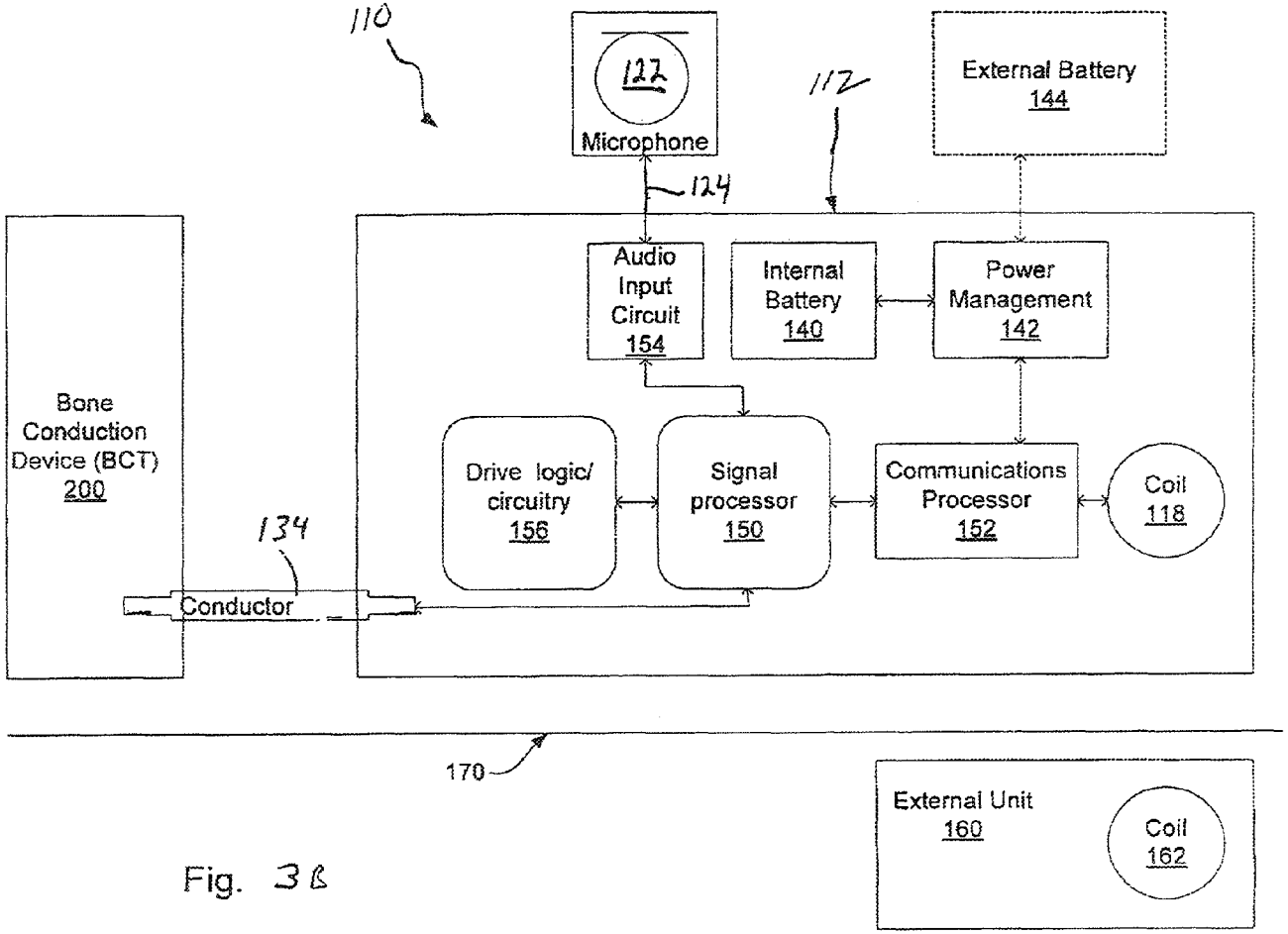
FIG. 3B illustrates a schematic view of the instrument of FIG. 3A.

The implantable BCT 200 can be utilized in different configurations. For instance, the BCT 200 can be incorporated into a semi-implantable bone conduction hearing instrument (BCHI) as illustrated in FIGS. 2A and 2B or can be incorporated into a fully implantable hearing instrument as illustrated in FIGS. 3A and 3B. Generally, there are two main components of the BCHI: bone conduction transducer (BCT) 200 and a speech processing unit.

The configuration of the speech processing unit depends upon the configuration of the BCHI. For instance, in the case of the semi-implantable BCHI illustrated in FIGS. 2A and 2B, the external speech processing unit 100 can be a behind-the-ear unit that includes a microphone 120, a speech processor 150, a transmitting/receiving coil 122, and a power source 140 and/or 144 (e.g., batteries). Alternatively, the external speech processing unit can be a wearable processing unit that is connected (e.g., wired) to a behind the ear transmitting coil (not shown). In either case, the transmitting coil 122 of the external unit will typically include one or more magnets for retentive positioning with a receiver/transmitter (e.g., coil) 202 of the BCT 200. Typically, one magnet is located under the skin near the receiver/transmitter 202 of the BCT 200 and the other in the center of the transmitting coil 122. In any case, the coils 122 and 202 are aligned across the skin 170 of a patient for transcutaneous communication.

The microphone 120 performs the function of the outer ear. That is, the microphone 120 picks up ambient sounds for processing. The speech processor 150, based on previous fittings (e.g., drive logic 156) selects the sounds most useful for understanding speech and codes them electronically. The electronic codes or drive signals are sent back to the transmitting coil 122. The external transmitting coil 122 sends the drive signals through the skin via inductive coupling to a receiving coil 202 of the BCT. The receiver coil 202 converts the drive signals into electrical signals that are utilized by the BCT 200 to generate vibrations. It will be appreciated that each coil is capable of inductively transmitting and receiving signals and that the terms 'receiving coil' and 'transmitting coil' can be utilized for purposes of clarity and not by way of limitation. Further, it will be appreciated that the external unit can in some instances provide power to the implanted BCT 200. In such arrangements, a power management module 142 can interface with internal battery 140 and/or external battery 144 of the speech processing unit 100 to provide operating power to the BCT 200. In other arrangements, the BCT can include an implanted power storage device (e.g., battery) 244. In such an arrangement, the BCT can be periodically recharged (e.g., at night) via an external source.

FIGS. 3A and 3B, illustrate a fully implantable BCHI. Like components of the speech processor and BCT of the fully implantable BCHI share common reference numbers with the embodiment of FIGS. 2A and 2B. As shown, the speech processing unit 110 is implanted below the surface of the skin 170 of the patient proximate to the BCT 200. In this regard, the speech processing unit 110 includes a biocompatible implant housing 112 that is adapted to be located subcutaneously on or proximate to a patient's skull. The speech processing unit 110 also includes a first receiving coil 118, a speech signal processor 150, a communications processor 152, audio input circuitry 154, an internal power supply or battery 140, a power management unit 142, drive logic and/or circuitry 156 and an implantable microphone 122. As shown, the internal battery 140 is interconnected to the power management unit 142, which is operative to provide power for the implantable hearing unit as provide necessary control functionality for use in charging the internal battery 140 utilizing transcutaneously received signals from an external unit 160 (i.e., received via the receiving coil 118). Of note, the hearing unit 110 can further incorporate one or more external batteries 144 (e.g. subcutaneously located apart from the housing 112), which can be operatively interconnected to the power management unit 142. This can allow the hearing unit 100 to have a power capacity that permits uninterrupted use of the BCT 200 for extended periods of time. The microphone 122 is interconnected to the implant housing 110 via a communications wire 124. This allows the microphone 122 to be subcutaneously positioned to receive acoustic signals through overlying tissue. However, it will be appreciated that in other embodiments a microphone can be integrated into the implant housing 112 (not shown). The implant housing 110 can be utilized to house a number of components of the implantable hearing unit 100.

An external unit 160, which includes a coil 162 for inductively coupling with the receiving coil 118 of the hearing unit 110, can be utilized to provide energy to the hearing unit 110 and/or BCT for use in recharging the battery or batteries of the hearing unit 110 or BCT, respectively. Further, the external unit can also be operative to provide programming instructions and or control instructions to the hearing unit. In this regard, the communications processor 152, which can in other embodiments be incorporated into the common processor with the signal processor 150, is operative to receive program instructions from external unit 160 as well as provide responses to the external unit 160. Various additional or different processing logic and/or circuitry components can be included in the implant housing 110 as a matter of design choice.

During operation, acoustic signals are received at the implanted microphone 122 and the microphone provides audio signals to the implantable hearing unit. The signal processor 150 processes the received audio signals to provide a processed audio signal (e.g., a drive signal) for transmission to the BCT 200. As will be appreciated, the implantable hearing unit can utilize digital processing techniques to provide frequency shaping, amplification, compression, and other signal conditioning, including conditioning based on patient-specific fitting parameters in a manner substantially similar to an external speech processing unit (e.g., 220 of FIG. 1). The implanted BCT 200 receives drive signals from the hearing unit via a connector 134 and converts the drive signals into vibrations, which are transmitted through the skull and stimulate the patient's cochlea and thereby causes the sensation of sound.

Bone Conduction Transducer Exemplary Features

As noted, the bone conductor transducer (BCT) 200 is designed to stimulate the cochlea via bone conduction. Specifically, the BCT does this by forcing the skull to shake slightly. In this regard, the BCT is a mechanical vibrator that imparts a vibration caused by controlled movement of an inertial mass within the BCT. Moving such an inertial mass (e.g., back and forth) generates a reactive force (e.g., vibration) on the case/housing of the BCT 200. Once the BCT 200 is secured to the skull of the patient, these vibrations are likewise transmitted to and through the skull to the cochlea.

A practical vibrator for use in an implantable housing in the subject to a number of real world constraints. One constraint can be that the vibrations applied to the skull need to have a minimum amplitude to induce a hearing response. Further, the size of the implant housing in which the inertial mass/vibrator is disposed is limited. That is, for subcutaneous implant positioning, it is often desirable that the thickness of the housing be less than 1 cm and more typically that the thickness be less than about 5 mm. This reduces the protuberance of the housing thereby protecting the implant from external contact and reducing cosmetic effects. Stated otherwise, the height of the implant housing above an underlying bone to which it is mounted (e.g., measured in a direction normal to a surface of the underlying bone) is limited. This limits the amplitude of movement of an inertial mass in a direction normal to the skull. In addition, the overall size if an implant housing is limited as it must mount onto and/or within a skull of a patient. Thus the size of a practical inertial mass is likewise limited.

Further complicating generation of a practical implantable bone conduction vibrator is that empirical studies show that, in bone conduction hearing, vibrations applied in a direction normal to the skull provide improved hearing response. That is, it has been observed that the normal excitation (i.e., vibrations moving perpendicular to the surface of the skull) can be more utilitarian (e.g., providing more efficiency of operation) than tangential excitation (i.e., vibrations moving across the surface of the skull). More specifically, it has been determined that vibration that is applied primarily normal to the skull (e.g., proximate to the mastoid) results in 5 to 10 dB greater patient sensitivity in comparison with vibration that is applied primarily tangential to the skull. While normal excitation is most desirable due to the improvement of 5-10 dB in patient sensitivity, measured sensitivity curves of normal and tangential excitation modes show differing peaks and notches (e.g., over a hearing frequency range) due to the different responses of the skull and/or inner/middle ear to these different vibration modes. These peaks and notches do not necessarily occur at the same frequency for normal and tangential modes. Therefore, a vibrator which simultaneously generates both normal and tangential modes will show fewer and less pronounced notches (e.g. frequencies ranges of lowered hearing response) than an implant that generates each one singly. This can be used to help flatten the frequency response of a patient so that the sound perceived is more natural-sounding. There is, therefore, no need to eliminate the tangential vibration modes, so long as the normal vibration mode is of sufficient amplitude.

An exemplary embodiment of a bone conduction vibrator generates a frequency between 700 Hz and 800 Hz with a magnitude of 7 dBN. In an exemplary embodiment, without sufficient power in this range, patients (recipients) report voices as being thin and having little perceived volume, in spite of the fact that most of the information is carried in the so-called "intelligence band" of 1-4 kHz. Thus, as a base line, it can be utilitarian to generate at least a 7 dBN force with the vibrator at low frequencies for hearing stimulation.

A mechanical vibrator often works against an inertial mass to generate a utilitarian force (e.g., reactance force) within the confines of the implant housing. Per Newton's law, the reaction force is:

$$F = ma = \frac{d(mv)}{dt} = m\frac{\partial^2 x}{\partial t^2} \qquad \text{Eq. (1)}$$

In order to generate a large, force, the momentum p=m*v of the inertial mass must be large. The size constraint on the mass 'm' means the velocity 'v' of the inertial mass must be large in the device. Assuming the displacement of an actuator (e.g., motor) of the mechanical vibrator is sinusoidal, the displacement can be expressed as $x=x_o \sin(\omega t+\theta_o)$, where $x_o$ is the amplitude, $\omega=2\pi f$, t is time and $\theta_o$ is the phase. Substituting this into the above, the magnitude of force is:

$$|F|=(2\Pi)^2 f^2 |mx| \qquad \text{Eq. (2)}$$

Accordingly, the higher the frequency for a given amplitude of an actuator or motor, the more force that can be generated. Conversely, at low frequencies, it becomes difficult to generate sufficient force unless using a large amplitude of motion and/or a large mass. Because the implant must go onto, and in some cases into, the skull of a patient, there is only a finite volume available for the mass and limited amplitude at least in a direction normal to the skull. Given that the device might be only 1 $cm^3$ in volume, of which potentially ¼ could be utilized by a dynamic/inertial mass (that is, mass that is actively moving and generating force), the ability to generate 0 dBN=IN of force at 700 Hz, even with a tungsten mass (p=19.3 $cm^3$; one of the densest easily available materials), can require an amplitude on the order of approximately 10 μm. In another example, in an implant housing having a diameter of 25 mm and a height of 5 mm (which is large for an implant), an inertial mass composed of tungsten filling the entire available volume would weigh 47 gm. To generate a typical target RMS force of 7 dBN (=3.1 N pk) at 700 Hz with this mass can require $x_o$ to be 3.5 μm peak displacement.

Such information can be utilitarian with respect to selecting a motor/actuator for the device in that the motor must in some embodiments generate high forces and/or significant displacement. Further, for an implantable device it can be utilitarian that the energy consumption be low to allow for rechargeable use of adequate duration. Based on these considerations, the inventor determined that generating the necessary forces electromagnetically with good efficiency led to linearity and mechanical stability problems. That is, for the force to be large with small power consumption, the gap spaces between the working spaces of a motor need to be very small utilizing previous technology. Unfortunately, large forces and ranges of motion between the working surfaces of an electromagnetic motor imply to some in the art nonlinear performance. This can give rise to a number of characteristics, such as a nonlinear spring rate due to the magnetic field that at least sometimes must be mechanically compensated. Such compensation can be difficult or impossible without sacrificing performance. Thus, most electromagnetic devices require a choice of making the motion relatively small compared to the total gap, which enforces linearity but sacrifices force, and then increase the force by reducing the electrical impedance, thus, increasing power consumption. Though use of an electromagnetic motor is feasible if power is available, it has been determined a more linear actuator is utilitarian from at least a power consumption standpoint. Some exemplary embodiments of the devices systems and methods detailed herein and/or variations thereof address or otherwise alleviate these issues in whole and/or in part.

Exemplary actuators/motors with increased linear response include magnetic shape memory alloys (MSMA), (e.g., NiMgGa) with variable magnetic fields as well as Piezoelectric transducers (PETs). Piezoelectric transducers are quite linear over their normal input voltage range, and thus free of the difficulties of nonlinear spring rates. They operate by changes in the charge distribution in their crystal lattice, and can be considered a motor module without the magnetic and alignment issues of an electromagnetic motor. An aspect with PETs is that, while the devices produce large forces, their displacements are quite small. An exemplary single layer device 3 mm high can produce a displacement amplitude of 3 μm per 150V, or 20 nm with 1V of excitation which represents a more realistic voltage in an implantable device. At 700 Hz, using such a limited displacement a device would require a mass of 2 kg to generate IN of force. Such a size can be considered by some practicing the art, in at least some circumstances, impractical in an implanted device. So, even using an unreasonably large theoretical mass with a conventional piezoelectric transducer produces unacceptable results. Some exemplary embodiments of the devices systems and methods detailed herein and/or variations thereof address or otherwise alleviate these issues in whole and/or in part.

In order to effectively use a piezoelectric transducer, it has been determined that it is necessary to convert the very low displacement, high force output of the PET to a high displacement, lower force output. One approach is to use a stack of thin piezoelectric layers, each of which has, for example, 1V across it, but, giving a very large voltage gradient on the stack material. These devices are stacks of thin slices of PZT (piezoelectric material). One utilitarian feature of stacking is that each slice is thin, and thereby a larger V/m on the material, and hence a larger percentage strain for a given voltage per slice. When the slices are stacked, these percentage strains add up. For instance, a stack having dimensions of 5 mm×5 mm (e.g., a diameter allowing placement in an implant housing) and 20 mm in length provides a displacement of 40 μm per 200V, or 200 nm with one volt of excitation. This is 10 times what is achievable in a non-stacked device, but still might require a 200 gm mass, which is unacceptably large due to space limitations. Additionally, the PET would be approximately 20 mm long, which is too long to be accommodated in a direction normal to the skull in an implant. That is, as the direction of displacement in a piezoelectric stack is axial and a utilitarian direction of force is normal to the skull, a normally aligned PZT stack is too long to fit in a practical housing. Some exemplary embodiments of the devices systems and methods detailed herein and/or variations thereof address or otherwise alleviate these issues in whole and/or in part.

In summary, it has been determined that existing actuators including piezoelectric actuators fail to provide utilitarian displacement or, if providing the necessary displacement, are too large to be utilized in an implantable housing. Some exemplary embodiments of the devices systems and methods detailed herein and/or variations thereof address or otherwise alleviate these issues in whole and/or in part.

Bone Conduction Transducer

Figure 4A:
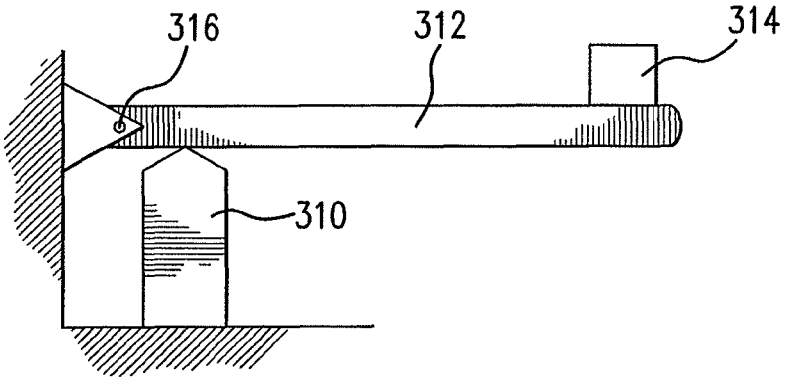
FIGS. 4A-4E illustrate mechanical amplification of an inertial mass.
Figure 4B:
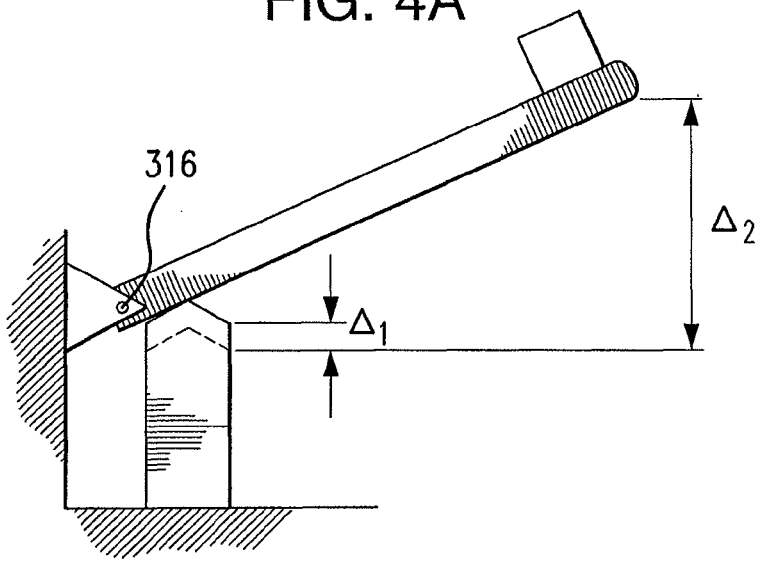
Figure 4C:
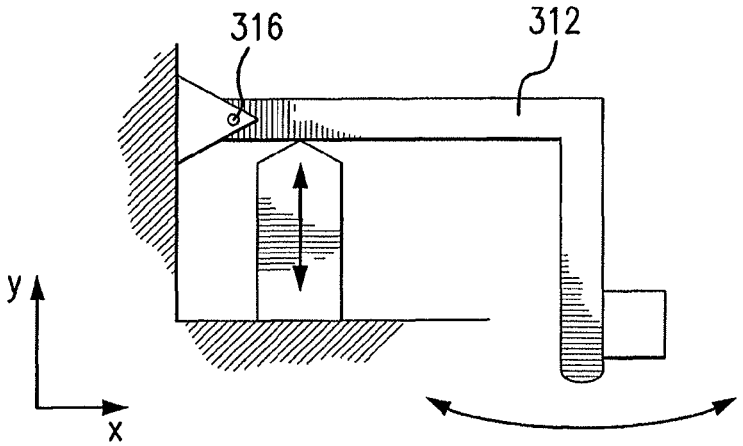

At least some exemplary bone conduction transducers detailed herein and/or variations thereof utilize the principle that displacement of an actuator/motor used to move an inertial mass is mechanically amplified and that this amplification can be redirected from a first direction (e.g., tangential to the skull) to a second direction (e.g., normal to the skull). FIGS. 4A and 4B illustrates an exemplary mechanical amplification system. As shown an actuator 310, which exemplary embodiment is a piezoelectric transducer, is operative to displace a lever 312 having an inertial mass 314 supported proximate to its free end. By using an exemplary mechanical lever of ratio of 1:17.5, a 200 nm motion (e.g., $\Delta_1$) could be multiplied to 3.5 μm at the free end of the lever (e.g., $\Delta_2$) which can be sufficient to achieve the necessary momentum to stimulate hearing. Further, by utilizing a non-linear lever, the motion of the free end of the lever can be redirected from a first direction of motion (e.g., aligned with the long axis of actuator 310) to being primarily in a second direction of motion. As shown in FIG. 4C, the axial displacement of the actuator 310 is in the 'y' direction while the movement of the free end of the lever 312 is primarily in the 'x' direction. The use of a non-linear lever (e.g. a right angle device) allows the long axis of the piezo element to lie tangential to the skull, while the mass 314 supported on the free end of the lever 312 and moves normal to the skull. Further, different lever arm ratios can be selected to generate a utilitarian equivalent momentum using larger displacements with a practical mass. As stated above, generating a sufficiently large force is dependent on the momentum p=m*v of the inertial mass. By lengthening the lever arm, the velocity of the movement of the mass in response to the displacement of the actuator can increase and therefore a smaller mass can be utilized for a given momentum. In order to further reduce the mass, compound lever systems can also be utilized to achieve larger net lever arm ratios. Such compound lever arms can also be utilized to further change the direction of the force. For example, the first lever arm can move in a direction that is substantially tangential to the skull and a second lever arm can work off the first lever aim to translate the force motion in a normal direction. Such arrangements can allow for reducing the total length of the device.

It is noted at this time that the arrangement of FIGS. 4A-4C correspond to a "Class 3 lever," per the teachings of "Physics In Biology And Medicine," third edition, by Paul Davidovist. It is further noted that the teachings detailed herein and/or variations thereof can be applicable to a "Class 1 lever," and/or a "Class 2 lever" as defied by the aforementioned text.

Figure 4D:
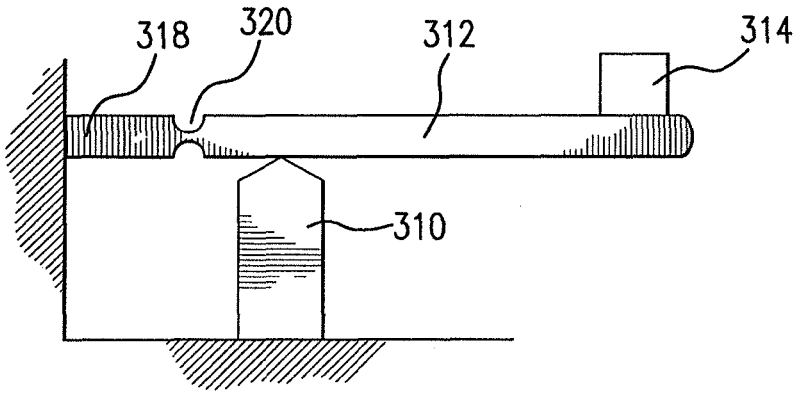

While the increased displacement improves acceleration of the mass and thereby maintains a utilitarian momentum utilizing a smaller mass, use of such a leveraged displacement typically requires a hinge or a pivot 316 as illustrated in FIGS. 4A-4C. It has further been determined such a pivot might not have full utilitarian value in all situations due to for example the small contact area of the pivot/hinge bearing. Specifically, in at least some embodiments, the bearing compresses and absorbs significant amounts of the force being applied to the lever 312. For instance, in an exemplary embodiment, up to 20 decibels of the force can be absorbed by the pivot 316. Accordingly, it has been determined that such pivot/hinge bearing losses can be reduced and/or eliminated by utilizing a flexural hinge according to the teachings detailed herein and/or variations thereof. Along these lines, as illustrated in FIG. 4D, the pivot of the lever 312 is removed in an exemplary embodiment. In this regard, the proximal end 318 of the lever 312 is fixedly attached to a surface (e.g., an implant housing, etc.). In this regard, the lever defines a cantilever. Disposed along the length of the lever 312 is the flexural hinge 320. Generally, the flexural hinge is defined by an area of the lever having a reduced cross-section in relation to adjacent portions of the lever. In this regard, when a force is applied along the length of the lever, deflection occurs within the flexural hinge prior to occurring within the adjacent portions of the lever. Generally, the flexural hinge 318 is formed by a relatively thin, wide (e.g., across the width of the lever), region that can be made with a designed compliance in a utilitarian bending direction while maintaining stiffness in all other directions. In this regard, while permitting the movement of the mass up and down as illustrated in FIG. 4D, the flexural hinge can have utility in that it minimizes or prevents movement in a direction that is, for example, normal or transverse to the permitted direction of movement.

As shown, the actuator 310 is configured to apply an axial force to the lever at a location beyond the flexural hinge 320. Stated otherwise, the flexural hinge 320 is disposed between where the proximal end 318 is fixedly interconnected to a supporting surface (e.g., implant housing etc.) and a point along the length of the lever 312 where the actuator 312 applies force to the lever 312. Such an arrangement eliminates a mechanical joint such as a multi-piece mechanical pivot or hinge and thereby provides improved focusing of the movement in a utilitarian direction and/or amplification with minimal energy losses.

Figure 4E:
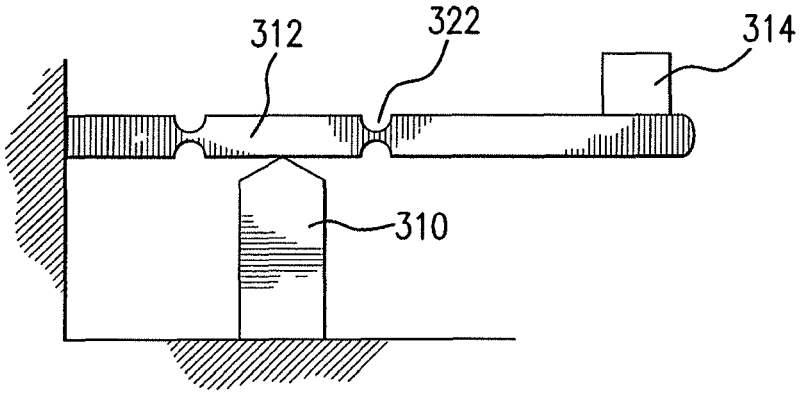

While reducing the compliance of the mechanical chain (e.g., hinge/pivot) delivering force to the mass, it is utilitarian to optimize the force over a large frequency range. That is, it can be utilitarian to shape the force versus a utilitarian frequency transfer function. For instance, as noted above, increasing the force response around the 700-800 hertz frequency band can utilitarian in that it can improve patient perceived loudness. This can be accomplished by adding compliance to the mechanical chain such that the compliance reactants cancel the inertial reactants at the desired frequency. Due to the impedance transformation properties of a lever arm, the very small compliance of the piezoelectric device and its transition layers to the lever and supporting structure can be used to resonate with the inertial mass of the system. A similar approach is to place a compliant component between the pivot or flexural hinge 318 and the inertial mass 314. Such a compliant component (e.g., a second flexural hinge) can be designed to be resonant at a desired frequency. Referring to FIG. 4E, and exemplary system is provided where the lever arm 312 includes a second flexural hinge 322. This second flexural hinge allows for defining the resonance of the distal end of the lever 312 and the supported mass 314. Stated otherwise, the lever and supported mass beyond the flexural hinge 322 define a resonator. A resonator is a device or system the exhibits resonance or resonant behavior where the device naturally oscillates at resonant frequencies with greater amplitude than other frequencies.

During operation, the force (e.g., torque) generated by the actuator 310 is then delivered to the resonator, consisting of a spring (e.g., flexural hinge) and mass (mass and lever). While the PET actuator itself is not capable of generating the needed displacement of a large mass, as noted previously, it is not necessary to generate the maximum displacement at all frequencies. By using a resonator, the displacement can be maximized at around 700 Hz-1 kHz, as is consistent with the requirements for low frequency hearing intelligibility. The amplitude is optimized by designing the resonant frequency to equal frequency of maximum amplitude, and damping the resonator appropriately.

The mechanical resonance of the structure according to some exemplary embodiments can be controlled to have increased utilitarian value. It is also utilitarian to control the width of the resonance. This can be done according to at least some of the embodiments detailed herein and/or variations thereof by several mechanisms, all of which damp the resonance by dissipating some of the energy stored in the resonant mode. Other mechanisms can be utilized in other embodiments. An exemplary mechanism can include viscous damping by fluids (liquids or gases) or gels, use of "dead" materials such as malleable metals such as silver and plastic, laminated construction, constrained layers (e.g., "damping tape"), filled materials, and magnetic eddy dampers. Further the resonances of a bending beam can be controlled by shaping the end of the beam, effectively making the beam into a continuum of beams of various lengths. Additionally, mass loading the end or surface of the beam, as well as using constrained layer damping applied in patterns on the surface, can be used to deliberately damp or promote certain modes, thereby shaping the frequency response.

Finite element modeling can allow, in some embodiments, the modes to be relatively well-defined for an implant envelope. By using nonlinear fitting, a particular set of resonator qualities can be designed to fit an implant shape. This allows the outline of the implant to be conformal to a desired anatomical structure, for instance, the curvature of the skull.

Figure 5:
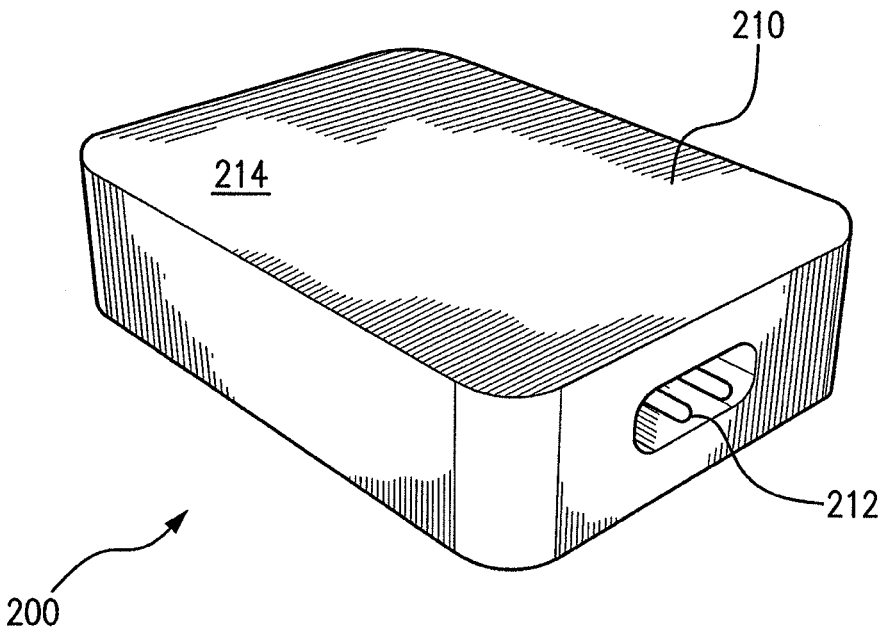
FIG. 5 illustrates one embodiment of a bone conduction transducer.
Figure 6:
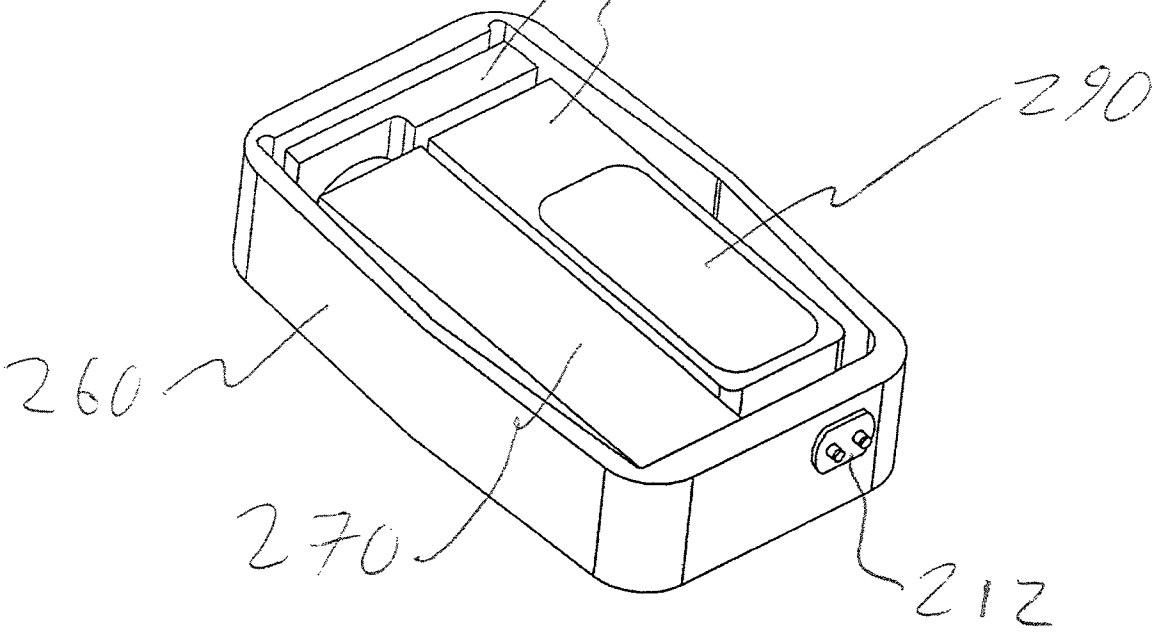
FIG. 6 illustrates a prospective view of the BCT of FIG. 5.
Figure 7A:
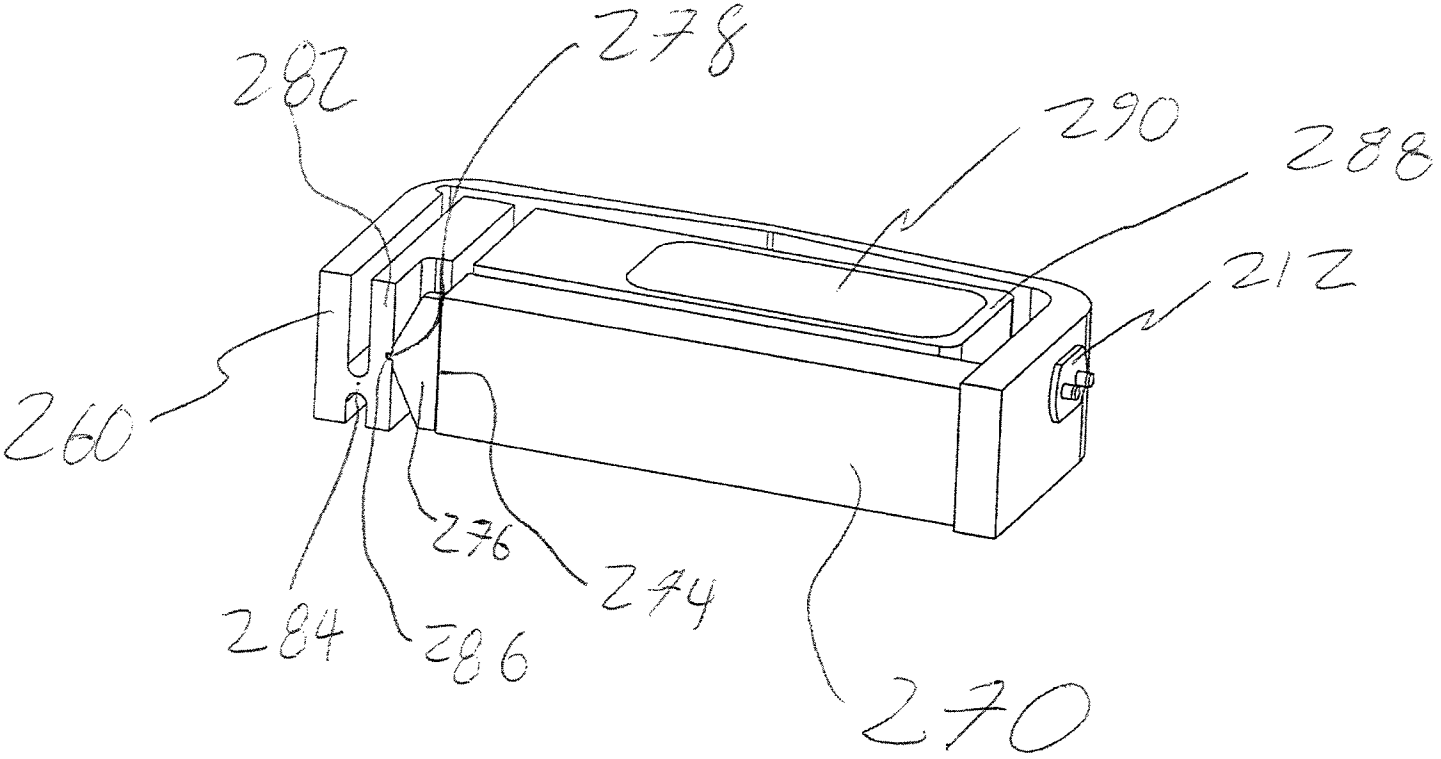
FIG. 7A illustrates a cross sectional view of the BCT of FIG. 6.
Figure 7B:
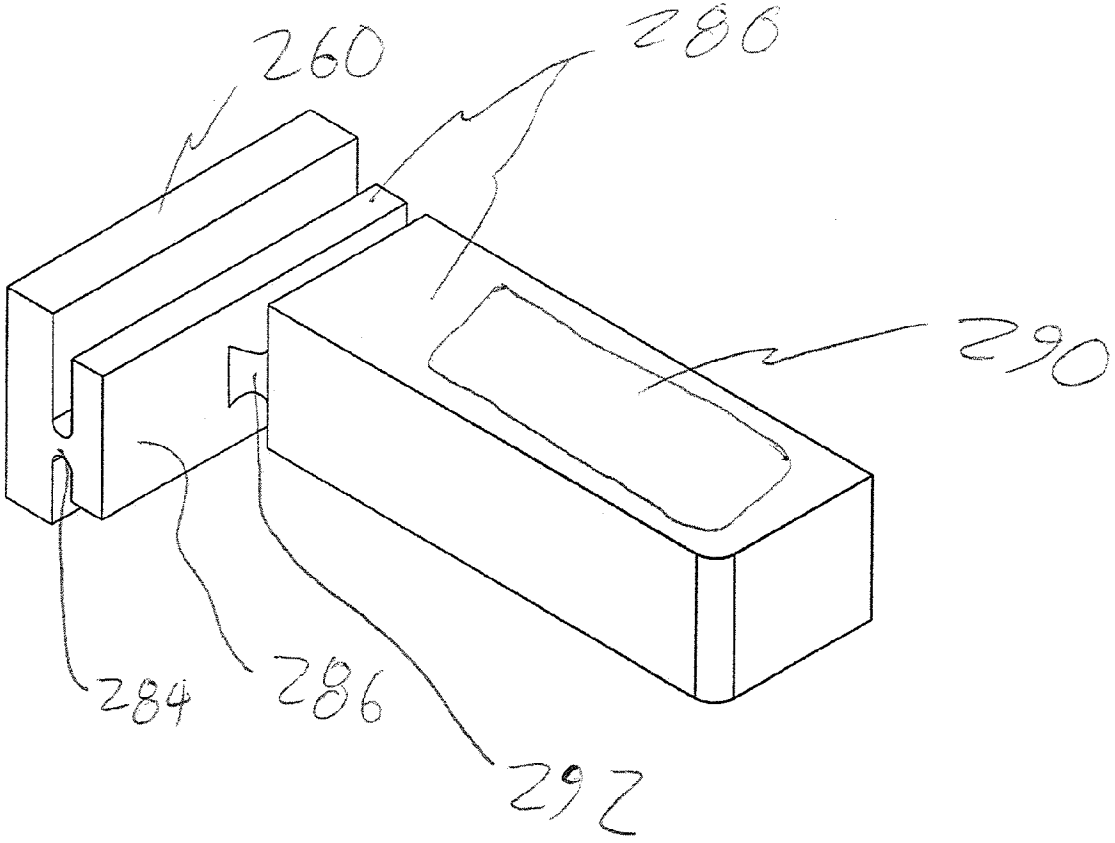
FIG. 7B illustrates a partial cross sectional view of the BCT of FIG. 6.

FIGS. 5-7B illustrate one embodiment of a BCT (again, also referred to as a bone conduction device), that is adapted for subcutaneous positioning. As shown in FIG. 5, the BCT 200 includes as a bio-inert housing 210. This bio-inert housing 210 defines a hermetically sealed internal chamber in which the active components of the device are included. It is noted that in some embodiments where the BCT is not implanted, the housing is not hermetically sealed, although in other embodiments the housing is hermetically sealed even though it is not implanted. As shown, the housing 210 includes an electrical feed through 212 that can enable interconnecting the BCT 200 to, for example, a coil and/or a subcutaneous speech processing unit. FIG. 6 illustrates the BCT 200 without a top surface (e.g., top lid, which is installed for example during manufacturing by laser welding the shared to the frame 260) for purposes of illustration. FIG. 7A provides a cross sectional view of the BCT of FIG. 6 and FIG. 7B provides an illustration of a partial cross sectional view of the BCT having the piezoelectric transducer removed.

An exemplary embodiment, such as the embodiment according to FIGS. 5-7B, the BCT 200 has a substantially rigid frame 260, which in the present embodiment defines the peripheral edge of the implant housing 212. This frame 260 is substantially rigid in comparison to the other components of the system. While being substantially rigid, it will be appreciated that some flexural movement can be applied to the frame. Exposed within the periphery of the frame 260 is a piezoelectric transducer 270 and a transverse lever arm 280 (e.g., non-linear lever arm) that supports a resonant mass 290. As discussed above, the transverse lever arm 280 is operative to translate an axial movement of the piezoelectric transducer (PET) 270 from a first direction (e.g., aligned with the top or bottom surface of the housing 210) to a second direction the is substantially normal to a plane defined by the top surface 214 (and/or bottom surface) of the housing 210 (see FIG. 5).

As shown, a proximal end of the transverse lever arm 280 defines a footplate 282 that is interconnected to a first end of the frame by a first flexural hinge 284. In the illustrated embodiment, the transverse lever arm 280 is formed in the shape of an "L" and the piezoelectric transducer 270 applies a force to the foot plate 282 of the L-shaped lever arm. The PET 270 has a first end 272 that solidly abuts against the frame 260 of the housing 210, although in other embodiments, an end cap can be positioned therebetween. A second end 274 of the piezoelectric transducer 274 supports an end cap 276 which contacts the foot plate 282 of the L-shaped lever arm 280. In the embodiment depicted in FIG. 7A, cap 276 tapers to a pivot point 278 which is received within a pivot recess 286 on the foot plate 282. In this regard, the pivot recess point 276 and pivot 286 provide for relatively minimal contact between the PET 270 and lever arm and thereby, at least in some embodiments, reduce the dampening effect of the PET 270 on the lever arm.

The tip of the end cap 276 and mating pivot recess 286 are located on the foot plate 282 at a position above the flexural hinge 284, which interconnects the foot plate 282 to the frame 260. In this regard, when the PET 270 expands upon the application or removal of an applied voltage and/or variation of the applied voltage, the end cap 276 applies a force to the end plate 282 which displaces the free end of the lever 288 and resonant mass 290 upward in relation to a bottom surface of the housing. Likewise, upon the PET 270 contracting, the free end of the lever 288 and mass 290 are permitted to move downward. In this regard, the movement of the PET 270 which is directed in a direction that is substantially aligned with the top surface 214 of the housing 210, is translated into a motion that has a primary movement direction that is normal to the top surface 214 of the housing 210.

As is further detailed herein, some exemplary embodiments include a transverse lever arm and/or other components of the bone conduction device that are obtained by, for example, machining these components from a single piece of material (e.g. a block of titanium, corresponding to the embryonic material from which the transverse lever arm is formed). Accordingly, still with reference to FIG. 7B, in an exemplary embodiment, the first flexural hinge 284 (and/or other hinges detailed further below) is a living hinge that is established by cutting or otherwise removing material of the embryonic component from which the transverse lever arm 280 was formed.

In an exemplary embodiment, there is a bone conduction device that includes a transverse lever arm having a hinge (e.g., the first hinge) having specific geometries that are configured to influence the performance of the bone conduction device in which it is included. By way of example only and not by way of limitation, such influence on the performance can include influencing the location of a resonance peak of the bone conduction device. Exemplary devices and systems of such an embodiment, as well as exemplary methods of implementing such an embodiment, will now be described. It is noted that any method detailed herein and/or variation thereof pertaining to the manufacture and/or fabrication of a component of a bone conduction device corresponds to a disclosure of a device or system including the resulting component, and visa-versa.

Figure 7C:
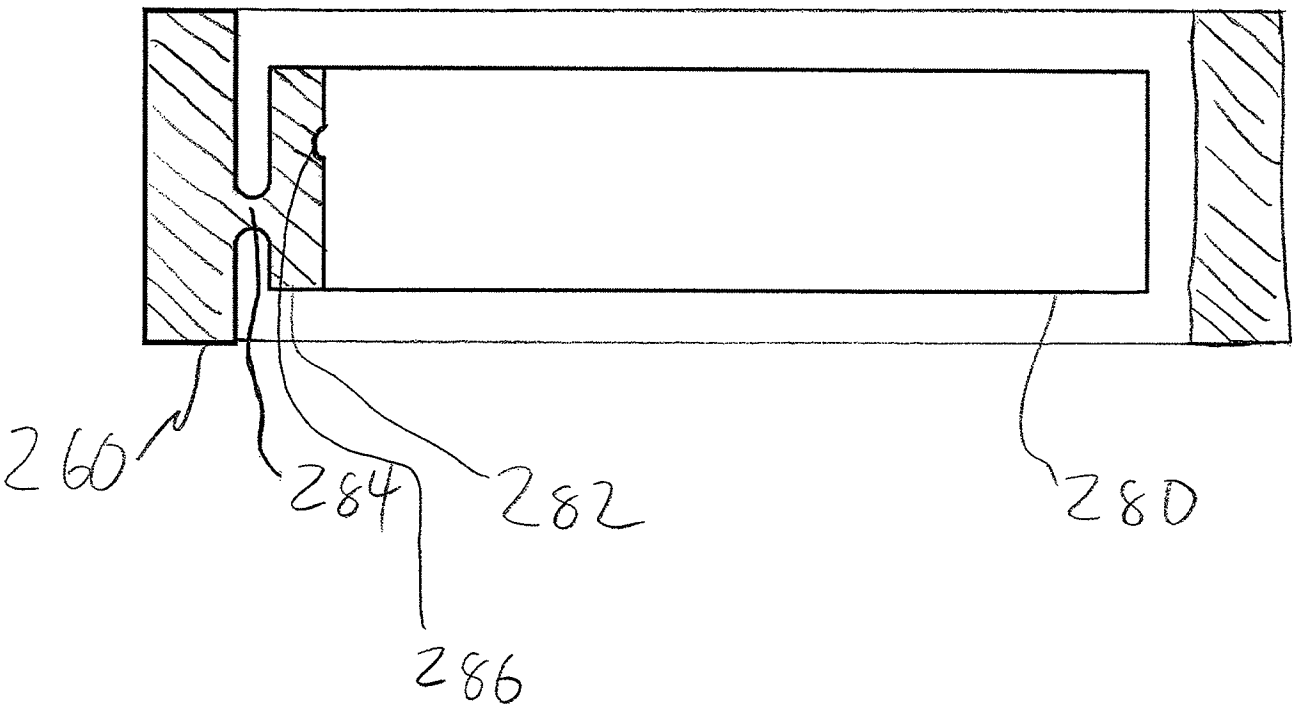
FIG. 7C illustrates a partial cross sectional view of the BCT of FIG. 6.
Figure 7D:
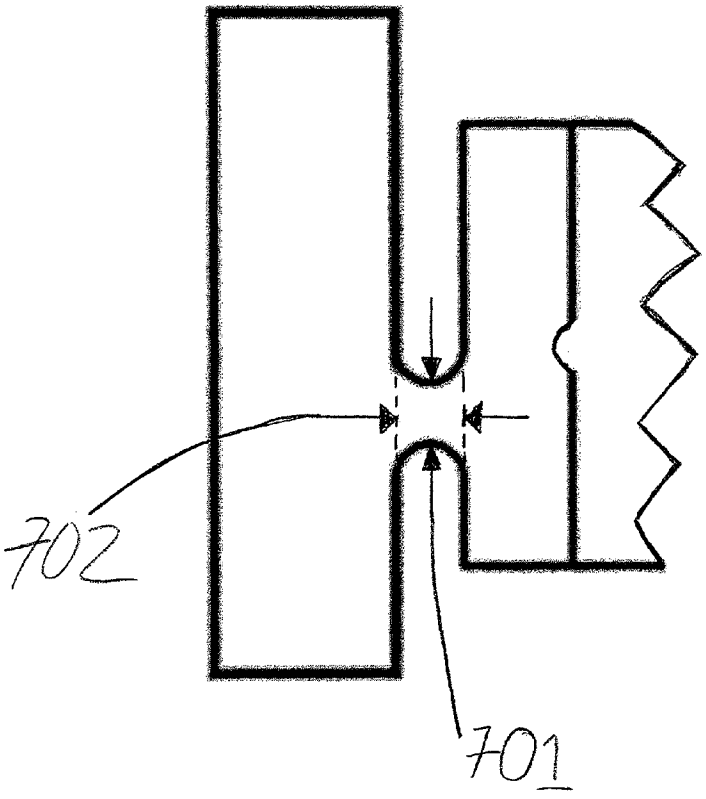
FIG. 7D illustrates a partial cross sectional view of the BCT of FIG. 6.

FIG. 7C depicts, in conceptual form, a side-view of some of the components illustrated in FIG. 7A. More specifically, FIG. 7C depicts a cross-section of frame 260, hinge 284, and footplate 282, essentially corresponding to that depicted in FIG. 7A. FIG. 7C also depicts the transverse lever arm 280, albeit in conceptual form (e.g. one of the hinges—the hinge remote from the frame 260—is not shown). Not depicted is the piezoelectric stack 270 and end cap 276 and other components for purposes of clarity. FIG. 7D depicts a close-up view of the left side portion of FIG. 7C. Reference numerals 701 and 702 of FIG. 7D respectively correspond to, with respect to the orientation of FIG. 7D, the minimum thickness in the vertical direction and the minimum thickness in the horizontal direction of hinge 284. In an exemplary embodiment, varying the thickness 701 and/or thickness 702 of the design of the transverse lever arm 280 can vary parameters associated with the resulting system (which can be a spring system) of transverse lever arm 280 due to hinge 284. By way of example only and not by way of limitation, varying one or both of these thicknesses can vary the effective spring constant of the transverse lever arm 280. Varying the thicknesses can also vary other properties, as will be detailed below by way of example and not by way of limitation.

In an exemplary embodiment, distance 701 and/or distance 702 can be about 0.1 mm, about 0.2 mm, about 0.3 mm, about 0.4 mm, about 0.5 mm, about 0.6 mm, about 0.7 mm, about 0.8 mm, about 0.9 mm, about 1.0 mm, about 1.1 mm, about 1.2 mm, about 1.3 mm, 1.4 mm, about 1.5 mm, 1.6 mm, about 1.7 mm, about 1.8 mm, about 1.9 mm, about 2.0 mm, about 2.1 mm, about 2.2 mm, about 2.3 mm, 2.4 mm, about 2.5 mm, 2.6 mm, about 2.7 mm, about 2.8 mm, about 2.9 mm, about 3.0 mm, about 3.1 mm, about 3.2 mm, about 3.3 mm, 3.4 mm, about 3.5 mm, 3.6 mm, about 3.7 mm, about 3.8 mm, about 3.9 mm, about 4.0 mm, about 4.1 mm, about 4.2 mm, about 4.3 mm, 4.4 mm, about 4.5 mm, 4.6 mm, about 4.7 mm, about 4.8 mm, about 4.9 mm, about 5.0 mm or more or any values or range of values therebetween in 0.01 mm increments (e.g., about 2.22 mm, about 0.84 mm to about 3.33 mm, etc.)

In an alternate embodiment, in addition to and/or alternatively to varying one or more aforementioned thicknesses, other modifications to the hinge 284 can be implemented. For example, the overall length (e.g. the dimension that extends into an out of the plane on which FIG. 7D is presented) of the hinge 284 need not correspond to the full length of the footplate 282. In an exemplary embodiment, the length can be less than the length of the footplate. By way of example only and not by way of limitation, in some embodiments, this length can be about 5.0 mm, about 7.5 mm, about 10.0 mm, about 15 mm, about 20 mm, about 25 mm, about 30 mm, or more or any value or range of values therebetween in about 0.5 mm increments (e.g., about 5.5 mm, about 7.55 mm to about 10.5 mm, etc.)

Alternatively and/or in addition to all of these, the configuration of the hinge can be modified from that depicted in the figures. For example, holes can be drilled or otherwise bored in the vertical direction, partially and/or fully extending through the hinge 284. One or more of such holes can be present. With respect to the holes that do not extend completely through the hinge 284, the number of such holes on one side of the hinge 284 can be the same as and/or can be different than the number of holes on the other side of hinge 284. Any device, system and/or method that relates to modifying the hinge 284 which will change or otherwise vary the parameters of the bone conduction device in which the transverse lever arm 280 is included can be utilized in at least some embodiments providing that the teachings detailed herein and/or variations thereof can be practiced.

Figure 7E:
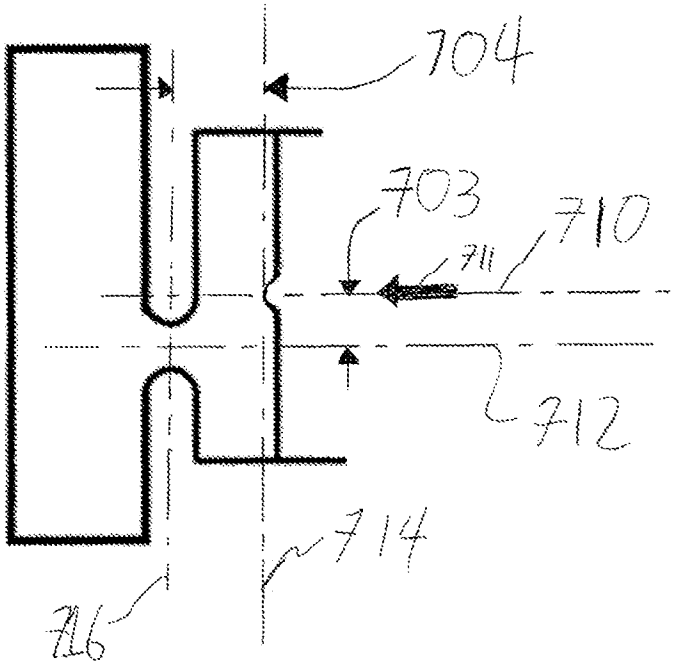
FIG. 7E illustrates a partial cross sectional view of the BCT of FIG. 6.

FIG. 7E also depicts a close-up view of the left side portion of FIG. 7C. Reference numerals 710 and 712 of FIG. 7E respectively correspond to, with respect to the orientation of FIG. 7D, the horizontal centerlines associated with pivot 286 and hinge 284. More specifically, with respect to pivot 286, when the piezoelectric transducer 270 is actuated such that it expands, the force that results from the expansion that travels through end cap 276 into footplate 282 travels through pivot 286. Effectively, that force is aligned with horizontal centerline 710, and thus horizontal centerline 710 is more descriptively referred to as the centerline along which the force from the piezoelectric stack travels into the pivot 286. Conceptually, this force is represented by arrow 711, where the magnitude of that force varies directly with respect to the amount that the piezoelectric stack 270 extends and inversely with respect to the amount that the piezoelectric stack 270 retracts. Owing to the offset distance between centerline 710 and 712, represented by reference numeral 703, a varying moment about the hinge 284 of varying magnitude is applied thereto (varying due to the varying extension distance of the piezoelectric stack 270). The magnitude of the varying moment varies directly with respect to the amount that the piezoelectric stack extends and inversely with respect to the amount of the piezoelectric stack retracts. In essence, the offset distance represented by reference numeral 703 creates a Class 1, Class 2 or a Class 3 lever, depending on the location of the center of gravity of the transverse lever arm 280).

Still referring to FIG. 7E, reference numerals 714 and 716 of FIG. 7E respectively correspond to, with respect to the orientation of FIG. 7D, the vertical centerlines associated with pivot 286 and hinge 284, where the vertical centerline associated with pivot 286 corresponds to the location on pivot 286 where the force from the piezoelectric transducer is concentrated (with respect to the schematic of FIG. 7E, the most leftward portion of the pivot 286). As can be seen, the vertical centerlines 714 and 716 are offset by a distance represented by reference numeral 704. The distance represented by reference numeral 704 can become significant (e.g., impact the performance of the bone conduction device in a noticeable manner), at least in embodiments having relatively low values thereof.

In an exemplary embodiment, distance 703 and/or distance 704 can be about 0.1 mm, about 0.2 mm, about 0.3 mm, about 0.4 mm, about 0.5 mm, about 0.6 mm, about 0.7 mm, about 0.8 mm, about 0.9 mm, about 1.0 mm, about 1.1 mm, about 1.2 mm, about 1.3 mm, 1.4 mm, about 1.5 mm, 1.6 mm, about 1.7 mm, about 1.8 mm, about 1.9 mm, about 2.0 mm, about 2.1 mm, about 2.2 mm, about 2.3 mm, 2.4 mm, about 2.5 mm, 2.6 mm, about 2.7 mm, about 2.8 mm, about 2.9 mm, about 3.0 mm, about 3.1 mm, about 3.2 mm, about 3.3 mm, 3.4 mm, about 3.5 mm, 3.6 mm, about 3.7 mm, about 3.8 mm, about 3.9 mm, about 4.0 mm, about 4.1 mm, about 4.2 mm, about 4.3 mm, 4.4 mm, about 4.5 mm, 4.6 mm, about 4.7 mm, about 4.8 mm, about 4.9 mm, about 5.0 mm, about 5.1 mm, about 5.2 mm, about 5.3 mm, 5.4 mm, about 5.5 mm, 5.6 mm, about 5.7 mm, about 5.8 mm, about 5.9 mm, about 6.0 mm, about 6.5 mm, about 7.0 mm about 7.5 mm, about 8.0 mm, about 8.5 mm, about 9.0 mm, about 9.5 mm, about 10.0 mm, about 10.5 mm, about 11.0 mm, about 12 mm, about 13 mm, about 14 mm, about 15 mm, about 16 mm, about 17 mm, about 18 mm, about 19 mm, and/or about 20 mm, or more or any values or range of values therebetween in 0.01 mm increments (e.g., about 2.22 mm, about 0.84 mm to about 3.33 mm, etc.)

Reference numerals 701 and 702 of FIG. 7D respectively correspond to, with respect to the orientation of FIG. 7D, the thickness in the vertical direction and the thickness in the horizontal direction of hinge 284. In an exemplary embodiment, varying thickness 701 and/or thickness 702 of the design of the transverse lever arm can vary parameters associated with the resulting spring system of transverse lever arm 280 due to hinge 284. (As will be discussed in greater detail below, varying thickness 701 varies the aspect ratio of the hinge 284, the ramifications of this being discussed further below.) By way of example only and not by way of limitation, varying one or both of these thicknesses can vary the effective spring constant of the transverse lever arm 280. Varying the thicknesses can also vary other properties.

In an exemplary embodiment, the greater the distance 703 (offset distance), the greater the leverage (offset leverage) of the system resulting from the force 711 applied by the piezoelectric transducer 270. More specifically, the greater the distance 703, the greater the movement of the center of gravity of the transverse lever arm 280 in general and the greater the movement of the mass 290 in particular with respect to a given extension amount of the piezoelectric transducer 270. Indeed, depending on the values of distances 703 and/or 704, and the location of the center gravity of the transverse lever arm 280/the mass 290, the total distance that the center of gravity of the transverse lever arm 280 and/or the mass 290 moves can be greater than the corresponding extension of the piezoelectric transducer 270. In this regard, consistent with the other teachings detailed herein, this offset leverage can enable the force output and/or energy output of the bone conduction device to be greater than that which would be the case if the movement of the center of gravity of the "force generating" components of the bone conduction device were restricted to the amount of movement corresponding to the extension amount of the piezoelectric transducer.

In addition to the flexural hinge 284 disposed between the foot plate 282 and the frame 260, the long leg of the L-shaped lever arm 280 can likewise include one or more additional hinges, which will be referred to at the current time by way of example only and not by way of limitation, as resonator hinges. These one or more additional hinges 292 are relatively compliant locations along the length of the lever arm that allow for generating a utilitarian resonance of the free end of the lever 288 and supported mass 290. Though shown as including a single additional hinge 292 (only a second hinge), it will be appreciated that two or more additional hinges (e.g., two or more additional resonator hinges) or other compliant portions along the length of the lever can be incorporated into the lever arm to tailor a desired frequency response(s). In some embodiments, the manner in which the second hinge 292 is formed is similar to and/or the same as that utilized to form the first hinge 284. In some embodiments, the second hinge 292 is a living hinge.

Figure 8A:
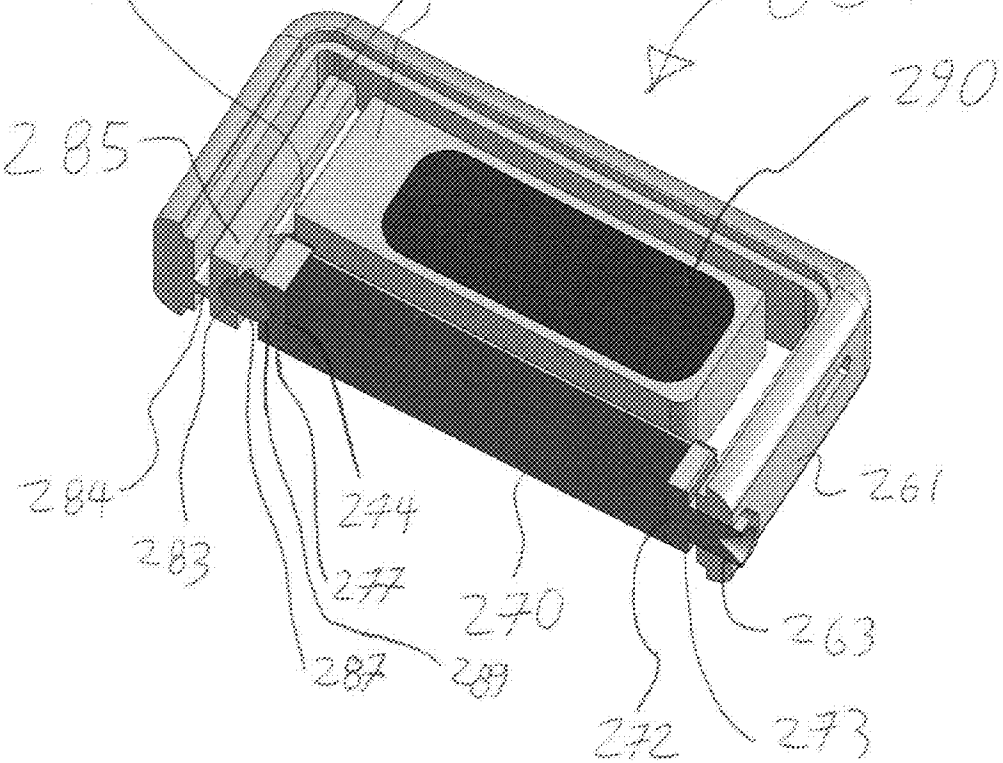
FIG. 8A illustrates an isometric cross-sectional view of a bone conduction device according to an alternate embodiment.
Figure 6B:
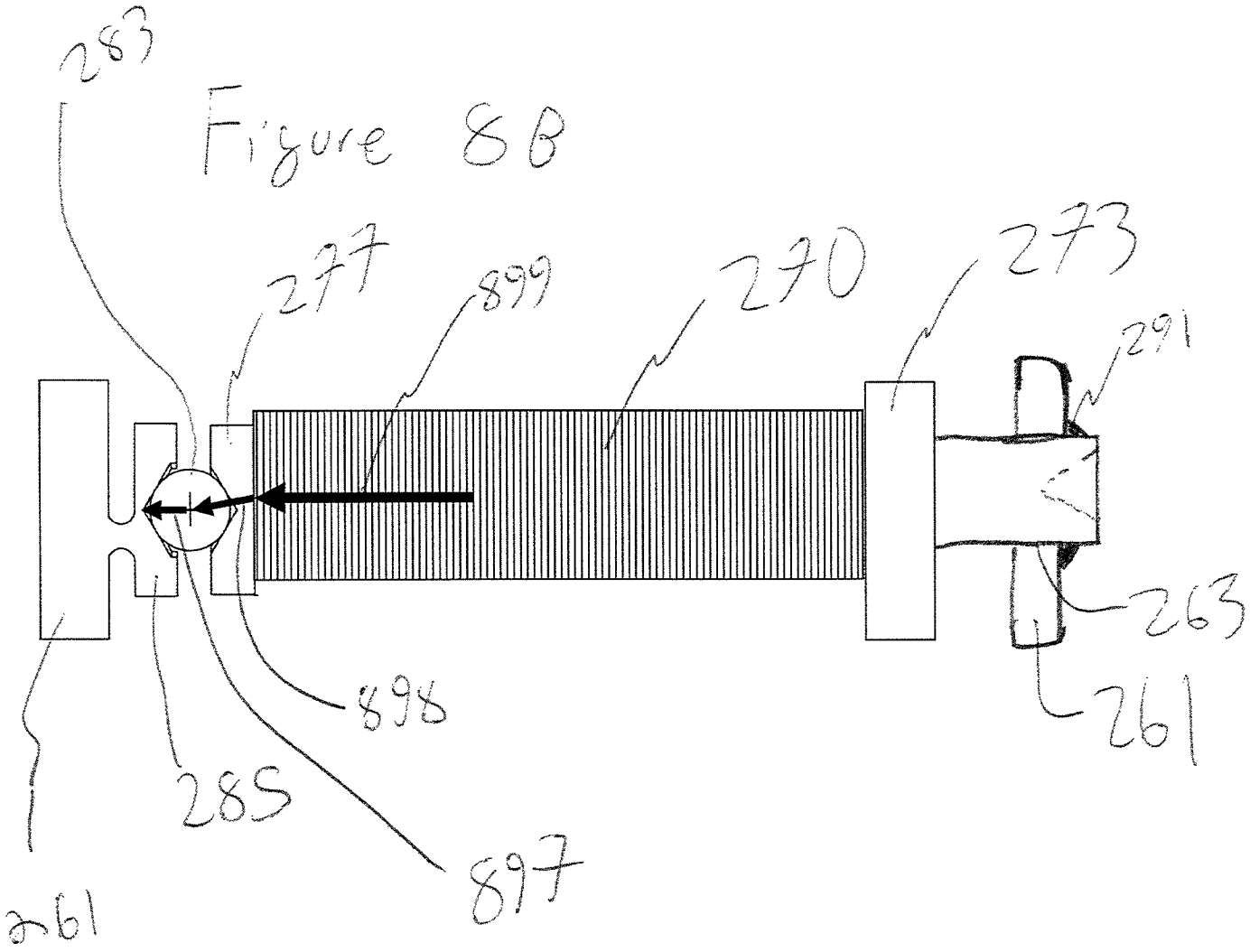

FIG. 8A depicts an isometric cross-sectional view of the alternate embodiment of a bone conduction device 800 with the top and bottom of the housing (lids) of the bone conduction device 800, along with the electrical communication apparatuses, removed for clarity. As shown in FIG. 8A, the bone conduction device 800 has a substantially rigid frame 261, which in the present embodiment defines the peripheral edge of the implant housing of which it is apart. In an exemplary embodiment, this frame 261 corresponds to the frame 260 as detailed above, with the exception that the sides of the frame are more linear than those of frame 261 and the frame 261 includes a hole 263 therethrough at one end as will be discussed further below. In this exemplary embodiment, frame 261 corresponds to a chassis of the bone conduction device 800. Exposed within the periphery of the frame 261 is a piezoelectric transducer 270 and a transverse lever arm 281 (corresponding to a component that moves relative to the frame) that supports a resonant mass 290 in, in some embodiments an essentially identical (including identical) fashion as the corresponding elements of BCT 200. Indeed, in an exemplary embodiment, these elements are essentially identical to the corresponding elements, with the exception of the female portion 283 in the footplate 285 of the transverse lever arm 281.

Further in this regard, a proximal end of the transverse lever arm 281 defines a footplate 285 that is interconnected to a first end of the frame by a first flexural hinge 284. In the illustrated embodiment, the transverse lever arm 281 is formed in the shape of an "L" and the piezoelectric transducer 270 applies a force to the foot plate 285 of the L-shaped lever arm. However, different from the PET 270 of the embodiment of FIGS. 6-7B detailed above, it has a first end 272 that solidly abuts against an end cap 273, as opposed to against the frame 261. Also different from the PET 270 of the embodiment of FIG. 6-7B detailed above, a second end 274 of the piezoelectric transducer 270 supports an end cap 277 which, instead of contacting the foot plate 285 of the L-shaped lever arm 281, contacts a spherical bearing 287, which in turn contacts footplate 285.

As can be seen from FIG. 8A, end cap 277 includes a female portion 289, some of the pertinent features which will be detailed below. Is noted that in some embodiments, only one of these two features that deviate from the embodiment of FIGS. 6-7B are utilized (e.g., there is no end cap 273 or there is no end cap 277, the piezoelectric transducer 270 directly contacting the frame or the end on the opposite side of the piezoelectric transducer 270 directly contacting the footplate of the lever arm).

An exemplary embodiment of an anti-backlash system utilized in the embodiment of FIG. 8A will now be described. It is noted that this is but one example of such an anti-backlash system. Other embodiments can use other systems, as will be briefly described below.

As can be seen from FIG. 8A, footplate 277 and footplate 285 both include female portions into which the spherical bearing 287 is fitted. More particularly, spherical bearing 287 can be a solid piece of a relatively hard material such as, by way of example and not by way of limitation, stainless steel, or other hardened material, and the material of the female components can be, in some embodiments, a material that is less hard than that of the spherical bearing 287, and/or vice versa. Disposing the spherical bearing 287 as depicted in FIG. 8A, results in the spherical bearing 287 transmitting the force generated by the piezoelectric transducer 270 to the footplate 285. Along these lines, the female portions 283 and 289 of the foot plate 285 (driven members) and end cap 277 (a driving member) are, in some embodiments, conical recesses in these components, although in other embodiments other geometries may be utilized (e.g. hemispherical recesses, parabolic recesses, stepped recesses, etc.) further along these lines, while element 277 has been identified as a spherical bearing, other geometries may be utilized, such as by way of example and not by way of limitation, a cylindrical bearing, and elliptical bearing, a stepped bearing, etc. In some embodiments any geometry or otherwise device system or method that will permit the teachings detailed herein and/or variations thereof to be practiced can be utilized with respect to the interface between the piezoelectric transducer and the other components.

With the above configuration in mind, in an exemplary embodiment, the piezoelectric transducer 270 is compressed during the manufacturer of the bone conduction device 800, and at least a portion of that compression is retained in the manufactured device such that the potential for backlash between the components associated with the piezoelectric transducer (the drive components) and the components associated with the transverse lever arm (the driven components) is reduced and/or eliminated. More particularly, referring back to FIG. 8A, as can be seen, end cap 273 extends through the frame 261 through hole 263. During manufacture, a force is applied in the longitudinal direction of the piezoelectric transducer 270 to the end cap 273, which is configured to move relative to the hole 263 through the frame 261, with a sufficient reaction force applied to the opposite side of the frame 261, or vice versa. This has the effect of compressing the elements between the end cap 273 and the footplate 285. Providing that the harnesses of the components between and including the end cap 273 and the footplate 285 are of a sufficiently complementary nature, the end cap 274 in general (the female portion 289 in particular) and the footplate 285 in general (the female portion 283 in particular), undergo a certain amount of deformation along the line(s) of contact with the spherical bearing 277. The result is that the piezoelectric element 270 in general and the drive components in particular (end cap 273, piezoelectric element 270, end cap 274 and spherical bearing 277) are compressively stressed. In an exemplary embodiment, the compressively stressed components are permanently compressively stressed by locking end cap 273 to frame 261 when the desired compressive stress is achieved. That is, the stress is set in the manufactured device. This can be accomplished by, for example, laser welding, flaring the end cap 273, etc., thereby resulting in a pre-stressed drive component assembly.

In an exemplary embodiment, the above results in the elimination of all backlash in the system that might otherwise be present during normal and/or abnormal expected operating environments (e.g. dropping the bone conduction device 800 from a given height, etc.) and/or the effective accommodation for any misalignment between the drive components and the driven components. For example, during all normal and/or abnormal expected operating environments, the piezoelectric transducer 270 always remains in compression (e.g. regardless of whether a voltage is applied thereto which causes the piezoelectric transducer 270 to expand and/or contract, depending on the embodiment). Still further by example, for all normal and/or abnormal expected operating environments, no part of the driven components and/or the drive components is not in contact with its adjacent component.

In an exemplary embodiment, this pre-stress imparted onto the drive components compresses the piezoelectric transducer farther than any expected displacement due to, for example, thermal expansion and/or displacement due to application of and/or removal of and/or variation of the applied voltages as detailed herein and/or variations thereof. Also, this pre-stress imparted onto the drive components compresses the piezoelectric transducer a sufficient amount such that the piezoelectric transducer always remands under effective compression during expected abnormal events such as, by way of example and not by way of limitation, the high acceleration resulting from the device being dropped from a reasonable height etc.

With respect to the pre-stress imparted onto the drive components, that pre-stress is reacted against by at least the hinge 284. In this regard, as noted above with respect to FIG. 7D, the thicknesses 701 and 702 influence the performance parameters of the transverse lever arm 280. In this regard, the hinge 284 functions as a spring. For a given material from which the hinge is made, the geometry of the hinge, including the thicknesses 701 and/or 702, at least generally control the stiffness of the spring system formed by the hinge 284. It is this stiffness that reacts against the pre-stress. In at least some embodiments, the hinge functions as a relatively stiff spring, where a relatively high stiffness of the spring provides increased pre-stress onto the piezoelectric transducer with less compression thereof (whereas a less stiff spring requires more compression to achieve the same amount of pre-stress). That is, relatively minimal amounts of compression applied to the system of the piezoelectric stack will be taken up by deflection of the footplate 282. In this regard, in some embodiments, the pre-stressing of the drive components in fact "compresses" the spring system of which the hinge 284 as a part. By sufficiently compressing the spring system, where compression of the spring system is achieved by, with respect to the schematic of FIG. 7C, imparting a force onto the piezoelectric transducer 270 sufficient to rotate the cross-section of the footplate 282 depicted therein counterclockwise, the constant pre-stress can be achieved owing to the reaction force imparted onto the piezoelectric transducer 270 by the "desire" of the hinge 284 to move the footplate 282 in the opposite (counterclockwise) direction.

Accordingly, in an exemplary embodiment, pre-stressing the drive components corresponds to "compressing" the spring system formed by the hinge 284 a sufficient amount to ensure that the piezoelectric transducer always remands under effective compression during expected abnormal events, such as in the eventuality of the bone conduction device being dropped etc. Some of the ramifications of this with respect to the performance of the bone conduction device will be described below.

In an exemplary embodiment, this pre-stress is a bit more than the force developed by the piezoelectric actuator 270 during operation (e.g., about 1.01, 1.02, 1.05, 1.08, 1.1, 1.15, 1.2, 1.25, 1.4, 1.5, 1.75, or about 2 or more or any value or range of values in between any of these values). It is noted that in some embodiments, this pre-stress feature, along with the methods detailed herein and/or variations thereof, can account for tolerance issues regarding the piezoelectric transducer 270, which in some embodiments comprises a stack of piezoelectric elements.

As noted above, in an exemplary embodiment, the teachings associated with FIG. 8A result effective accommodation of misalignments between the drive components in the driven components. Further in this regard, FIG. 8B depicts an example of how that misalignment is effectively accommodated utilizing the embodiment of FIG. 8A, where arrow 899 represents the force/movement resulting from actuation of piezoelectric transducer 270 (with end cap 273 welded to frame 261 (see fillet welds 291), thereby preventing any substantive movement of end cap 273 in the opposite direction), arrow 898 represents the direction of the force resulting from actuation of the piezoelectric transducer 270 from the transducer to the center of the spherical bearing 283 (corresponding to the effective accommodation of the misalignment), and arrow 897 corresponds to the direction of the force from the center of the circle bearing 283 into the footplate 285.

Figure 8C:
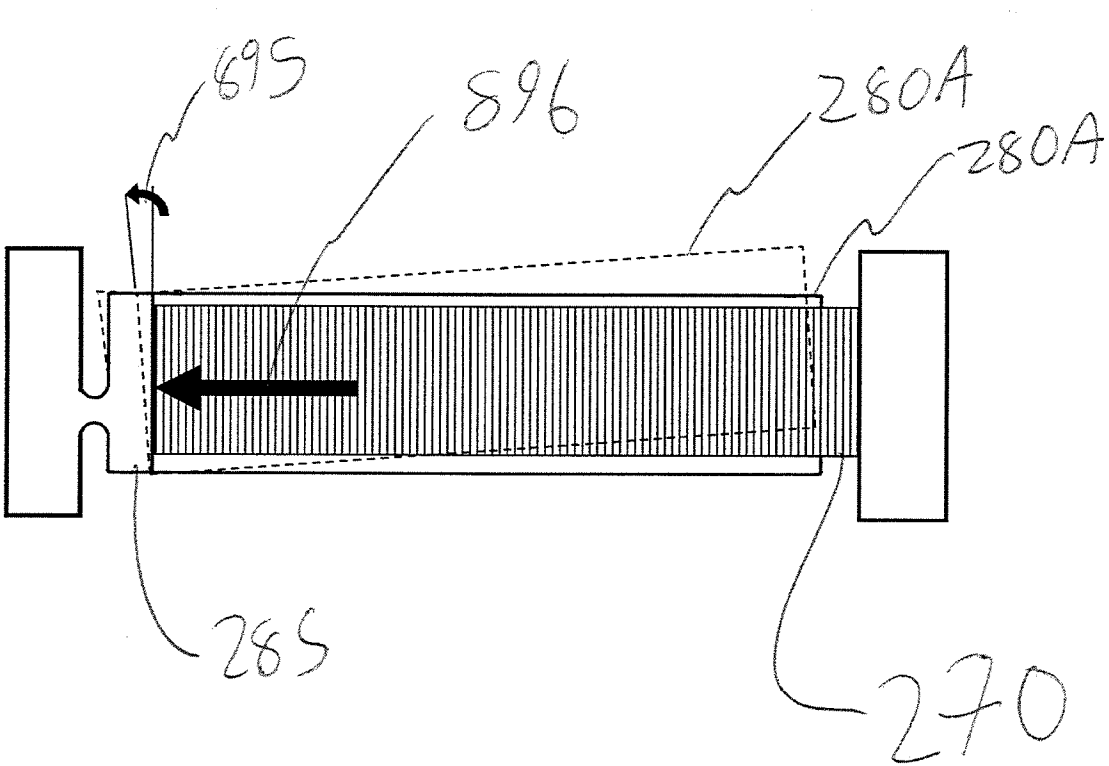
FIG. 8C illustrates an exemplary phenomenon according to some alternate embodiments.

Further along these lines, FIG. 8C depicts a scenario where the piezoelectric transducer 270 is actuated, represented by arrow 896, resulting in upward movement of lever arm 280A (which can be seen by comparison of the dashed lines to the solid lines), in a system where there is no spherical bearing 283. As can be seen, the actuation results in footplate 285 rotating by angle 895. In an exemplary embodiment, such rotation could reduce the utilitarian value of some of the embodiments detailed herein and/or variations thereof, at least with respect to a piezoelectric transducer 270 that directly abuts footplate 895, as is the case in FIG. 8C. By way of example and not by way of limitation, such could result in a stress concentration at the lower end portions of the piezoelectric actuator 270 and/or a stress concentration in other locations owing to for example, upward arching of the piezoelectric actuator 270 resulting from the rotation of footplate 895. The embodiment of FIGS. 8A and 8B reduce and or eliminate such scenarios. It is also noted that the embodiments of FIGS. 7A and 7B also can reduce and eliminate such scenarios, owing to the presence of for example end cap 276, which includes point 278.

Any device, system or method that can be used to eliminate or otherwise compensate for the moments and/or tension and/or the relief of compression applied to the piezoelectric element 270, which in some embodiments is made out of a ceramic which might be brittle, can be used in some embodiments and/or variations thereof. Further in this regard, as noted above, alternate embodiments include other devices, methods and/or systems of eliminating or reducing the effects of backlash. For example, instead of utilization of the spherical bearing and corresponding female component regime of FIG. 8A and associated compression as detailed above, and alternative embodiment can utilize a jackscrew or the like to apply the compression pre-stress to the piezoelectric transducer 270. For example, referring back to FIG. 7A, a hole corresponding to hole 263 of FIG. 8A can be placed in frame 260, and an end cap can be attached to the end 272 of piezoelectric transducer 270, although another embodiments this additional end cap might not be utilized. The hole through the frame 260 could be threaded (or a nut could be placed on the inside wall of the frame 260), and a jackscrew screwed therethrough. Rotation of the jackscrew from outside frame 260 in the correct direction would impart a compressive force onto the added end cap, and thus the drive components (e.g., piezoelectric transducer 270, etc.).

In yet an alternative embodiment, still referring back to FIG. 7A, frame 260 could be heated such that it expands, and the piezoelectric transducer 270 could then be inserted while the frame 260 contains sufficient amounts of thermal energy to maintain an effective expanded state. As this thermal energy is dissipated into the ambient environment, the frame will contract, thereby imparting a compressive stress on the drive components. In yet another alternative embodiment, again referring to the embodiment of FIGS. 6-7B, the sidewalls of the frame 260 that extend in the longitudinal direction of the device (e.g. the walls that are nonlinear) can be elastically compressed inward, thereby moving the opposite walls away from each other and providing additional room for the piezoelectric element 270. Upon insertion of the piezoelectric element 270, the end walls move towards each other thereby imparting the compressive stress on to the drive components. Alternatively, the walls can be elastically and/or plastically compressed outward after the drive components are installed in the housing, thereby moving the end walls towards each other and imparting the compressive stress onto the drive components. The housing walls (lids) added to the frame 260/261 can be used to ensure her otherwise prevent the walls from deforming back, thereby relieving the stress imparted onto the piezoelectric transducer. Again, any device system or method that can be utilized to reduce and/or eliminate backlash in general and to provide a compressive pre-stress onto one or more or all of the drive components (e.g., the piezoelectric transducer 270 etc.) can be utilized in some embodiments providing the teachings detailed herein in variations thereof can be practiced.

Figure 8D:
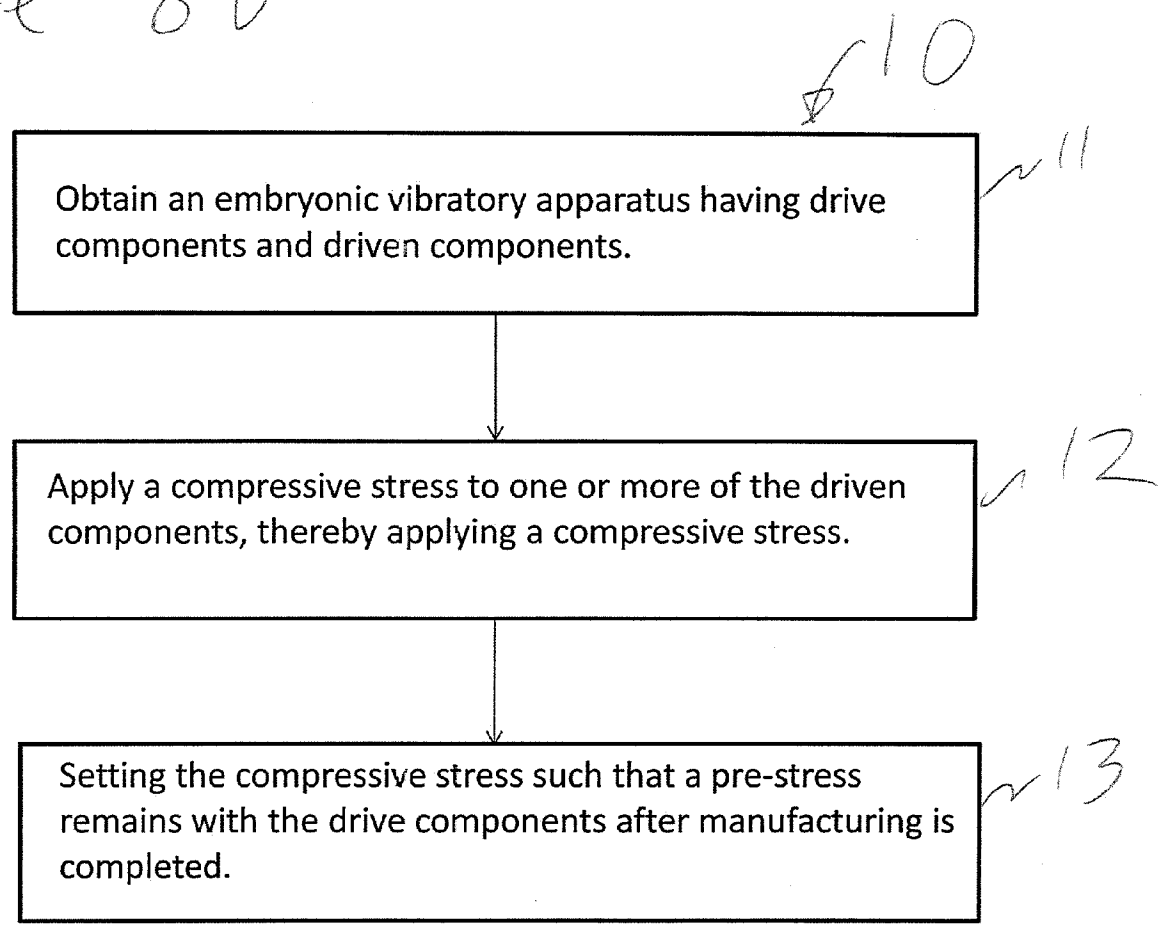
FIG. 8D illustrates an exemplary flowchart according to an exemplary method.

With the above teachings in mind, FIG. 8D depicts a flowchart 10 for an exemplary method according to an exemplary embodiment. The method represented by flowchart 10 can include method action 11 which entails obtaining an embryonic vibratory apparatus having drive components and driven components, wherein the driven components include a piezoelectric transducer. Upon the completion of method action 11, the method proceeds to method action 12 (with possible additional method actions there between), which entails applying a compressive stress to one or more of the driven components, thereby applying a compressive stress to the piezoelectric transducer. Upon the completion of method action 12, the method proceeds to method action 13 (which may include additional actions there between), which entails setting the compressive stress (e.g., by welding, etc.) such that a pre-stress remains with the drive components after manufacturing is completed.

It is noted that the teachings detailed herein respect to reduction and/or elimination of backlash have been presented as applied to a bone conduction device utilizing the features of the lever. Other embodiments include utilization of these teachings as applied to devices that utilize piezoelectric transducer elements that do not have the features of the lever as detailed herein and/or variations thereof. That is, in some embodiments, the anti-backlash features detailed herein can be applied to for example a bone conduction device, or other device for that matter, where the displacement of the piezoelectric element 270 results in a corresponding displacement of a mass in a 1:1 ratio or less.

Figure 8E:
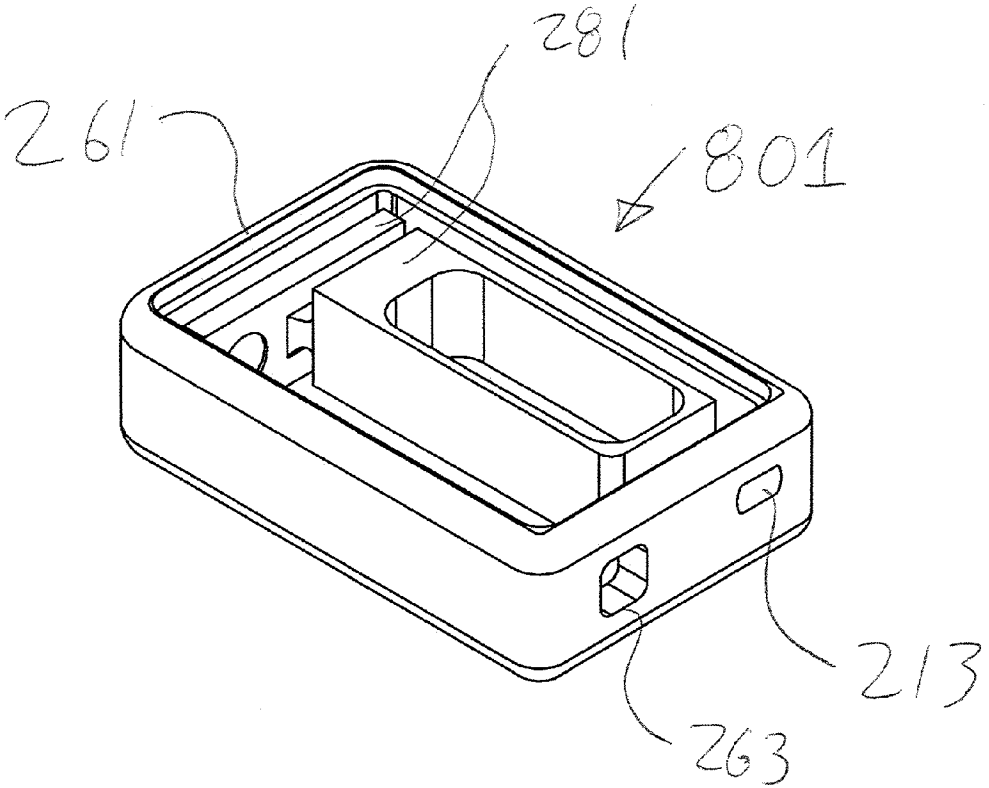
FIG. 8E illustrates an isometric view of a sub-component of a housing according to an exemplary embodiment.
Figure 6F:
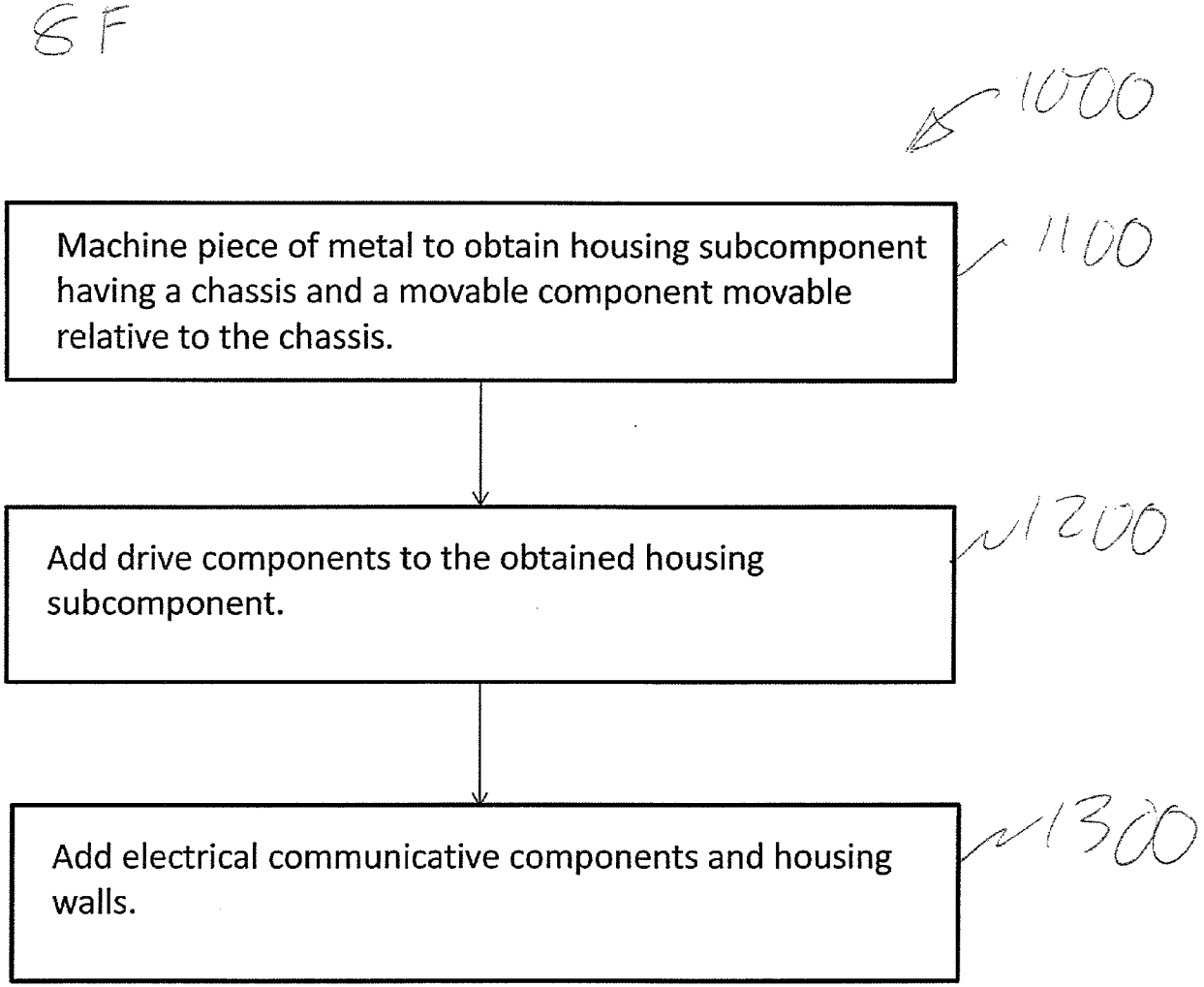

As can be seen from the FIGS. 6 to 7B, some embodiments can utilize a monobloc design where the frame 260 and the lever arm components are made from the same component. That is, the frame 260 and the translating lever arm 280 are both part of a monolithic component. In an exemplary embodiment, this component can be machined from a casting of titanium/titanium alloy or other suitable metal/metal alloy. Indeed, in some embodiments, this component can come from a single casting with minimal or even no machining thereto. Further along these lines, FIG. 8E depicts a housing subcomponent 801, where attachment of top and bottom walls and sufficient closure of the orifices 263 and 213 (through which the feedthrough 212 extends) can result in a hermetic enclosure as detailed above. In this embodiment, housing subcomponent 801 is a monolithic piece of titanium. Frame 261, which corresponds to a chassis, and translating lever arm 281, which corresponds to a movable element attached to the chassis, are a single unitary component machine from a single piece of titanium.

Along these lines, FIG. 8F presents an exemplary manufacturing method 1000 of a bone conduction device according to an exemplary embodiment. Method 110 includes action 1100, in which a piece of metal (which herein includes a metal alloy) is machined to obtain a housing subcomponent (e.g. housing subcomponent 801) having a chassis and a movable component movable relative to a chassis of the In action 1200 of method 1000 (where there can be additional actions between action 1100 and 1200), drive components are added to the obtained housing subcomponent (e.g. piezoelectric transducer elements, end plate (s), etc.), such that upon actuation of the drive components, the driven components which are part of the housing subcomponent machined from the metal in action 110, moves a movable component thereof to impart vibration onto the chassis portion of the housing sub-component. In action 1300 (where there can be additional actions between action 1200 and 1300, such as the addition of the mass 290 to the subhousing), electrical communicative components and housing walls are added to the housing subcomponent to establish a finished housing.

It is noted that the methods detailed herein and or variations thereof can include method actions prior to and or during and/or after the method actions delineated herein.

Figure 8G:
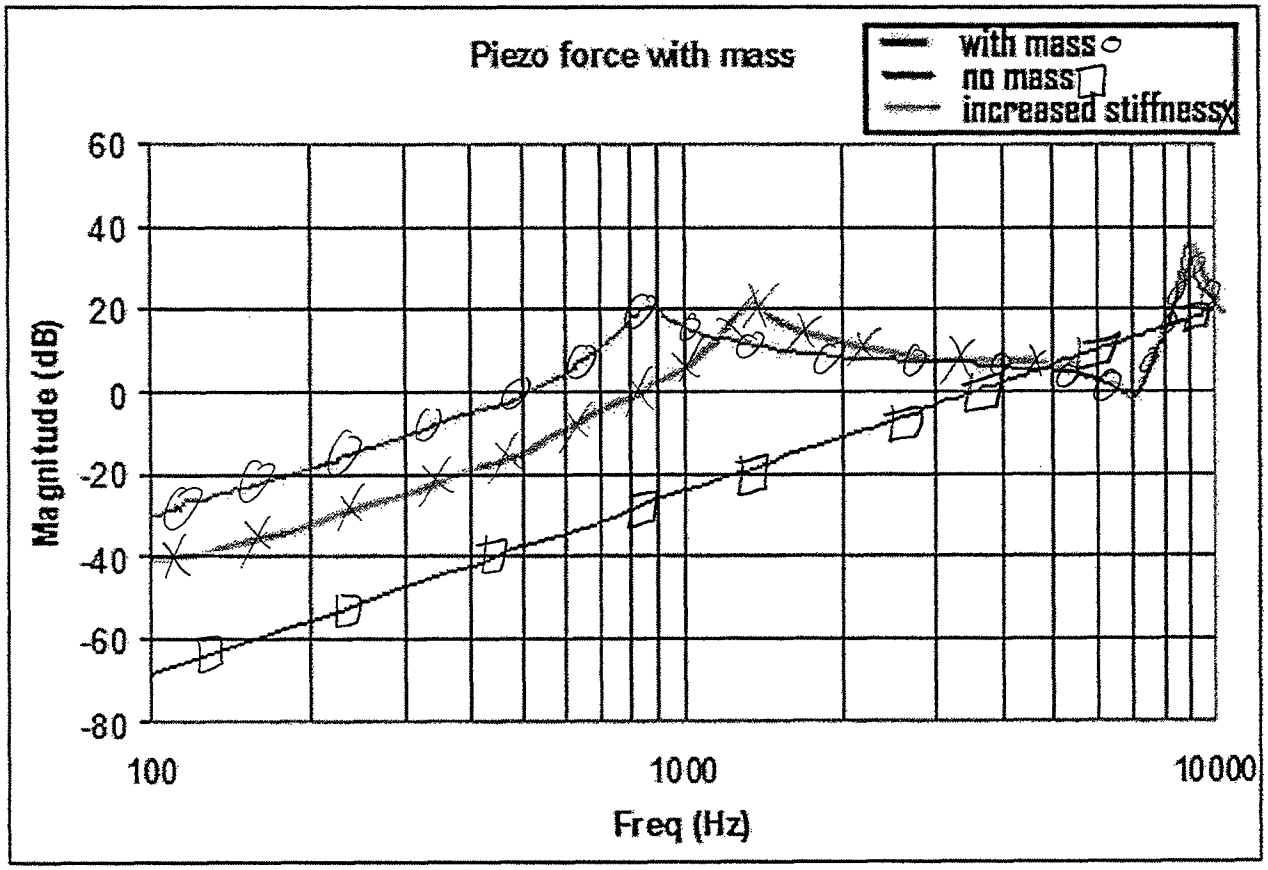
FIG. 8G illustrates a chart depicting output energy vs. frequency of an exemplary embodiment.

It is noted that implementing embodiments of the prestressed piezoelectric stack detailed above can be enabled by increasing the effective stiffness of the design of the hinge 284. However, this can have the effect of lowering the output force of the resulting bone conduction device, at least at output energies/forces corresponding to lower frequencies. In this regard, as noted above, the stiffness of the hinge 284 can be relatively high in some embodiments. In some embodiments, this may affect the utilitarian value of the resulting bone conduction device. In this regard, FIG. 8G provides an exemplary chart depicting force/energy output versus frequency of an exemplary bone conduction device under three scenarios. A first scenario is a control scenario where mass 290 is removed ("no mass" scenario), and is represented by the relatively straight line. A second scenario is a scenario where mass 290 is added ("with mass" scenario), and the stiffness of the hinge 284 corresponds to a unitized value of 1. A third scenario is a scenario where mass 290 is maintained as in the second scenario, and the stiffness of the hinge 284 corresponds to a value higher than the unitized value of 1 ("increased stiffness" scenario) of the second scenario. As can be seen, the increased stiffness of the hinge 284 generally decreases the output of the bone conduction device by about 10 dB, at least in the lower frequencies (e.g., 100 to 1500 Hz). An exemplary embodiment includes a bone conduction device where this phenomenon is at least partially countered (eliminated and/or reduced) by varying the geometry of the design of the second hinge 292, thereby tuning (or, more descriptively, frontloaded tuning the bone conduction device, because the second hinge is implemented prior to the bone conduction device bank functional) and/or reducing and/or eliminating the output differential.

Figure 8H:
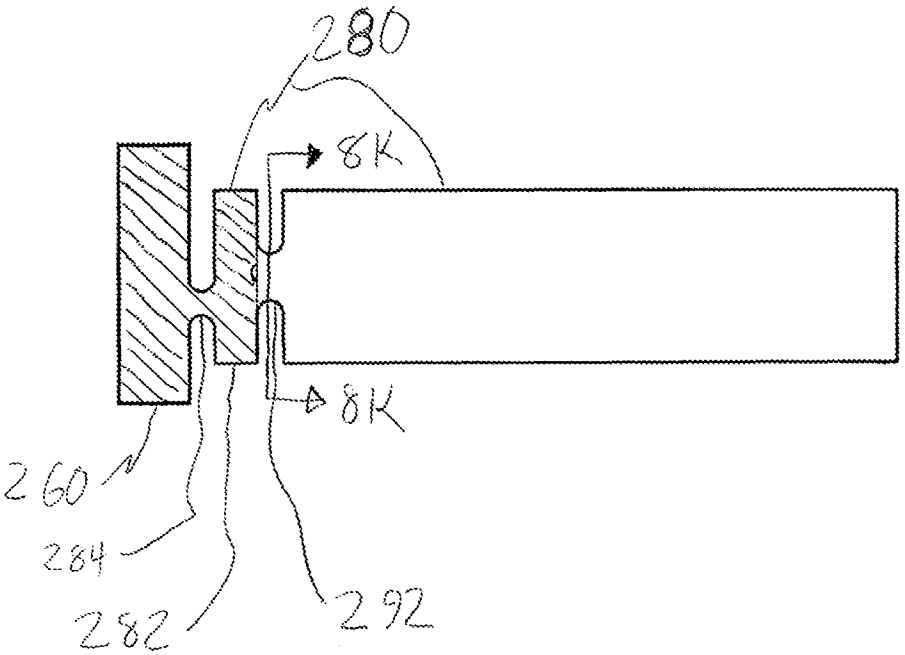
FIG. 8H illustrates a partial cross sectional view of the BCT of FIG. 8A.

In an exemplary embodiment, there is a bone conduction device that includes a transverse lever arm having a second hinge 292 having a specific geometry such that it is configured to influence the performance of the bone conduction device. By way of example only and not by way of limitation, such influence on the performance can include influencing the location of a resonance peak of the bone conduction device and/or varying the output of the bone conduction device. FIG. 8H depicts, in conceptual form, a side-view of some of the components illustrated in FIG. 7A. More specifically, FIG. 8C depicts a cross-section of frame 260, hinge 284, and footplate 282, essentially corresponding to that depicted in FIG. 7A. FIG. 8H also depicts the transverse lever arm 280 with second hinge 292. Not depicted is the piezoelectric stack 270 and end cap 276 and other components for purposes of clarity.

Figure 8I:
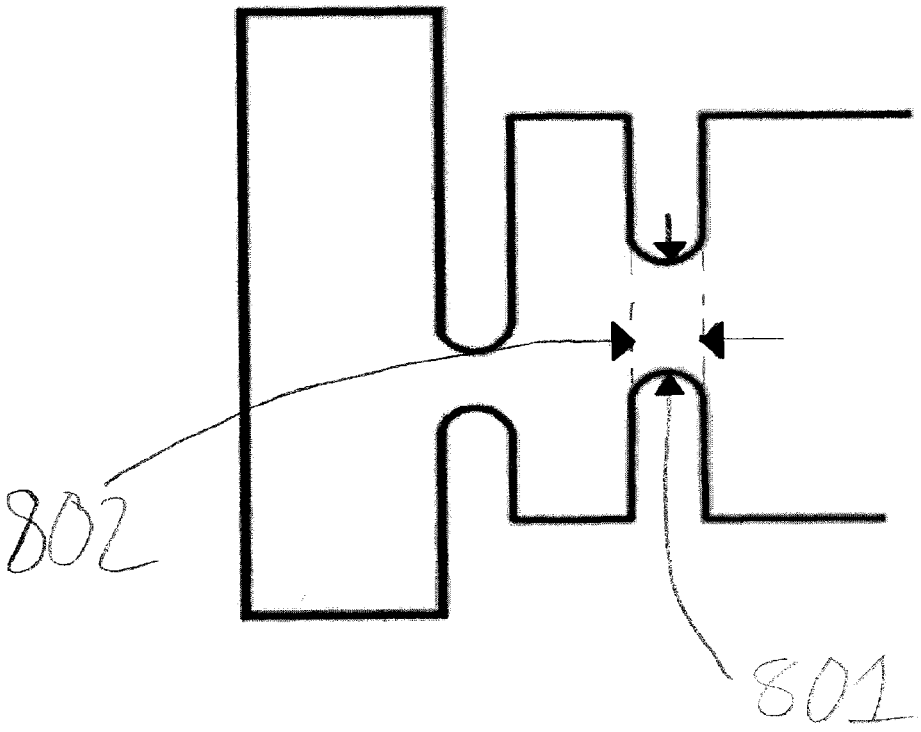
FIG. 8I illustrates a partial cross sectional view of the BCT of FIG. 8A.

FIG. 8I depicts a close-up view of the left side portion of FIG. 8H. Reference numerals 801 and 802 of FIG. 8I respectively correspond to, with respect to the orientation of FIG. 8H, the minimum thickness in the vertical direction and the minimum thickness in the horizontal direction of hinge 292. In an exemplary embodiment, varying the thickness 801 and/or thickness 802 in designs of the transverse lever arm 280 can vary parameters associated with the resulting system of transverse lever arm 280 due to hinge 284. By way of example only and not by way of limitation, varying one or both of these thicknesses can change (tune) a first fundamental frequency of the transverse lever arm 280/resulting bone conduction device (where the first fundamental frequency will be detailed further below). In an exemplary embodiment, this can be done independently of the configuration of the first hinge 284. That is, in an exemplary embodiment, a desired offset and/or leverage ratio achieved by the configuration of the first hinge 284 and relative placement of the pivot 286 and/or a desired stiffness achieved by the configuration of first hinge 284 can be maintained while the first fundamental frequency of the transverse lever arm 280/resulting bone conduction device can be varied. Accordingly, in an exemplary embodiment, various configurations of the second hinge 292 can move the resonance peak of the bone conduction device closer to and/or about the same and/or the same as that which would result with a less stiff hinge 284 (e.g., "the increased stiffness" curve of FIG. 8G could be moved to the left closer to and/or to substantially overlap "with mass" curve).

More particularly, in an exemplary embodiment, thickness 801 and/or thickness 802 can be set such that, with respect to the chart of FIG. 8G, the resonant peak of the bone conduction device and/or all or part of at least the sloping line of that chart associated with frequencies below the resonance peak can be set to a given desired frequency within a range of about 300 Hz to about 1.5 kHz and/or values above and/or below that in some embodiments. As just noted, in an exemplary embodiment, with respect to FIG. 8G, the thicknesses can be set such that the curve for the bone conduction device with "increased stiffness" with respect to the hinge 284 corresponds to at least substantially the curve for the bone conduction device with "with mass." Accordingly, in some embodiments, the second hinge 292 can negate, in part and/or in whole, a decrease of force output and/or energy output of a bone conduction device for a given frequency within a range of frequencies of about 300 Hz to about 1500 Hz attributable to an increased stiffness from a unit value of the first hinge.

In an exemplary embodiment, distance 801 and/or distance 802 can be about 0.1 mm, about 0.2 mm, about 0.3 mm, about 0.4 mm, about 0.5 mm, about 0.6 mm, about 0.7 mm, about 0.8 mm, about 0.9 mm, about 1.0 mm, about 1.1 mm, about 1.2 mm, about 1.3 mm, 1.4 mm, about 1.5 mm, 1.6 mm, about 1.7 mm, about 1.8 mm, about 1.9 mm, about 2.0 mm, about 2.1 mm, about 2.2 mm, about 2.3 mm, 2.4 mm, about 2.5 mm, 2.6 mm, about 2.7 mm, about 2.8 mm, about 2.9 mm, about 3.0 mm, about 3.1 mm, about 3.2 mm, about 3.3 mm, 3.4 mm, about 3.5 mm, 3.6 mm, about 3.7 mm, about 3.8 mm, about 3.9 mm, about 4.0 mm, about 4.1 mm, about 4.2 mm, about 4.3 mm, 4.4 mm, about 4.5 mm, 4.6 mm, about 4.7 mm, about 4.8 mm, about 4.9 mm, about 5.0 mm or more or any values or range of values therebetween in 0.01 mm increments (e.g., about 2.22 mm, about 0.84 mm to about 3.33 mm, etc.)

In an alternate embodiment, in addition to and/or alternatively to varying one or more the aforementioned thicknesses, other modifications to the design of the hinge 292 can be implemented. For example, the overall length (e.g. the dimension that extends into an out of the plane on which FIG. 8H is presented) of the hinge 292 need not correspond to the full length of the footplate rest of the arm. In an exemplary embodiment, the length can be less than the length of the arm. By way of example only and not by way of limitation, in some embodiments, this length can be about 1.0 mm 5.0 mm, about 7.5 mm, about 10.0 mm, about 15 mm, about 20 mm, about 25 mm, about 30 mm, or more or any value or range of values therebetween in about 0.5 mm increments (e.g., about 5.5 mm, about 7.5 mm to about 17.5 mm, etc.).

Figure 8J:
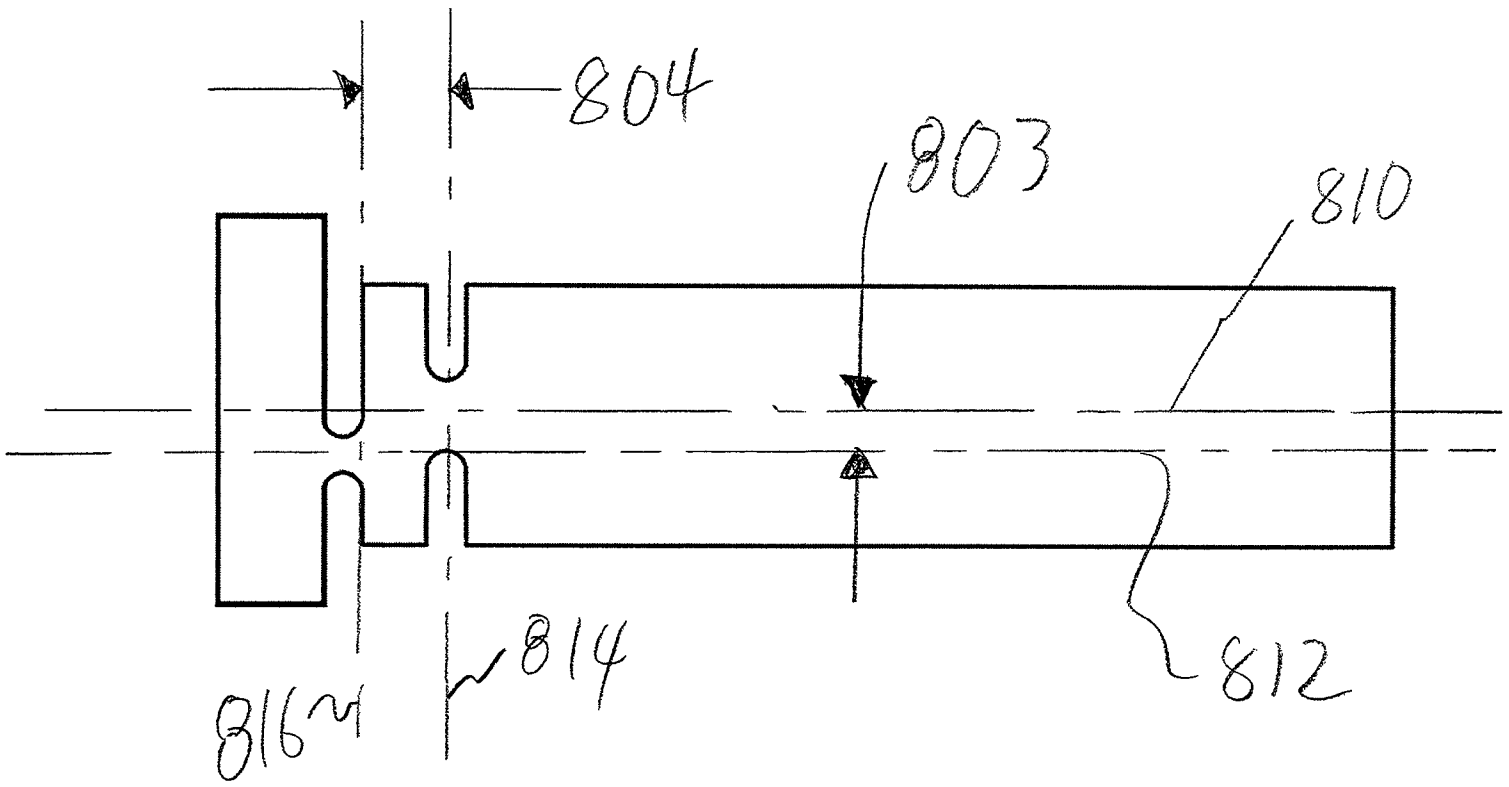
FIG. 8J illustrates a partial cross sectional view of the BCT of FIG. 8A.

FIG. 8J also depicts a close-up view of the left side portion of FIG. 8H. Reference numerals 810 and 812 of FIG. 7J respectively correspond to, with respect to the orientation of FIG. 8H, the horizontal centerlines associated with hinges 292 and 284. Also, numerals 814 and 816 respectively correspond to, with respect to the orientation of FIG. 8H, the vertical centerlines associated with hinge 292 and hinge 284. As can be seen, the vertical centerlines 814 and 816 are offset by a distance represented by reference numeral 804. Also as can be seen, the horizontal centerlines 810 and 812 are offset by a distance represented by reference numeral 803.

In an exemplary embodiment, varying the distance 803 and/or the distance 804 in designs of the transverse lever arm 280 can vary parameters associated with the resulting system of transverse lever arm 280 due to hinge 284. By way of example only and not by way of limitation, varying one or both of these distances can change (tune) a first fundamental frequency of the transverse lever arm 280/resulting bone conduction device (where the first fundamental frequency will be detailed further below). In an exemplary embodiment, this can be done independently of the configuration of the first hinge 284. That is, in an exemplary embodiment, a desired offset and/or leverage ratio achieved by the configuration of the first hinge 284 and relative placement of the pivot 286 and/or a desired stiffness achieved by the configuration of first hinge 284 can be maintained while the first fundamental frequency of the transverse lever arm 280/resulting bone conduction device can be varied. Accordingly, in an exemplary embodiment, various locations of the second hinge 292 can move the resonance peak of the bone conduction device closer to and/or about the same and/or the same as that which would result with a less stiff hinge 284 (e.g., "the increased stiffness" curve of FIG. 8G could be moved to the left closer to and/or to substantially overlap "with mass" curve).

More particularly, in an exemplary embodiment, distance 803 and/or distance 804 can be set independently and/or in addition to setting the aforementioned thicknesses of the second hinge such that, with respect to the chart of FIG. 8G, the resonant peak of the bone conduction device and/or all or part of at least the sloping line of that chart associated with frequencies below the resonance peak can be set to a given desired frequency within a range of about 300 Hz to about 1.5 kHz and/or values above and/or below that in some embodiments. In an exemplary embodiment, with respect to FIG. 8G, the distances can be set such that the curve for the bone conduction device with "increased stiffness" with respect to the hinge 284 corresponds to at least substantially the curve for the bone conduction device with "with mass." Accordingly, in some embodiments, setting the distances of the second hinge alone or in combination with setting the thicknesses of the second hinge can negate, in part and/or in whole, a decrease of force output and/or energy output of a bone conduction device for a given frequency within a range of frequencies of about 300 Hz to about 1500 Hz attributable to an increased stiffness from a unit value of the first hinge.

In an exemplary embodiment, distance 803 and/or distance 804 can be about 0.1 mm, about 0.2 mm, about 0.3 mm, about 0.4 mm, about 0.5 mm, about 0.6 mm, about 0.7 mm, about 0.8 mm, about 0.9 mm, about 1.0 mm, about 1.1 mm, about 1.2 mm, about 1.3 mm, 1.4 mm, about 1.5 mm, 1.6 mm, about 1.7 mm, about 1.8 mm, about 1.9 mm, about 2.0 mm, about 2.1 mm, about 2.2 mm, about 2.3 mm, 2.4 mm, about 2.5 mm, 2.6 mm, about 2.7 mm, about 2.8 mm, about 2.9 mm, about 3.0 mm, about 3.1 mm, about 3.2 mm, about 3.3 mm, 3.4 mm, about 3.5 mm, 3.6 mm, about 3.7 mm, about 3.8 mm, about 3.9 mm, about 4.0 mm, about 4.1 mm, about 4.2 mm, about 4.3 mm, 4.4 mm, about 4.5 mm, 4.6 mm, about 4.7 mm, about 4.8 mm, about 4.9 mm, about 5.0 mm, about 5.1 mm, about 5.2 mm, about 5.3 mm, 5.4 mm, about 5.5 mm, 5.6 mm, about 5.7 mm, about 5.8 mm, about 5.9 mm, about 6.0 mm, about 6.5 mm, about 7.0 mm about 7.5 mm, about 8.0 mm, about 8.5 mm, about 9.0 mm, about 9.5 mm, about 10.0 mm, about 10.5 mm, about 11.0 mm, about 12 mm, about 13 mm, about 14 mm, about 15 mm, about 16 mm, about 17 mm, about 18 mm, about 19 mm, and/or about 20 mm, or more or any values or range of values therebetween in 0.01 mm increments (e.g., about 2.22 mm, about 0.84 mm to about 3.33 mm, etc.)

As detailed herein, some embodiments can include additional living hinges beyond the second hinge 292. In an exemplary embodiment, the transverse lever arm 280 can include a third, a fourth, a fifth, a sixth or even more such living hinges. It is noted that in some embodiments, any teachings associated with or otherwise applicable to one of the hinges detailed herein and/or variations thereof can be applicable to another of the hinges detailed herein and/or variations thereof, and thus those teachings can be applicable to the additional hinges just detailed. For example, the disclosure above associated with the holes through hinge 282 are thus applicable to the hinge 292 or other hinges, etc.

Figure 8K:
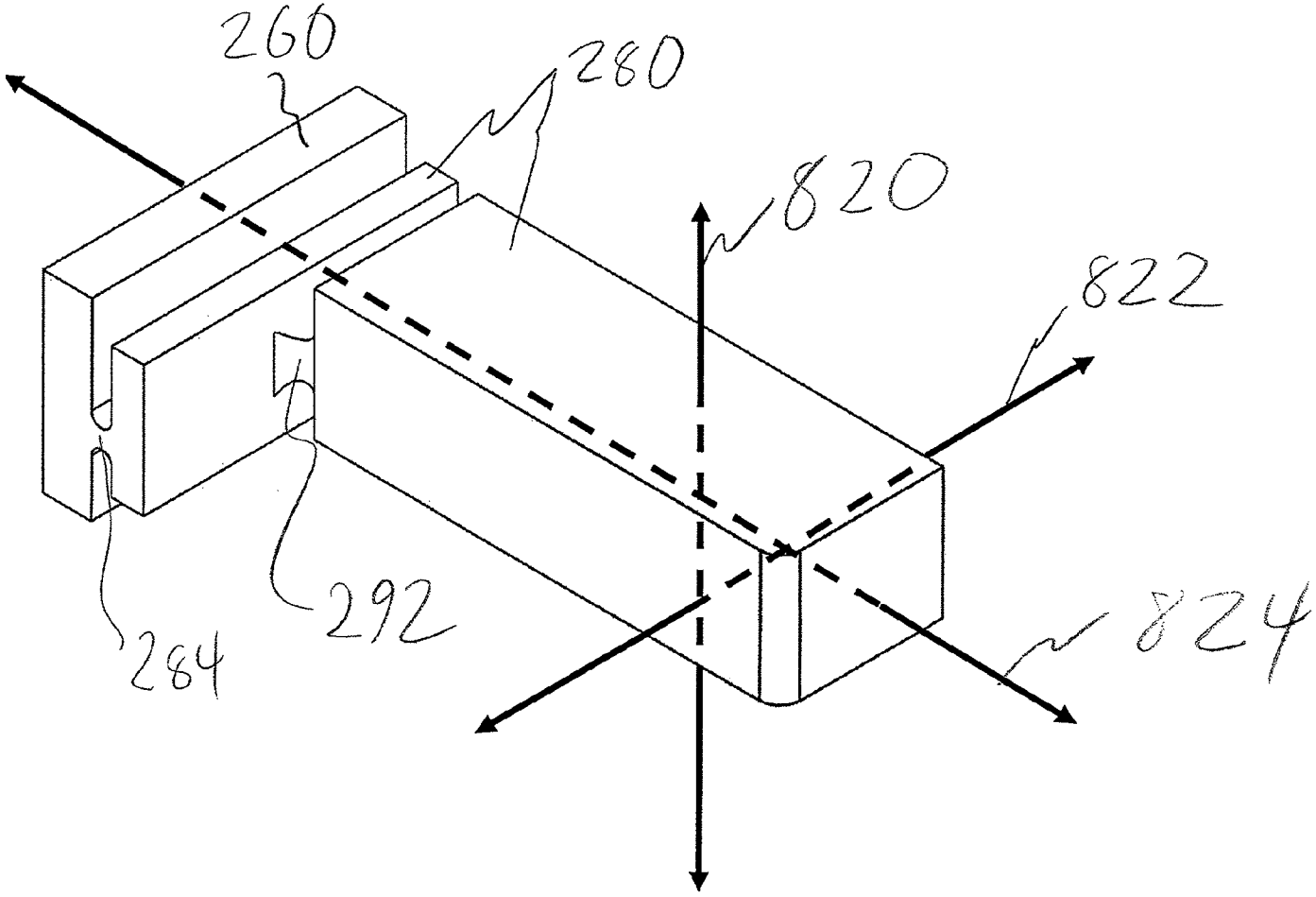
FIG. 8K illustrates an isometric view of a portion of the BCT of FIG. 8A.

The above discussion with respect to varying the geometries and/or locations of the second hinge 292 has been directed towards what was briefly referred to above as the first fundamental frequency of the transverse lever arm 280 (and thus, at least in some embodiments, of the bone conduction device of which it is a part). Referring now to FIG. 8K, the structure depicted in FIG. 7B is reproduced with three sets of axes 820, 822, and 824, imposed upon the structure depicted therein. In an exemplary embodiment, actuation of the piezoelectric transducer 270 causes the transverse lever arm 280 to move along a trajectory that has a significant component in all three dimensions beyond that which is attributable to the fact that the arm moves in an arcuate manner about hinge 284 and/or 292 (although it is noted that in some embodiments, the configuration of the components of the bone conduction device are such that actuation of the electronic transducer 270 causes the transverse lever arm 280 to move along a trajectory that has a significant component in only one and/or to dimensions). In this regard, in an exemplary embodiment, there is a bone conduction device such that the placement of the mass 290, the stiffness of one or more or all of the hinges, the stiffness of the material of the chassis of the bone conduction device, and/or the geometry of one or more or all of the components thereof etc., is such that the transverse lever arm 280 moves in one and/or two and/or three dimensions (directions) as a result of the arcuate movement of the arm. This can be because, in some embodiments there are one or two or three or more fundamental frequency mode shapes at various frequencies because of the aforementioned features of the bone conduction device.

Still referring to FIG. 8K, axis 820 corresponds to movement of the transverse lever arm 280, or, more particularly, the movement of the center of gravity thereof (which is established by the arm and the mass therein), in the dimension (direction) that is normal to the surface of the skull to which the bone conduction device is attached. This is referred to herein as movement impacting the first fundamental frequency of the arm and/or bone conduction device. In this regard, a first fundamental frequency mode shape of the arm/device can be set or otherwise modified by influencing the movement of the arm in this direction. Axis 822 corresponds to movement of the transverse lever arm 280, or, more particularly, the movement of the center of gravity thereof (which, as noted herein, is impacted by the mass), in the dimension (direction) that is normal to axis 820 and in a lateral direction to the surface of the skull and in a lateral direction with respect to the transverse lever arm 280. This is referred to herein as movement impacting the second fundamental frequency of the arm and/or bone conduction device. In this regard, a second fundamental frequency mode shape of the arm/device can be set or otherwise modified by influencing the movement of the arm in this second direction. Axis 824 corresponds to movement of the transverse lever arm 280, or, more particularly, center of gravity thereof, in the dimension (direction) that is normal to axis 820 and in a longitudinal direction with respect to the transverse lever arm 280. This is referred to herein as movement impacting the third fundamental frequency of the arm and/or bone conduction device. In this regard, a third fundamental frequency mode shape of the arm/device can be set or otherwise modified by influencing the movement of the arm in this direction. Movements in these dimensions impact locations of the resonance peaks of the force output/energy output versus frequency curves, depending on the geometry and/or design of the other components of the bone conduction device as will now be described.

In an exemplary embodiment, the first and/or the second hinge is configured such that movement of the transverse lever arm 280 in the direction of axis 820 establishes a first fundamental frequency of the bone conduction device such that the first fundamental resonant frequency is at about 900 Hz. In an exemplary embodiment, this is achieved by configuring one or more or all hinges such that the cross-sections of the most narrow portion of the hinges are relatively long and narrow. In this regard, the resulting aspect ratio (length to thickness) of the hinges causes most of the energy resulting from the actuation of the piezoelectric transducer 270 to translate into movement of the arm in the direction of axis 820. As detailed herein, by varying the geometry of the hinges, the resonant frequency associated with movement in this direction (the first fundamental resonant frequency) can be established at about 900 Hz. Indeed, by varying the geometry of the hinges, the first, second and third fundamental resonant frequencies can be shifted to values that have utilitarian values, such as those detailed below. Some exemplary geometries to achieve this shifting will now be described with reference to the second hinge. However, it is noted that the teachings detailed herein and/or variations thereof associated with hinge 292 can also be applicable to hinge 284 and/or other hinges.

Figure 8L:
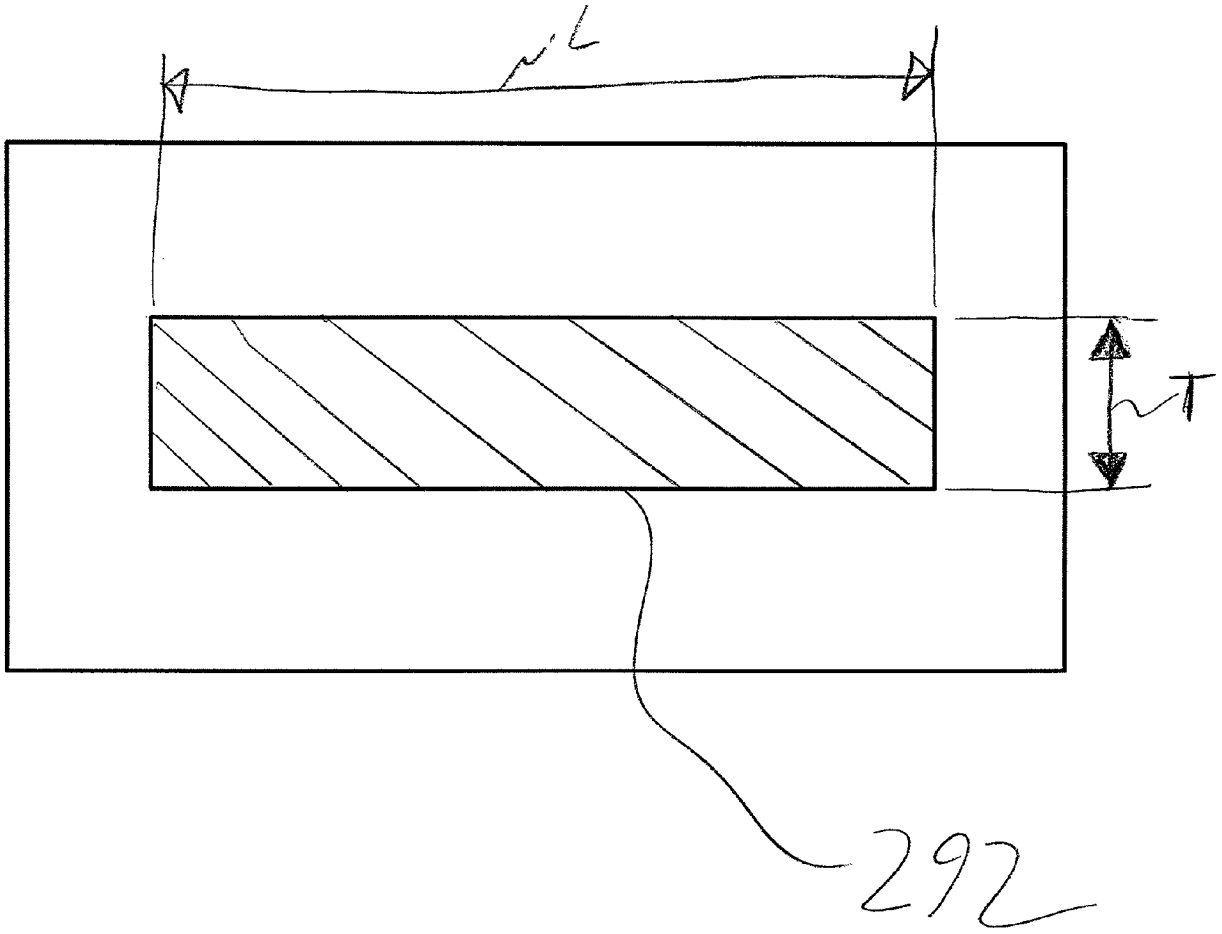
FIG. 8L illustrates a partial cross sectional view of the portion of the BCT of FIG. 8J.

FIG. 8L depicts a cross-section through the second hinge 292 of FIG. 8H, where dimension T is a thickness of the narrowest portion of the hinge 292 and dimension L is a length of the narrowest portion of the hinge 292. Accordingly, hinge 292 has an aspect ratio according to the equation $$\text{Aspect Ratio}=L/T$$

By varying the ratio of L to T, the value of the aspect ratio will change. That is, as L becomes larger and/or as T becomes smaller, the aspect ratio will correspond to a relatively higher value. Conversely as L become smaller and/or as T becomes larger the aspect ratio will correspond to a relatively lower value. In an exemplary embodiment, the aspect ratio can be about 0.5, 1.5, 2.0, 2.5, 3.0, 3.5, 4.0, 4.5, 5.0, 5.5, 6, 6.5, 7.0, 7.5, 8.0, 8.5, 9.0, 9.5 and/or 10.0 or more or any value or range of values therebetween in 0.1 increments (e.g., about 4.6, about 3.8 to about 6.6, etc.). In an exemplary embodiment, as the relative aspect ratio increases, the relative location of the first fundamental frequency decreases and conversely, as the relative aspect ratio decreases, the relative location of the first fundamental frequency increases. Still further, in an exemplary embodiment, as the relative aspect ratio increases, the relative location of the second fundamental frequency increases and conversely, as the relative aspect ratio decreases, the relative location of the second fundamental frequency decreases. It is noted however, that in some alternate embodiments the reverse of one or more or all of these is the case, at least if there are other components in the system that influence the resonant frequencies of the device.

In an exemplary embodiment, the first and/or the second hinge is configured (e.g., has an aspect ratio) such that movement of the transverse lever arm 280 in the direction of axis 822 establishes a second fundamental frequency of the bone conduction device such that the second fundamental resonant frequency is at about 3800 Hz. In an exemplary embodiment, this is likewise achieved by configuring the hinges such that the hinges are relatively long and narrow (e.g., an aspect ratio of about 4 or 5 or 6 or more, as was the case with respect to the first fundamental frequency just described). In this regard, the resulting aspect ratio of the hinges causes only a minority of the energy resulting from the actuation of the piezoelectric transducer 270 to translate into movement of the arm in the direction of axis 822. As detailed herein, by varying the geometry of the hinges, the resonant frequency associated with movement in this direction (the first fundamental resonant frequency) can be established at about 3800 Hz. In an exemplary embodiment, the configuration of the hinges are configured such that this second fundamental resonance frequency is as high as possible.

In an exemplary embodiment, the first and/or the second hinge is configured such that movement of the transverse lever arm 280 in the direction of axis 824 establishes third fundamental frequency of the bone conduction device such that the third fundamental resonant frequency is at about 9.8 kHz. In an exemplary embodiment, this is achieved by configuring the hinges such that the cross-sectional area depicted in FIG. 8L has a certain value such that movement in the direction of axis 824 resulting from deformation of the hinge 292 as a result of tension applied thereto due to the movements of the transverse lever arm 280 in the arcuate trajectory (e.g., due to centrifugal force where the center of gravity of the transverse lever arm 280 is to the right of hinge 292 with respect to the layout of FIG. 8H). In an exemplary embodiment, as the relative area increases, the relative location of the third fundamental frequency increases, and as the relative area decreases, the relative location of the third fundamental frequency decreases. In an alternate embodiment, the opposite is the case, at least with respect to embodiments where additional components act on the arm. Accordingly, in an exemplary embodiment, the cross-sectional area of the thinnest portion of the hinge 292 (corresponding to that depicted in FIG. 8L) is such that the third fundamental resonant frequency is at about 9.8 kHz.

Figure 9A:
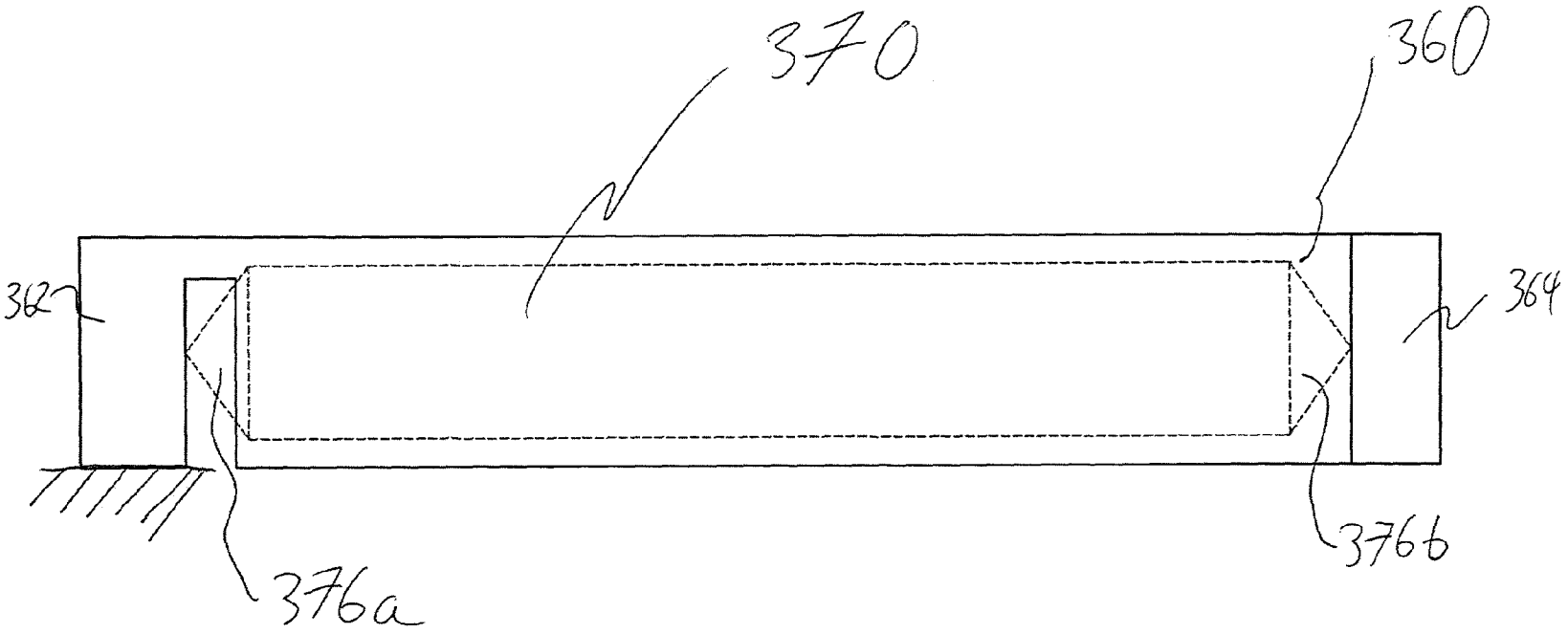
FIGS. 9A through 9D illustrate another embodiment of an exemplary embodiment.
Figure 9B:
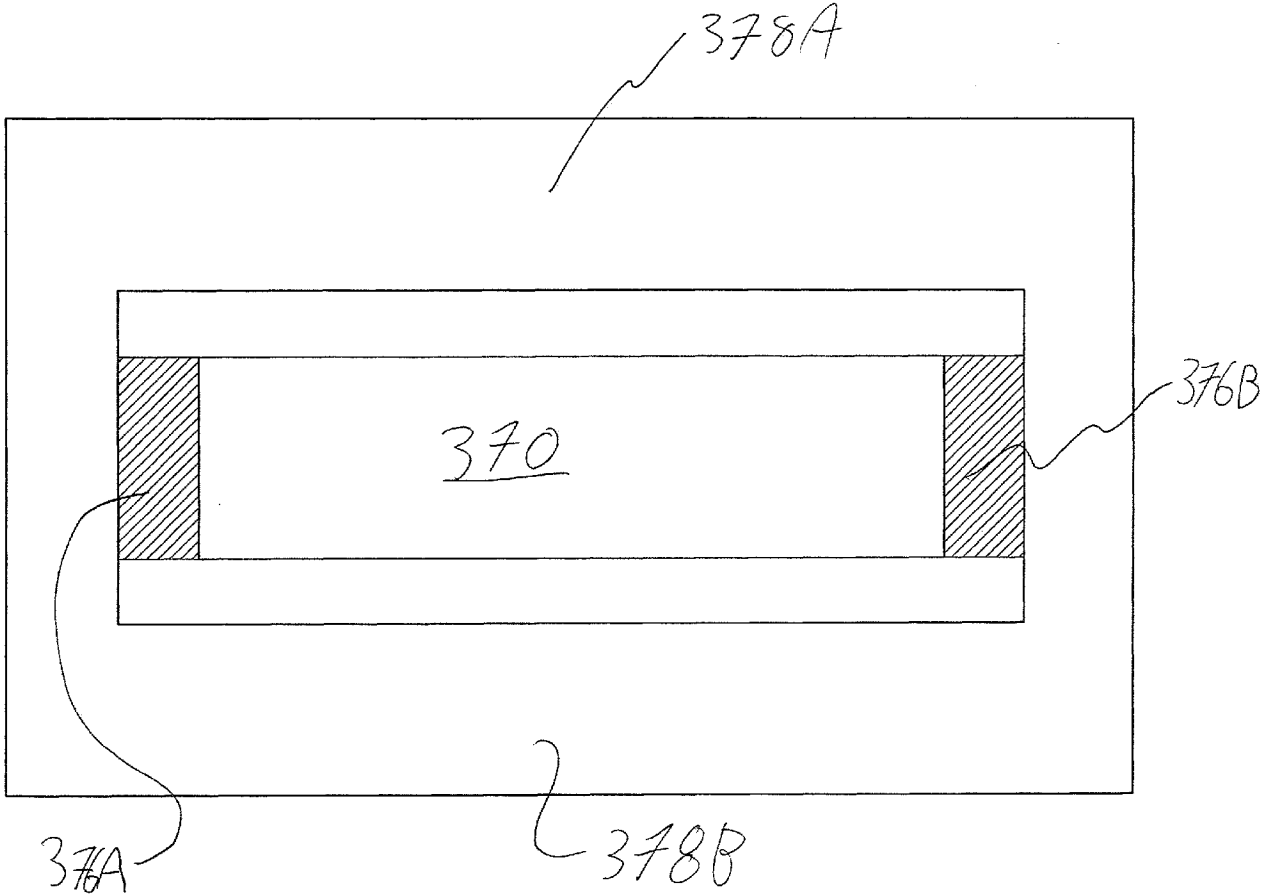
Figure 9C:
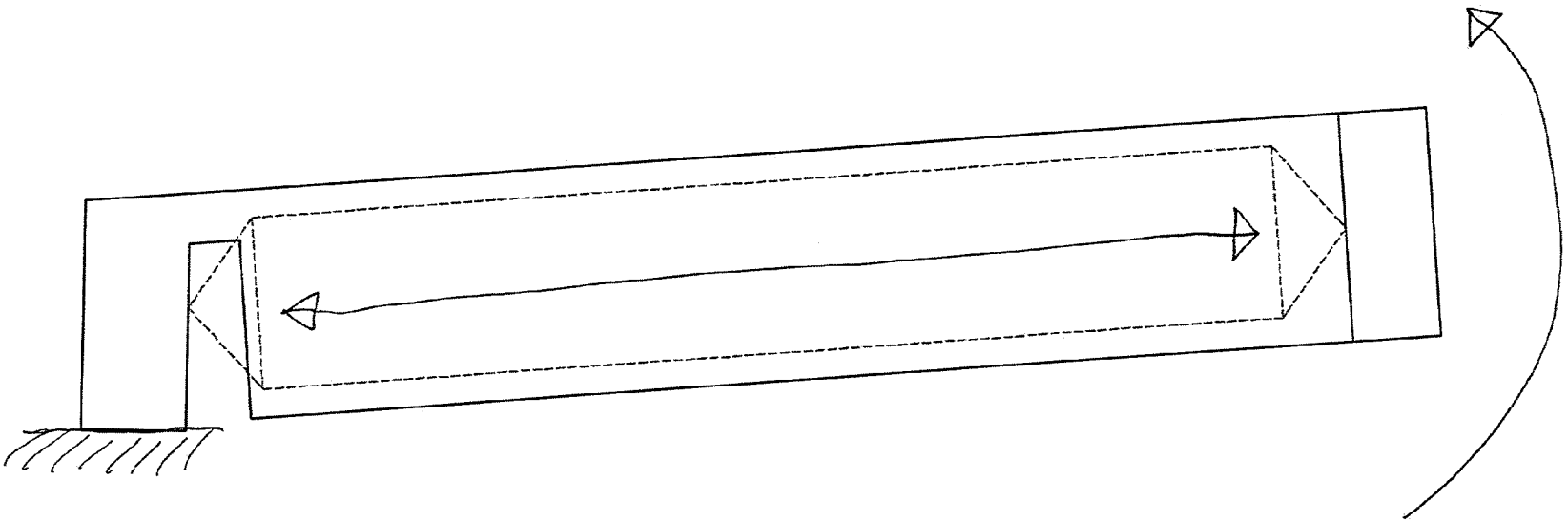
Figure 9D:
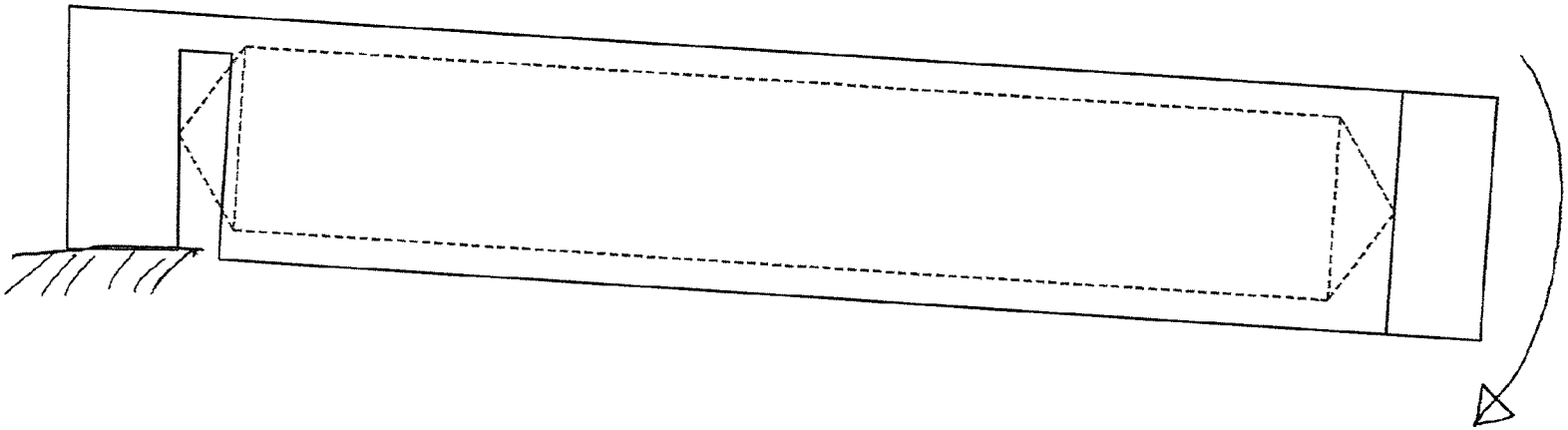

FIGS. 9A and 9B illustrate a second embodiment of a vibrator arrangement that allows for amplifying actuator displacement and translating that displacement from a first direction to a second direction. FIG. 9A illustrates a side view of the vibrator arrangement, which can be disposed within an internal cavity of an implantable housing (not shown) or other type of housing, and/or as with the other embodiments detailed herein and or variations thereof can be attached to a device different from housing (e.g. a plates, a surface of a device, etc.). FIG. 9B illustrates a top view. As shown, the transducer assembly includes a frame 360 which defines a lever arm having a free end. The frame 360, includes a first or proximal end plate 362 that is fixedly interconnected to a supporting structure (e.g., implant housing). A second end plate 364 of the frame is cantilevered from this fixed end 362 by first and second side arms 378A, 378B. A PET 370 is disposed between the inside surfaces of the end plate. First and second end caps 376A and 376B are disposed on either end of the PET 370. These end caps 376 come to a tapered point (e.g., knife edge) which extends across a portion of the width of the respective end plate 362, 364. In this regard, while being disposed between these end plates, the PET maintains minimal contact or a pivoting contact. During operation, the PET 370 is operative to expand and apply an expansive force between the end plates 362 and 364. This is illustrated in FIG. 9C. Such expansion, in conjunction with the pivotally interconnected ends of the PET 370 forces the free end of the lever arm upward. Removal of a voltage across the PET allows the free end of the lever arm to move in a opposite direction and, in some instances, beyond a static location of the frame.

The side arms 378A and 378B have a reduced cross section as shown in FIG. 9A proximate to the location where they interconnect to the first end plate 362. Again, this reduced cross section between the side arm and end plates provides a flexural hinge that permits the free end of the frame to move. The size of these flexural hinges can be selected to provide a desired resonance.

As shown, in this embodiment, the PET 370 itself forms a portion of the mass that is utilized to apply vibrations to the housing in which such a transducer is disposed. In this regard, as the mass of the PET form part of the overall vibrating mass, the size of an inertial mass can be reduced and overall size of the transducer can be reduced.

Figure 10:
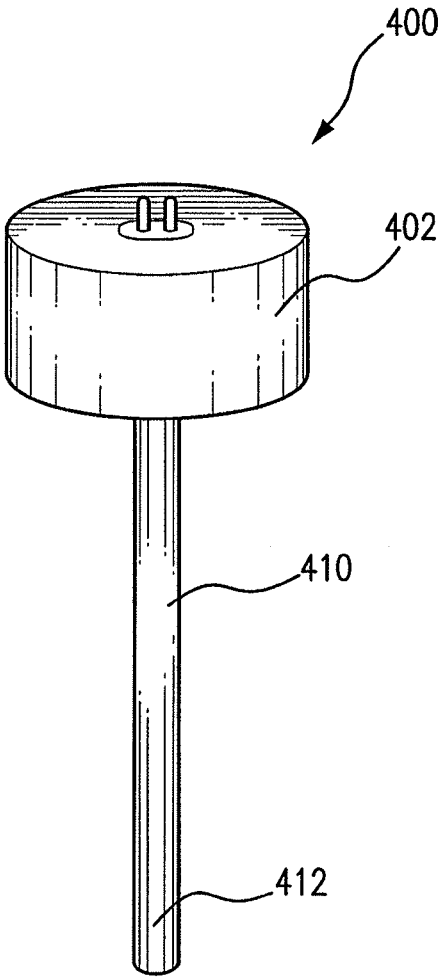
FIG. 10 illustrates another embodiment of a bone conduction transducer.
Figure 11:
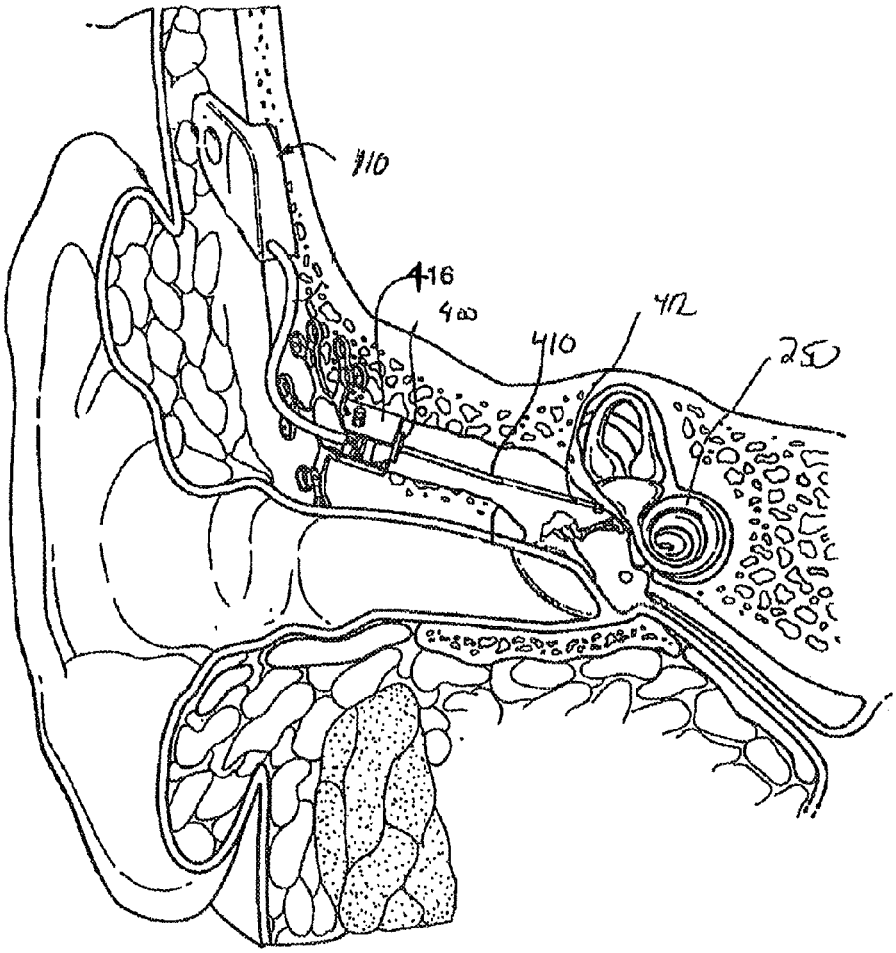
FIG. 11 illustrates positioning of the bone conduction transducer within a skull of a patient (recipient).

FIG. 10 illustrates a further embodiment of a BCT transducer. In this embodiment, the BCT 400 again includes a biocompatible housing 402 that defines an internal chamber for housing a vibrator assembly according to one or more or all of the embodiments detailed herein and/or variations thereof. However, in this embodiment the BCT further includes on a lower surface a vibration extension element 410. This vibration extension element 410 is, in the present embodiment, a solid metallic rod that is integrally formed with the lower surface of the housing 402. In this regard, when vibrations are applied to the housing, these vibrations are transmitted through the vibration extension 410. In some embodiments, vibration transmission is dependent at least in part on the density of the material through which the vibrations pass. Accordingly, metals (e.g., titanium, etc.) can be utilitarian conductors of vibration.

At least some exemplary embodiments of the BCT 400 are based upon the recognition that it can be utilitarian to provide vibrations to bone structure more proximately located to the cochlea. In this regard, it has been recognized that various middle ear implant systems have been devised that allow for positioning a transducer element proximate to, for example, the ossicular chain of a patient. In such arrangements, a hole is typically formed through the mastoid of the patient in order to position to the transducer element within the tympanic cavity. One such positioning and retention apparatus is disclosed in U.S. Pat. No. 7,273,447.

In the present embodiment, the BCT 400 is adapted to be received within the interior of a positioning device 416 such that the vibration extension 410 can extend from the bottom surface of the housing 402 into the tympanic cavity and be disposed against bone structure proximate to the cochlea 250. As will be appreciated, by positioning the distal end 412 of the extension 410 against bone structure proximate to the cochlea, the magnitude of the vibrations necessary to generate adequate hearing can be significantly reduced. That is, in contrast to FIG. 1 where the vibrations applied to the outside surface of the mastoid region of the skull travel several centimeters prior to reaching the cochlea and are subject to attenuation by the intervening bone, the more direct application of vibration proximate to the cochlea receives little or no bone attenuation. Accordingly, the magnitude of the vibrations required to sufficiently stimulate hearing can be reduced. Likewise, the power required to generate such vibrations can likewise be reduced.

The distal end 412 of the extension 410 can include a rounded engagement head for positioning against the bone surface. Alternatively, the distal end can be engaged within a pocket formed in the bone. In any arrangement, the retention apparatus 416 allows for advancing and/or retracting the BCT 400 to correctly position the distal end. Once so positioned, the retention apparatus 416 can be locked and thereby maintain the distal end 412 of the BCT 400 in contact with the patient bone proximate to the cochlea 250. Though illustrated as utilizing a long, straight extension 410, it will be appreciated that extension need not be straight. That is, the extension can have any shape that allows for desired placement proximate to the cochlea. In this regard, the distal end 410 can be applied to any appropriate location within the tympanic cavity while still reducing the distance between where the vibrations are applied to the skull and received by the cochlea.

According to at least some embodiments of the embodiment of FIG. 10, the housing of the BCT 400 can have an increased thickness. That is, as the housing is designed to be placed into the skull as opposed to on the surface of the skull, the thickness of the housing can be considerably increased. Likewise, in such an arrangement, translation of the movement of the actuator from a first direction to a second direction cannot be necessary. Nonetheless, for purposes of power reduction, it may still be desirable to utilize the mechanical advantage systems as set forth above.

Power Considerations

Another consideration in the case of utilizing a PET with an implantable device is that the electrical input impedance of a PET is highly capacitive. In at least some embodiments, the amount of power it takes to generate a given force can be minimized to zero (theoretically) by making sure that the energy stored in the electrical reactances presented to the driver/actuator are recovered by the driver/actuator. This can be done with electromagnetic transducers by using a switching amplifier and recovering the energy stored in the inductance of the drive coil by returning it back to the power supply. That is, in electromagnetic drive systems, operation is inductive and as the amplifier switches between different rails and power proceeding through the actuator is recovered on opposite rails.

Accordingly, these systems can be made with near 100% efficiency. With a conventional switching amplifier, capacitive loads dissipate power with every switching cycle equal to the energy stored in the capacitance. That is, the electrical reactance of a piezoelectric motor is different from that of an electromagnetic motor. Rather than looking inductive, the piezoelectric motor looks capacitive. Likewise, previous attempt to utilize piezoelectric actuators has resulted in problems of low electrical efficiency as the piezoelectric actuator looks like a capacitor electrically.

The power loss of not recovering the stored energy is easily computed as the energy stored in the capacitance, times the number of times the capacitance is charged to that energy per second:

$$E = \frac{fCV_{ss}^2}{2} \qquad \text{Eq. (3)}$$

where E is the energy lost, f is the mean frequency of the switching amplifier charging to a supply, C is the capacitance, and V is the voltage of the supply, assuming the capacitor is charged from ground to the supply. In most implantable devices, V is around 1.25 VDC. The supply current is then:

$$I = \frac{fCV_{ss}}{2} \qquad \text{Eq. (4)}$$

For a switching amplifier with f=1.28 MHz, C=650 nF, Vss=1.25 VDC, I is 0.532 A, which in some circumstances can be less than utilitarian for use in an implantable device. Likewise, E could be, in some circumstances, approximately 0.5 W of power dissipation with 11 μF piezoelectric motor/actuator. Again, this power loss is too large for use in an implantable device.

Unfortunately, the phase of the current and voltage of a conventional switching power supply are not in the correct direction to recover energy stored in the capacitors, and therefore this power would be lost even using the type of switching amplifier commonly used to drive electromagnetic motors. The inventor has recognized one solution for this problem: make the piezoelectric motor look like an electromagnetic motor, at least at high frequencies. This can be done by placing a (suitably damped) inductor in series with the piezoelectric motor. At frequencies above the resonant frequency $f_0$:

$$f_0 = \frac{1}{2\pi}\sqrt{\frac{1}{LC}} \qquad \text{Eq. (5)}$$

(where L is the inductance and C is the capacitance of the motor), the circuit will look inductive. The piezoelectric motor will no longer have Vss on it, but the much lower average voltage being demanded by the switching power supply. At high frequencies, the energy stored in the inductor will be returned to the power supply as in an electromagnetic motor, since it will look inductive and the current and voltages will be in the correct phase for recovery. If the inductance is selected to resonate at 8 kHz, it would have a value of $$L = \frac{1}{C \cdot (2\pi f_0)^2} \quad \text{Eq. (6)}$$

or 600 μH, a very modest-sized inductor. A simple estimate of the worst-case power loss can be estimated as about 1.28 MHz/8 kHz smaller, or 3.3 mA. This would occur only when the output is being driven at 8 kHz to maximum output, with no power at any other frequency. In practice, this number is considerably smaller when computed over the long term average speech spectrum (LTASS), although the estimate above doesn't include the switching amplifier losses or the critical damping resistor. A critical damping resistor would be $$R = \sqrt{\frac{L}{C}} \quad \text{Eq. (7)}$$

or R=30Ω for this example. This is also the minimum impedance for a series LRC circuit, with the impedance being dominated by the capacitor C at low frequencies, and the inductance L at high frequencies. For instance, at 3 kHz, the impedance will be $\sqrt{81.6^2+30.6^2}=87\Omega$, which is an acceptable impedance.

In summary, by putting an inductor in series with the motor, the switching amplifier sees an inductive load at high frequencies, and the change in the stored energy in the capacitance of the motor, and subsequent dissipation, is greatly reduced. Essentially, the inductance in combination with the motor capacitance form a filter which reduces the change in voltage from Vss every 640 kHz to a maximum of Vss every 16 kHz or so, a 40:1 reduction in power. This power reduction makes use of the PET actuator with an implantable device a feasible alternative to an electromagnetic actuator.

Figure 12:
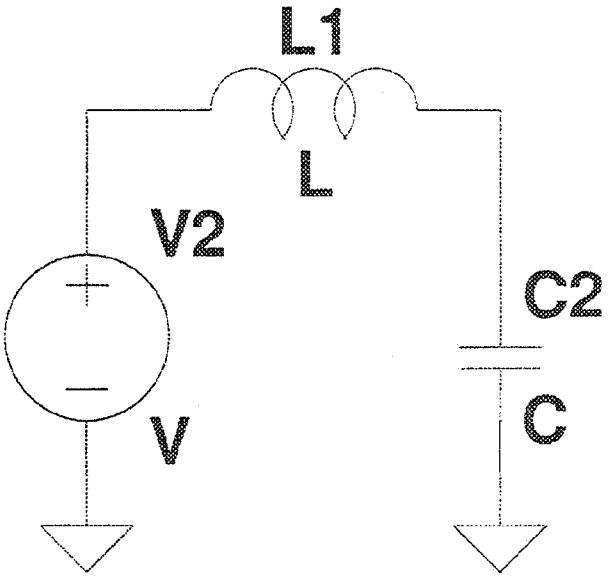
FIG. 12 illustrates incorporation of an inductor in series with a PET actuator.
Figure 12:
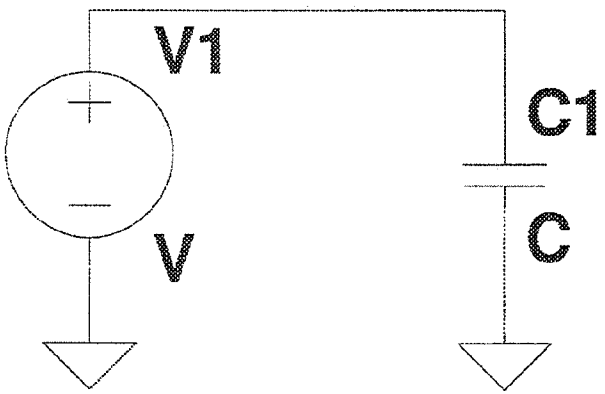

FIG. 12 provides one exemplary circuit of a BCT that utilizes a PET to apply a vibration to the implant housing Switching amplifiers are commonly used in hearing instruments for high efficiency to obtain long battery life. In normal operation, this high efficiency is obtained by using a load which is inductive. The load must be inductive at frequencies comparable to switching frequencies, and ideally at frequencies significantly lower. The input impedance of a piezoelectric actuator is largely capacitive (FIG. 12, left), however, and switching amplifiers by their nature are very inefficient when connected to such a load. However, the apparent impedance of a load to an amplifier can be modified by the use of a matching network, which converts the impedance of the load at one or more frequencies to a different impedance presented to the amplifier. One simple example is shown (FIG. 12, right). By inserting a series inductance with the piezoelectric actuator whose resonance is below the switching frequency, the load of the combined inductor and piezoelectric actuator will appear to be inductive. Of course, more complicated networks using inductors, capacitors, resistors, transformers, electromechanical devices, and the like can also be used in matching networks. The output from the amplifier can have, in some embodiments, at least one inductor in series on its output, to any additional circuit, and finally to the piezoelectric device. The inductance can be part of the leakage inductance of a transformer. The matching circuit can be selected to selectively shape the frequency response of the piezoelectric actuator as well.

In an exemplary embodiment, the displacement of the free end of the lever is greater than a deformation displacement of the piezoelectric element by at least about two times the deformation displacement of the piezoelectric element.

In an exemplary embodiment there is an implantable vibratory actuator for use in a bone conduction hearing instrument, comprising a housing having a hermetically sealed internal chamber, wherein the internal chamber includes a lever having a first end and a free second end, a piezoelectric element adapted to deform in response to an applied voltage, wherein deformation of the piezoelectric element displaces the free second end of the lever, wherein the displacement of the free end of the lever is greater than a deformation displacement of the piezoelectric element; and wherein displacement of the free end of the lever within the internal chamber imparts a vibration to the housing.

According to an exemplary embodiment of an apparatus as detailed above and/or below, the displacement of the free end is at least five times and/or tent times and/or two times the deformation displacement of the piezoelectric element According to an exemplary embodiment of an apparatus as detailed above and/or below, a force associated with the deformation of said piezoelectric element is mechanically applied to the lever between the first and second ends of the lever. According to an exemplary embodiment of an apparatus as detailed above and/or below, the piezoelectric element is disposed between the lever and an inside surface of the internal chamber of the housing. According to an exemplary embodiment of an apparatus as detailed above and/or below, the piezoelectric element comprises a stack of piezoelectric elements. According to an exemplary embodiment of an apparatus as detailed above and/or below, at least a portion of the piezoelectric element is displaced in conjunction with the displacement of the free end of the lever. According to an exemplary embodiment of an apparatus as detailed above and/or below, a first end of the piezoelectric element compliantly engages the lever proximate to the free second end. According to an exemplary embodiment of an apparatus as detailed above and/or below, a second end of the piezoelectric element compliantly engages a substantially non-compliant surface. According to an exemplary embodiment of an apparatus as detailed above and/or below, the first and second ends are compliantly attached to the lever and the non-compliant surface, respectively. According to an exemplary embodiment of an apparatus as detailed above and/or below, the first and second ends pivotally engage the lever and the non-compliant surface, respectively. According to an exemplary embodiment of an apparatus as detailed above and/or below, wherein the first end of the lever is connected to the substantially non-compliant surface. According to an exemplary embodiment of an apparatus as detailed above and/or below, the lever further comprises a flexible portion disposed between the first end and second end of the lever. According to an exemplary embodiment of an apparatus as detailed above and/or below, the flexible portion of the lever comprises a reduced cross-sectional area in relation to a cross-sectional area of an adjacent portion of the lever. According to an exemplary embodiment of an apparatus as detailed above and/or below, the piezoelectric element forms a portion of a vibrating mass of the vibratory actuator. According to an exemplary embodiment of an apparatus as detailed above and/or below, the housing, lever and piezoelectric element are non-magnetic materials. According to an exemplary embodiment of an apparatus as detailed above and/or below, wherein the free end of the lever arm has a resonant frequency of between 500 Hz and 1 kHz.

In an exemplary embodiment, there is an implantable vibratory actuator for use in a bone conduction hearing instrument, comprising: a housing having a base surface and a hermetically sealed internal chamber, the internal chamber including a lever having a first end fixedly connected to said housing and a free second end, wherein said second free end supports a mass, a piezoelectric element adapted to deform in a direction substantially aligned with said base surface in response to an applied voltage, wherein deformation displacement of the piezoelectric element applies a force to the lever to displace the free second end of the lever and said mass in a direction that is primarily normal to the base surface, wherein displacement of the mass within the internal chamber imparts a vibration to the housing.

According to an exemplary embodiment of an apparatus as detailed above and/or below, the apparatus further comprises an elongated rod having a first end attached to an outside surface of said housing, wherein the vibration imparted on said housing is transmitted through said rod to a free second end of said rod. According to an exemplary embodiment of an apparatus as detailed above and/or below, the displacement of said mass is greater than the deformation displacement of the piezoelectric element. According to an exemplary embodiment of an apparatus as detailed above and/or below, displacement of the mass is at least about two times the deformation displacement of the piezoelectric element.

In an exemplary embodiment, there is an implantable vibratory actuator for use in a bone conduction hearing instrument, comprising a housing having a hermetically sealed internal chamber, wherein the internal chamber includes a lever having a first end and a free second end, a piezoelectric element connected to said lever proximate to said second free end, wherein said piezoelectric element is adapted to deform in response to an applied voltage and wherein a deformation displacement of the piezoelectric element displaces the free second end of the lever and said piezoelectric element, and wherein displacement of the free end of the lever and said piezoelectric element within the internal chamber imparts a vibration to the housing.

According to an exemplary embodiment of an apparatus as detailed above and/or below, wherein the displacement of the free end of the lever is greater than the deformation displacement of the piezoelectric element. According to an exemplary embodiment of an apparatus as detailed above and/or below, in a static position, a length of the lever is substantially aligned with a base surface of said internal chamber, wherein upon displacement a direction of movement of the free second end of the lever has a primary component that is normal to the base surface. According to an exemplary embodiment of an apparatus as detailed above and/or below, a first end of the piezoelectric element compliantly engages a non-compliant surface within said housing and a second end of the piezoelectric element compliantly engages said lever.

In an exemplary embodiment, there is a method for use in implantable vibratory actuator of a bone conduction hearing instrument, comprising receiving a drive signal at an implanted housing, applying a voltage to a piezoelectric element within said housing in accordance with said drive signal to deform said piezoelectric element in a first direction, using a force associated with the deformation of said piezoelectric element to displace a free end of a lever supporting a mass within the housing, wherein the displacement of the mass is greater than deformation displacement of said piezoelectric element, wherein displacement of the free end of the lever and the mass within the internal chamber imparts a vibration to the implanted housing.

According to an exemplary embodiment of a method as detailed above and/or below, displacing the free end of the lever further comprises displacing the piezoelectric element. According to an exemplary embodiment of a method as detailed above and/or below, said drive signal represents an acoustic sound signal, wherein said imparted vibration is in accordance with said acoustic sound signal. According to an exemplary embodiment of a method as detailed above and/or below, the method further comprises receiving an acoustic signal at a sound input element, and generating said drive signal in response to said acoustic signal. According to an exemplary embodiment of a method as detailed above and/or below, said acoustic sound signal is received transcutaneously. According to an exemplary embodiment of a method as detailed above and/or below, transmitting said signal comprises transcutaneously receiving said drive signal from an external source.

In an exemplary embodiment, there is a bone conduction hearing instrument, comprising a speech processing unit operative to receive acoustic signals and generate a transducer drive signal, and an implantable bone conduction transducer operatively interconnected to said speech processing unit for receipt of said drive signal, said implantable bone conduction transducer including a housing having a hermetically sealed internal chamber, a lever, disposed within said internal chamber, having a first end and a free second end, said lever disposed in said internal chamber, a piezoelectric element, disposed within said internal chamber, adapted to deform in response to said drive signal, wherein deformation of the piezoelectric element displaces the free second end of the lever, wherein the displacement of the free end of the lever is greater than a deformation displacement of the piezoelectric element, wherein displacement of the free end of the lever within the internal chamber imparts a vibration to the housing.

According to an exemplary embodiment of a method as detailed above and/or below, said speech processing unit further comprises: a bio-inert housing, wherein said speech processing unit is adapted for subcutaneous implantation. According to an exemplary embodiment of a method as detailed above and/or below, said speech processing unit and said bone conduction transducer are operatively connected by a signal line. According to an exemplary embodiment of a method as detailed above and/or below, said speech processing unit further comprises a first coil and said bone conduction transducer further comprises a second coil, wherein said first and second coil are adapted for transcutaneous communication. According to an exemplary embodiment of a method as detailed above and/or below, said bone conduction transducer further comprises an energy storage device wherein said energy storage device provides energy to said piezoelectric element.

The foregoing description of the present invention has been presented for purposes of illustration and description.

Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain known modes of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

Figure 13:
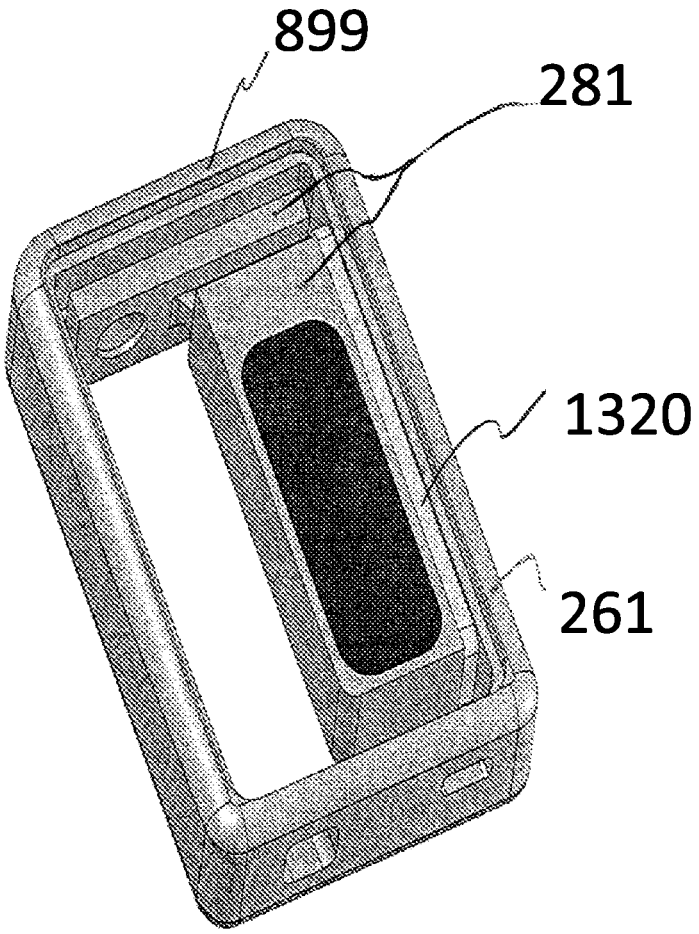
FIG. 13 depicts an isometric view of a portion of a BCT according to an exemplary embodiment.

Referring now to FIG. 13, there is an alternate embodiment of a bone conduction device, as will now be described. In at least some embodiments, this alternate embodiment corresponds to a modified embodiments of the embodiments associated with FIG. 8E, detailed above. More particularly, FIG. 13 depicts the housing subcomponent 899 of FIG. 8E in an isometric view, although the features of this embodiment can be applied to the other embodiments detailed herein and/or variations thereof. Interposed between the transverse lever arm 281 and the substantially rigid frame 261 is a dampener 1320. In an exemplary embodiment, dampener 1320 has a generally rectangular cross-section (albeit with rounded edges), and is relatively thin. In an exemplary embodiment, the thickness thereof is determined based on the distance between the frame 261 and the transverse lever arm 281. In this regard, in at least some embodiments, dampener 1320 extends from touching contact with the sidewall of the frame 261 to contact with the lateral side of the transverse lever arm 281. In some embodiments, the dimensions are such that the dampener 1320 is at least slightly compressed by the transverse lever arm 281 and the sidewall of the frame 261 when the arm is at rest, although in other embodiments, this is not the case (e.g. there is only negligible compression, if any compression at all, the dampener 1320 is slip fit in between the arm and the frame, etc.).

Some exemplary functionalities of the dampener 1320 without be described with respect to some exemplary dampener embodiments.

The peaks of the first, second and/or third fundamental frequencies detailed herein can be a source of detraction from the utilitarian use of a bone conduction device having the transverse lever arms detailed herein and/or variations thereof. With respect to the embodiments that will be described hereinafter, these embodiments are described with respect to specific fundamental frequencies of the bone conduction device. However, it is noted that these teachings can be applicable, in at least some embodiments, to the second and/or third fundamental frequencies, and visa-versa, unless otherwise specifically noted.

More particularly, as noted above, in an exemplary embodiment of a bone conduction device according to the teachings detailed herein and or variations thereof, the first fundamental frequency of such a device has a peek at about 900 Hz. This peak thus can cause distortion at a limited range on either side of and including that peak of 900 Hz (e.g. 25 Hz on either side, 50 Hz on either side, 75 Hz on either side, etc.), thus lessening the utilitarian value of the bone conduction device from that which might otherwise be the case in the absence of such a peak. The dampener 1320, in at least some embodiments, is configured to damp this peak and the output associated with frequencies at about this peak, and, in some embodiments, to do this without effectively reducing (including reducing) output power/output force from the bone conduction device at other frequencies.

In one embodiment of the dampener 1320, the dampener 1320 is a prefabricated pad that is placed in between the arm and the frame. In another embodiment, dampener 1320 is fabricated by applying a dampening material in between the arm and the frame. For example, the gap between the two opposing faces of those elements can be filled and/or at least substantially filled with this applied dampening material. By way of example only and not by way of limitation, dampener 1320 can be a mixture of silicone gel and glass beads. This mixture can be a relatively dense mixture, although other types of mixtures that can enable the teachings detailed herein and or variations thereof can be utilized in at least some embodiments.

In at least some embodiments, as the arm moves in the direction of axis 820, the arm places the dampener 1320 into shear. In at least some embodiments, the dampener 1320 damps (e.g., smoothes) the sharp resonance peak of the first fundamental frequency, which, in some embodiments, as detailed above, occurs at 900 Hz.

As noted above, in some embodiments, the peak of the first resonance frequency can be located at locations other than 900 Hz (e.g. 750 Hz, 1000 Hz 1100 Hz etc.). The dampener 1320 can be variously configured to dampen the peak that occurs at a given frequency. By way of example only and not by way of limitation, in an exemplary embodiment, the ratio of glass beads to silicone gel can be varied for a given dampener design. In this regard, there are bone conduction devices that are configured to have a ratio of glass bead to silicone gel (by volume and/or by mass) such that the first fundamental frequency resonance peak (or applicable fundamental frequency resonance peak) is dampened at a given frequency. Alternatively and/or in addition to this, the size/volume taken up by individual glass beads in the mixture can vary in some designs. That is, a given mixture can include relatively large beads and/or relatively small beads and/or relatively medium size beads, etc., altogether. Accordingly, in an exemplary embodiment, a wider variation in size of beads within the mixture can lead to tighter packing of the beads, and, therefore, a dampening effect at increased frequencies.

In an exemplary embodiment, the arrangement of the beads (glass or otherwise) reduce compression of the silicone relative to that which would be the case due to compression of the mixture (or just gel) by the arm during movement thereof. In an exemplary embodiment, the arrangement of the beads is such that the dampener provides a counterforce to the arm, thereby reducing the motion associated with the first, second and/or third modes/movement impacting the first, second and/or third fundamental frequencies.

In an exemplary embodiment, glass beads in the mixture can have a distribution of A and/or B and/or C and/or D and/or E and/or F and/or G and/or H and/or I and/or J and/or other distributions, where A, B, C, D, E, F, G, H, I and J are normalized volume values relative to the largest bead therein. For example, A can be 1 (corresponding to the volume of the largest bead therein, B can be about 0.9, C can be about 0.8, D can be about 0.7, E can be about 0.6, F can be about 0.5, G can be about 0.4, H can be about 0.3, I can be about 0.2, and J can be about 0.1.

Alternatively and/or in addition to this, the volume of individual beads can be controlled to be uniformly small or large to vary the dampening effect. Accordingly, in an exemplary embodiment, there is a bone conduction device that is configured to have a glass bead size distribution within the dampener such that the first fundamental frequency resonance peak (or other applicable fundamental frequency resonance peak) is dampened at a given frequency. Also, other types of solid media other than glass beads can be utilized (e.g., metallic beads, etc.).

Still further, in at least some exemplary embodiments, the amount of contact area between the arm and the frame can be varied to vary the dampening effect. In this regard, in an exemplary embodiment, there is a bone conduction device that is configured to have an arm-dampener contact area and/or a frame dampener contact area such that the first fundamental frequency resonance peak (or other applicable fun a middle frequency peak) is dampened at a given frequency.

As noted above, the teachings associated with dampening the resonance peak of the first fundamental frequency can be applicable, at least in some embodiments, to dampening the peaks of the second and/or for third fundamental frequencies. In this regard, in an exemplary embodiment, there is a bone conduction device that includes a dampener positioned between the arm (top and/or bottom) and the respective lid(s) of the bone conduction device (where FIG. 13 depicts the lids removed for clarity). In an exemplary embodiment, the configuration of this second fundamental frequency dampener is such that it is relatively more easily compressed than deformed by shear. In this regard, a dampener positioned above and/or below the arm as just noted that is relatively resistant to compression can lower the output force/output energy of the bone conduction device vis-à-vis first fundamental frequency as compared to a dampener that is less resistant to compression. Still, it is the shear properties associated with the dampener positioned in such a manner that drive the dampening associated with the second fundamental frequency. Thus, in an exemplary embodiment, there is a dampener placed above and/or below the arm that has a shear resistance such that the second fundamental frequency response peak is dampened at a given frequency, and has a compressive resistance that the output of the bone conduction device at the first of the middle frequency is effectively the same (including the same) as that which would be the case in the absence of the dampener.

It is further noted that in at least some exemplary embodiments, placement of the dampener above and/or below the arm can also dampen the peak of the third fundamental frequency.

In yet an alternative embodiment, a dampener can be located at the longitudinal end of the arm 281 (i.e., the side opposite the hinge 292) between the arm in the frame. In an exemplary embodiment, this can damp been the peaks of the first and/or second fundamental frequencies while lowering the power output of the third fundamental frequency. In this regard, in an exemplary embodiment, this dampener placed at the end of the arm has a resistance to shear that is such that the influence on restrictions of movements along axis 820 and axis 822 is generally limited and/or the influence on the output of the bone conduction device associated with the first and/or second fundamental frequencies is generally limited. Conversely, this dampener placed accordingly has a resistance to compression such that it significantly limits movements of the arm along axis 824/significantly limits the output of the bone conduction device at the third fundamental frequency.

It is noted that the materials from which the dampeners are made are but exemplary. Any device system and/or method that can be utilized to enable the dampening methods detailed herein and/or variations thereof can be utilized in at least some embodiments.

What is claimed is:

1. A vibratory apparatus, comprising:

a lever arm apparatus including a living hinge;

an actuator; and a frame, wherein the vibratory apparatus is configured such that at least a portion of the lever arm moves about the living hinge when the vibratory apparatus is generating vibrations, and the vibratory apparatus is a hearing prosthesis, wherein the actuator vibrates the lever arm and the lever arm is connected to the frame.

2. The vibratory apparatus of claim 1, wherein the vibratory apparatus is configured such that the movement of the lever arm apparatus about the living hinge generates the vibrations.

3. The vibratory apparatus of claim 1, further comprising:

a transducer in mechanical communication with the lever arm, wherein the vibratory apparatus is configured so as to impart a compressive force onto the transducer throughout all ranges of output and non-output of the compressive force by the transducer, thereby compressively prestressing the transducer.

4. The vibratory apparatus of claim 3, wherein:

the vibratory apparatus has a first fundamental frequency peak;

the lever arm includes a second living hinge that influences the first fundamental frequency peak; and the vibratory apparatus is configured such that the first fundamental frequency peak would be higher in the absence of the second living hinge.

5. The vibratory apparatus of claim 1, wherein:

the vibratory apparatus has a first fundamental frequency peak;

the lever arm includes a second living hinge that influences the first fundamental frequency peak; and the vibratory apparatus is configured such that the first fundamental frequency peak would be higher in the absence of the second living hinge.

6. The vibratory apparatus of claim 1, wherein:

the lever arm apparatus includes a second living hinge, wherein an aspect ratio thereof is such that a second fundamental frequency peak of the vibratory apparatus is located at a frequency that is about four times that of the frequency of a first fundamental frequency peak of the vibratory apparatus.

7. The vibratory apparatus of claim 1, further comprising:

a transducer in mechanical communication with the lever arm, the transducer configured to output compressive force, wherein the vibratory apparatus is configured so as to provide resistance to compressive force generated by the transducer throughout all ranges of output and non-output of the compressive force by the transducer.

8. The vibratory apparatus of claim 1, wherein the living hinge is located completely away from the actuator and the frame.

9. The vibratory apparatus of claim 1, further comprising:

a transducer configured to repeatedly apply a force to a first location of the lever arm offset from the living hinge, thereby moving the at least a portion of the lever arm about the living hinge in an oscillating manner to generate the vibrations, wherein all force applied by the transducer resulting from an expansion thereof is a purely compressive force.

10. The vibratory apparatus of claim 1, wherein the living hinge is located completely away from the actuator, and wherein the vibratory apparatus is configured such that the movement of the at least a portion of the lever arm about the living hinge generates the vibrations generated by the vibratory apparatus.

11. The vibratory apparatus of claim 1, wherein the lever arm has a free end, wherein the actuator is located completely away from portions of the lever arm between the free end and the living hinge.

12. The vibratory apparatus of claim 1, wherein the frame surrounds the actuator and the lever arm, and wherein the living hinge is a portion of the lever arm that has a geometry that is different than another portion of the lever arm.

13. The vibratory apparatus of claim 1, wherein:

the vibratory apparatus has a first fundamental frequency peak; and the lever arm includes a second living hinge that influences the first fundamental frequency peak.

14. A vibratory apparatus, comprising:

a lever arm apparatus including a living hinge, wherein the vibratory apparatus is configured such that at least a portion of the lever arm moves about the living hinge when the vibratory apparatus is generating vibrations, the vibratory apparatus further comprising a transducer configured to repeatedly apply a compressive force to a first location of the lever arm offset from the living hinge, thereby moving the at least a portion of the lever arm about the living hinge in an oscillating manner to generate the vibrations.

15. The vibratory apparatus of claim 14, wherein:

the offset and the lever arm are configured such that movement of the first location by a first distance corresponds to movement of a center of gravity of the at least a portion of the lever arm by a second distance that is substantially greater than the first distance.

16. The vibratory apparatus of claim 14, wherein the vibratory apparatus includes a frame, wherein an actuator vibrates the lever arm and the lever arm is connected to the frame, and wherein the transducer is located completely away from the living hinge.

17. A hearing prosthesis, comprising:

a vibratory apparatus, including:

a lever arm apparatus including a living hinge;

an actuator; and a frame, wherein the lever arm is connected to the frame, wherein the vibratory apparatus is configured such that the actuator moves the lever arm in a vibratory manner, and the vibratory apparatus is configured such that at least a portion of the lever arm moves about the living hinge when the vibratory apparatus is generating vibrations, wherein the living hinge is a section of reduced cross-section relative to portions of the lever arm apparatus directly on either side of the living hinge.

18. The hearing prosthesis of claim 17, wherein:

the lever arm apparatus has a first end that is free and a second end that is connected to the frame, wherein there is a first distance between the living hinge and the frame, and wherein a distance from the free end to the living hinge is greater than the first distance.

* * * * *